US009650202B2

(12) United States Patent
Okuno et al.

(10) Patent No.: US 9,650,202 B2
(45) Date of Patent: May 16, 2017

(54) FLUID CONTAINER AND FLUID CONSUMING DEVICE

(71) Applicant: SEIKO EPSON CORPORATION, Tokyo (JP)

(72) Inventors: Tokujiro Okuno, Kitakyushu (JP); Katsutomo Tsukahara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/644,738

(22) Filed: Mar. 11, 2015

(65) Prior Publication Data

US 2015/0259129 A1 Sep. 17, 2015

(30) Foreign Application Priority Data

Mar. 14, 2014 (JP) ..... 2014-051620

(51) Int. Cl.
*B65D 83/38* (2006.01)
*B41J 2/175* (2006.01)

(52) U.S. Cl.
CPC ..... *B65D 83/38* (2013.01); *B41J 2/17526* (2013.01)

(58) Field of Classification Search
CPC ..... B41J 2/17526; B41J 2/1752; B41J 2/1753
See application file for complete search history.

(56) References Cited

U.S. PATENT DOCUMENTS 5,500,664 A * 3/1996 Suzuki ..... B41J 2/17513 347/86
5,852,452 A * 12/1998 Imai ..... B41J 2/16511 347/30

(Continued)

FOREIGN PATENT DOCUMENTS

EP 1547783 A2 6/2005
JP 2003-341100 A 12/2003
JP 2005-238815 A 9/2005

*Primary Examiner* — Stephen Meier
*Assistant Examiner* — John P Zimmermann
(74) *Attorney, Agent, or Firm* — Stroock & Stroock & Lavan LLP

(57) ABSTRACT

A technique is provided to facilitate connection of a fluid container with a fluid consuming device and disconnection of the fluid container from the fluid consuming device by a simple configuration. There is provided a fluid container detachably connectable with a fluid consuming device. The fluid container comprises: a fluid container body at least partly made of a material having flexibility and configured to contain a fluid; a fluid supply structure located at one end portion of the fluid container body and configured to be connectable with a fluid introducing structure provided in the fluid consuming device; and a container-side electrical connection structure linked with the fluid supply structure and configured to have a contact arranged to come into contact with a device-side electrical connection structure provided in the fluid consuming device. The fluid supply structure and the container-side electrical connection structure are arranged in a positional relationship such that the contact of the container-side electrical connection structure is separated away from the fluid consuming device, prior to the fluid supply structure, when the fluid container is disconnected from the fluid consuming device.

11 Claims, 87 Drawing Sheets

F8-F8 PARTIAL CROSS SECTIONAL VIEW

(56) References Cited

U.S. PATENT DOCUMENTS

| | | | | |
|---|---|---|---|---|
| 6,749,292 | B2 * | 6/2004 | Sturgeon | B41J 2/1752 347/45 |
| 8,192,003 | B2 * | 6/2012 | Ishizawa | B41J 2/17509 347/86 |
| 8,231,209 | B2 * | 7/2012 | Koizumi | B41J 2/1752 347/84 |
| 8,857,956 | B2 * | 10/2014 | Tomoguchi | B41J 25/00 347/86 |
| 9,132,644 | B2 * | 9/2015 | Harada | B41J 2/1721 |
| 2003/0222940 | A1 | 12/2003 | Seino et al. | |
| 2004/0021737 | A1 * | 2/2004 | Harada | B41J 2/17553 347/49 |
| 2005/0001888 | A1 | 1/2005 | Seino et al. | |
| 2005/0036015 | A1 * | 2/2005 | Seino | B41J 2/17553 347/86 |
| 2005/0068382 | A1 | 3/2005 | Kimura et al. | |
| 2005/0248637 | A1 * | 11/2005 | Seino | B41J 2/1752 347/86 |
| 2007/0206076 | A1 | 9/2007 | Seino et al. | |
| 2009/0295885 | A1 * | 12/2009 | Wanibe | B41J 2/17506 347/86 |
| 2013/0182051 | A1 | 7/2013 | Aoki et al. | |
| 2016/0221349 | A1 * | 8/2016 | Aoki | B41J 2/17513 |

* cited by examiner

F8-F8 PARTIAL CROSS SECTIONAL VIEW

F10-F10 PARTIAL CROSS SECTIONAL VIEW

F18-F18 CROSS SECTIONAL VIEW

VIEWED FROM ARROW F23

F18a-F18a PARTIAL CROSS SECTIONAL VIEW

F26-F26 CROSS SECTIONAL VIEW

F47-F47 CROSS SECTIONAL VIEW

F49-F49 CROSS SECTIONAL VIEW

F58-F58 CROSS SECTIONAL VIEW

F61A-F61A PARTIAL CROSS SECTIONAL VIEW

F61B-F61B PARTIAL CROSS SECTIONAL VIEW

F64A-F64A PARTIAL CROSS SECTIONAL VIEW

F64B-F64B PARTIAL CROSS SECTIONAL VIEW

F72-F72 CROSS SECTIONAL VIEW

F73-F73 CROSS SECTIONAL VIEW

F76-F76 CROSS SECTIONAL VIEW

F86A-F86A PARTIAL CROSS SECTIONAL VIEW

F86B-F86B PARTIAL CROSS SECTIONAL VIEW

FLUID CONTAINER AND FLUID CONSUMING DEVICE

CROSS REFERENCE TO RELATED APPLICATION

This application claims priority to Japanese Patent Application No. 2014-051620 filed on Mar. 14, 2014, the entire contents of this application are incorporated by reference herein.

BACKGROUND

Technical Field

The present invention relates to a technique of supplying a fluid to a fluid consuming device.

Description of the Related Art

A known configuration of a fluid container has a casing and a fluid-containing bag placed in the casing (for example, JP 2005-238815A). This proposed technique provides a guide groove in the casing to connect and fix the fluid container to a printer.

SUMMARY

The above technique of JP 2005-238815A, however, needs positioning to connect a lock pin provided on the printer side with the guide groove. In some cases, there is a difficulty in smoothly connecting the lock pin with the guide groove. In an application providing a mechanism for positioning of the lock pin with respect to the guide groove in the fluid container, this may undesirably complicate the configuration of the fluid container. Additionally, the complicated mechanism provided in the fluid container may cause a difficulty in disposal of the fluid container after consumption of a fluid contained in the fluid container.

This problem is not limited to the fluid container provided to supply ink to the printer but is commonly found in any fluid container configured to supply a fluid to a fluid consuming device.

An object of the invention is accordingly to provide a technique that facilitates connection of a fluid container with a fluid consuming device and disconnection of the fluid container from the fluid consuming device by the simple configuration. Other needs with respect to the prior art include cost reduction, resource saving, easy manufacture and improvement of usability.

In order to solve at least part of the problems described above, the invention may be implemented by aspects described below.

(1) According to one aspect of the invention, there is provided a fluid container detachably connectable with a fluid consuming device. This fluid container comprises: a fluid container body at least partly made of a material having flexibility and configured to contain a fluid; a fluid supply structure located at one end portion of the fluid container body and configured to be connectable with a fluid introducing structure provided in the fluid consuming device; and a container-side electrical connection structure linked with the fluid supply structure and configured to have a contact arranged to come into contact with a device-side electrical connection structure provided in the fluid consuming device. The fluid supply structure and the container-side electrical connection structure are arranged in a positional relationship such that the contact of the container-side electrical connection structure is separated away from the fluid consuming device, prior to the fluid supply structure, when the fluid container is disconnected from the fluid consuming device.

In the course of disconnection of the fluid container from the fluid consuming device, the fluid container body may be unintentionally pushed and make the fluid scattered from the fluid supply structure to outside. In this case, when the contact of the container-side electrical connection structure is in contact with the device-side electrical connection structure of the fluid consuming device, the scattered ink may adhere to the contact part and may cause an electrical problem such as a short circuit. In the fluid container of this aspect, however, the fluid supply structure is located at one end portion of the fluid container. Accordingly, the configuration of the fluid container causes the contact of the container-side electrical connection structure to be separated away from the fluid consuming device, prior to the fluid supply structure, in the course of disconnection of the fluid container from the fluid consuming device. This reduces the likelihood of the electrical problem described above.

(2) In the fluid container of the above aspect, the container-side electrical connection structure may have a plurality of the contacts, surface of the plurality of contacts defines a virtual plane, and the virtual plane may be inclined with respect to a connecting direction of the fluid container with the fluid consuming device.

In the fluid container of this aspect, the virtual plane is inclined. Compared with a configuration that the virtual plane is arranged parallel to the connecting direction, the inclined configuration of this aspect reduces the likelihood that some shaving produced by scraping off the container-side electrical connection structure by the device-side electrical connection structure adheres to the contact. Compared with a configuration that the virtual plane is arranged perpicular to the connecting direction, the inclined configuration of this aspect increases the moving distance of the device-side electrical connection structure from the position of contact of the device-side electrical connection structure with the container-side electrical connection structure to the position of contact of the device-side electrical connection structure with the contact. The device-side electrical connection structure accordingly comes into contact with the contact, while rubbing against the surface of the container-side electrical connection structure. This removes the dust adhering to the device-side electrical connection structure or the container-side electrical connection structure from the contact. This ensures good electrical continuity between the contact and the device-side electrical connection structure.

(3) The fluid container of the above aspect may further comprise a handle member linked with the fluid supply structure and the container-side electrical connection structure.

The fluid container of this aspect uses the handle member to facilitate the operation of the fluid container.

(4) In the fluid container of the above aspect, at least part of the handle member may be covered by a cover member provided on the fluid consuming device in a state that the fluid container is connected with the fluid consuming device.

The fluid container of this aspect suppresses an operation of the handle member in the connecting state. This also reduces the likelihood that the handle member is damaged.

(5) According to another aspect of the invention, there is provided a fluid container detachably connectable with a fluid consuming device. The fluid container comprises a fluid supply structure configured to be connectable with a fluid supply connection unit of the fluid consuming device. The fluid supply connection unit comprises: a stationary structure supported by a casing of the fluid consuming device and configured to have a fluid introducing structure which the fluid supply structure is connected with; and a movable support structure supported by the stationary structure and configured to be movable in a first direction and in a second direction with supporting the fluid supply structure of the fluid container, the first direction being a direction approaching the stationary structure, the second direction being a direction moving away from the stationary structure. The movable support structure includes a guide structure having a support structure-side engagement element. The stationary structure includes a connection structure-side engagement element configured to be engaged with the support structure-side engagement element. The fluid supply structure is configured to be supported by the movable support structure and the connection structure-side engagement element is configured to move along the guide structure, when the fluid supply structure is connected with the fluid introducing structure or when the fluid supply structure is disconnected from the fluid introducing structure.

The fluid supply connection unit of the fluid consuming device includes a connection mechanism configured to connect the fluid container with the fluid consuming device and include, for example, the movable support structure, the guide structure and the connection structure-side engagement element. The fluid container of this aspect is connected with the fluid consuming device by means of the connection mechanism of the fluid consuming device. The fluid container accordingly does not need to have any complicated connection mechanism. This simplifies the configuration of the fluid container and facilitates disposal of the fluid container after consumption of the fluid.

(6) In the fluid container of the above aspect, the stationary structure may have a motion guide assembly and the motion guide assembly may have guide parts to guide motion of the movable support structure either in the first direction or in the second direction and the guide parts may be placed on respective sides across the guide structure.

The fluid supply connection unit includes the motion guide assembly, so that the fluid container of this aspect does not need to have any complicated mechanism for guiding the motion of the movable support structure either in the first direction or in the second direction. Accordingly this facilitates guiding of the fluid container either in the first direction or in the second direction and simplifies the configuration of the fluid container.

(7) In the fluid container of the above aspect, the fluid supply connection unit may have a main body-side electrical connection structure located between the guide parts of the motion guide assembly. The fluid container of this aspect may further comprise a contact configured to come into contact with a device-side electrical connection structure of the fluid consuming device.

In the fluid container of this aspect, the main body-side electrical connection structure is located between the guide parts of the motion guide assembly. This configuration causes the motion of the fluid container supported on the movable support structure to be guided by the motion guide assembly and thereby enables the contact to be smoothly connected with the main body-side electrical connection structure.

(8) In the fluid container of the above aspect, the movable support structure may be biased in the second direction. The connection structure-side engagement element may be engaged with the support structure-side engagement element when the contact comes into contact with the main body-side electrical connection structure. An area in which the contact is formed may be located in a third direction that passes through an engagement position where the connection structure-side engagement element is engaged with the support structure-side engagement element and is perpendicular to the second direction.

In the fluid container of this aspect, the movable support structure is likely to rotate about the engagement position of the support structure-side engagement element. The configuration of locating the contact on the engagement position suppresses a deviation of the contact from its designed position. This maintains good electrical continuity between the contact and the main body-side electrical connection structure.

(9) The fluid container of the above aspect may have a plurality of the contacts. Surface of the plurality of contacts defines a virtual plane and the virtual plane may be inclined with respect to the first A virtual plane defined by surface of the plurality of contacts may be inclined with respect to the first direction.

The inclined configuration of this aspect facilitates generation of a force having a vector component in the second direction opposite to the first direction, compared with a configuration that the contacts are arranged to make the virtual plane parallel to the first direction and are brought into contact with the electrical connection structure by a force in a direction perpendicular to the first direction. This makes the contact of the fluid container more easily separated from the electrical connection structure of the fluid consuming device when the fluid container is demounted from the fluid consuming device.

(10) The fluid container of the above aspect may further comprise a pushing part located on a second direction side of the fluid supply structure and configured to push the fluid supply structure in the first direction.

The fluid container of this aspect is readily moved in the first direction by simply pressing the pushing part. This makes the fluid supply structure more easily connected with the fluid supply connection unit.

(11) The fluid container of the above aspect may further comprise a pushing part located on a second direction side of the fluid supply structure and configured to push the fluid supply structure in the first direction. The motion guide assembly may have a plurality of guide restriction parts configured to restrict motion of the movable support structure in a direction perpendicular to the first direction. The pushing part may be located in an area defined by the plurality of guide restriction parts in a view from a second direction side, when the fluid supply structure is supported by the movable support structure and is connected with the fluid introducing structure or when the fluid supply structure is disconnected from the fluid introducing structure.

The fluid container of this aspect enables the operation of connecting the fluid supply structure with the fluid introducing structure or the operation of demounting the fluid supply structure from the fluid introducing structure by means of the motion guide assembly by simply pressing the pushing part.

(12) In the fluid container of the above aspect, the movable support structure may have a restriction element configured to restrict motion of movable support structure in a direction intersecting with the second direction. The restriction element may be provided to come into contact with an abutment part provided on the stationary structure.

The fluid container of this aspect reduces the likelihood that the movable support structure is moved in the direction intersecting with the second direction and is detached from the stationary structure. This accordingly suppresses a fall of the movable support structure from the fluid consuming device and a resulting damage by the fall.

(13) According to another aspect of the invention, there is provided a fluid consuming device which a fluid container configured to contain a fluid and have a fluid supply structure arranged to make a flow of the fluid to outside is detachably connectable with. The fluid consuming device comprises: a casing; a stationary structure supported on the casing and configured to have a fluid introducing structure which the fluid supply structure is connected with; and a movable support structure supported by the stationary structure and configured to be movable in a first direction and in a second direction with supporting the fluid supply structure of the fluid container, the first direction being a direction approaching the stationary structure, the second direction being a direction moving away from the stationary structure. The movable support structure includes a guide structure having a support structure-side engagement element. The stationary structure includes a connection structure-side engagement element configured to be engaged with the support structure-side engagement element. The movable support structure is configured to support the fluid supply structure and the connection structure-side engagement element is configured to move along the guide structure, when the fluid supply structure is connected with the fluid introducing structure or when the fluid supply structure is disconnected from the fluid introducing structure.

The fluid consuming device of this aspect includes a connection mechanism configured to connect the fluid container with the fluid consuming device and include, for example, the movable support structure, the guide structure and the connection structure-side engagement element. The fluid container accordingly does not need to have any complicated connection mechanism.

All the plurality of components included in the aspects of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described above to provide still another independent aspect of the invention.

For example, one aspect of the invention may be implemented as a device including one or more components among a plurality of components, i.e., a fluid container body, a fluid supply structure and a container-side electrical connection structure. In other words, this device may have or may not have the fluid container body. This device may have or may not have the fluid supply structure. This device may have or may not have the a container-side electrical connection structure. The "fluid container body" may include a fluid-containing vessel comprised of flexible walls.

For example, another aspect of the invention may be implemented as a device including one or more components among a plurality of components, i.e., a casing, a stationary structure and a movable support structure. In other words, this device may have or may not have the casing. This device may have or may not have the stationary structure. This device may have or may not have the movable support structure.

The respective aspects described above solve at least one of the various problems described above, i.e., downsizing of the device, cost reduction, resource saving, easy manufacture and improvement of usability. Part or all of the technical features in each of the aspects of the fluid container and the fluid consuming device described above may be applied to the device of the above aspect.

The invention may be implemented by any of various aspects other than the fluid container and the fluid consuming device, for example, a manufacturing method of the fluid container and a fluid consuming system including the fluid container and the fluid consuming device.

DESCRIPTION OF EMBODIMENTS

A. First Embodiment

A-1. Configuration of Fluid Consuming System

Figure 1:
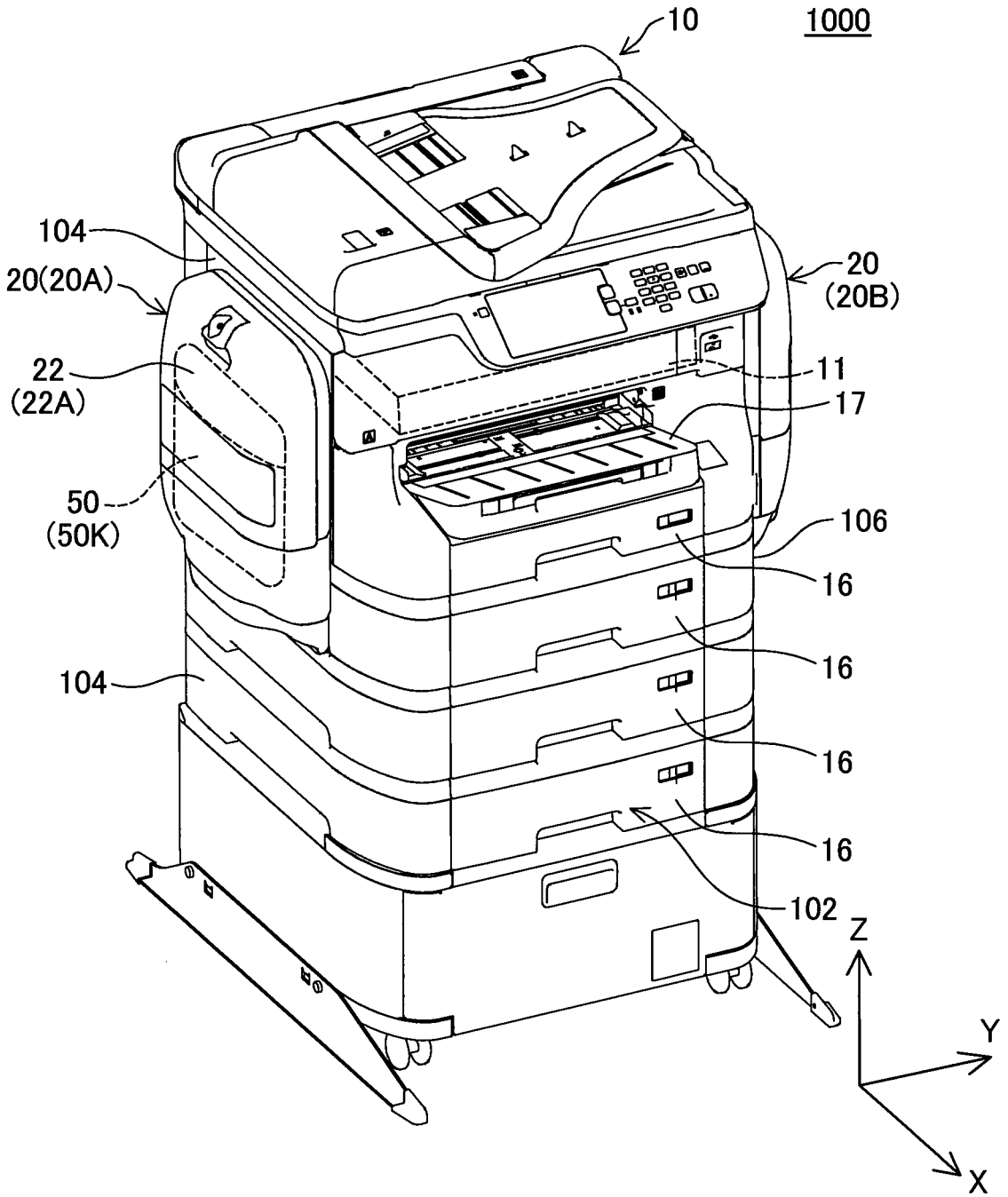
FIG. 1 is a first perspective view illustrating the general configuration of a fluid consuming system.
Figure 2:
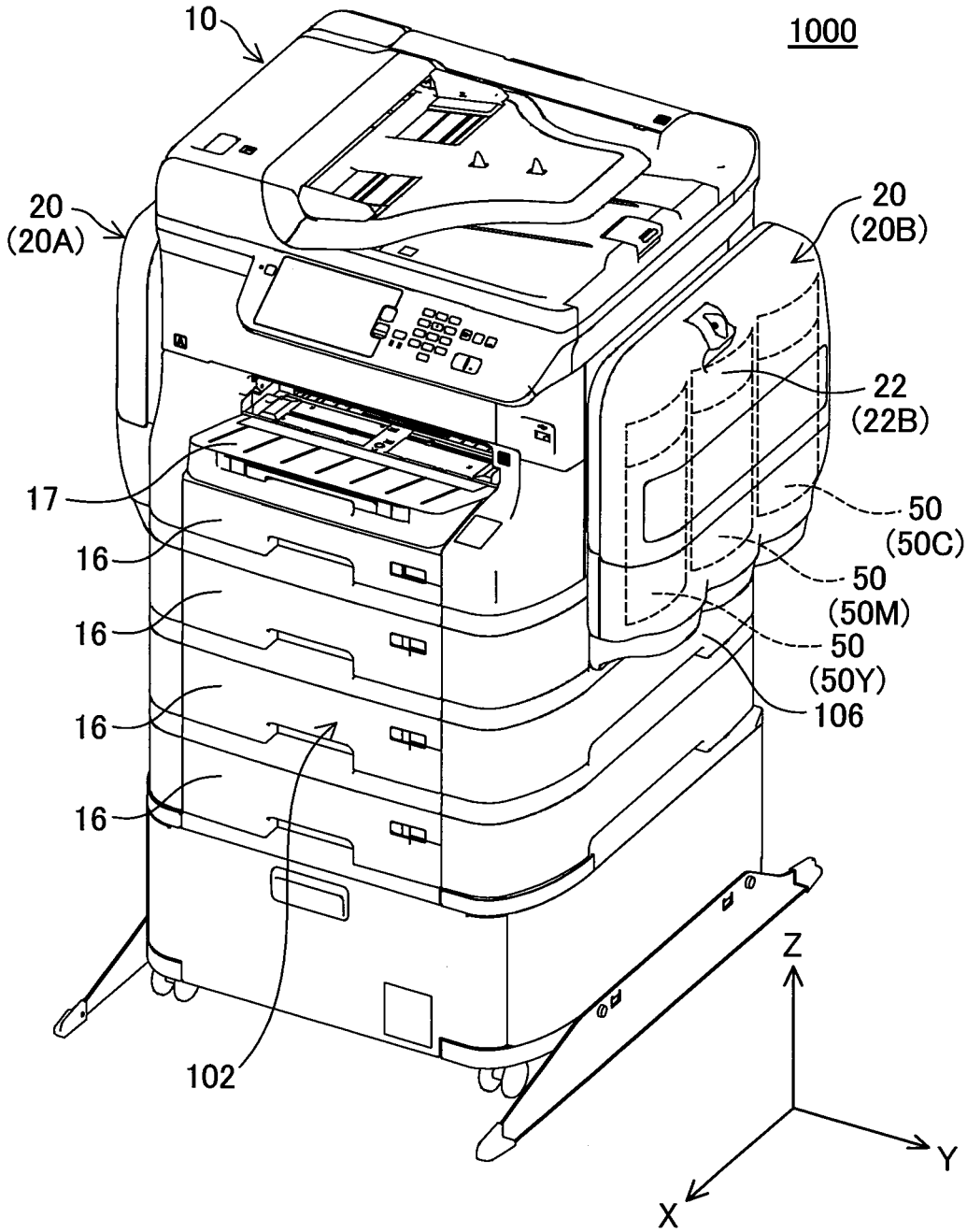
FIG. 2 is a second perspective view illustrating the general configuration of the fluid consuming system.
Figure 3:
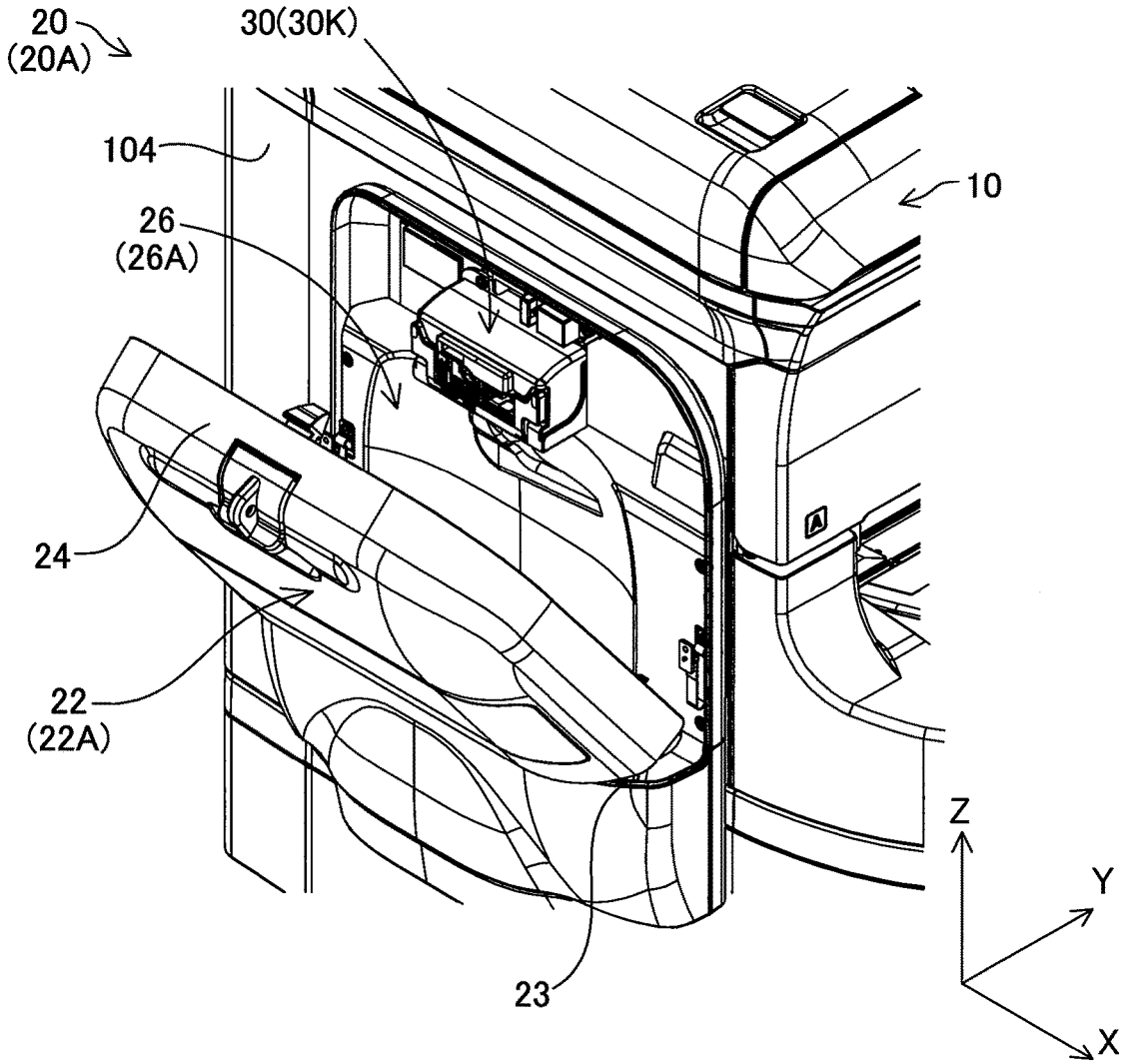
FIG. 3 is a first diagram illustrating a fluid supply device.
Figure 4:
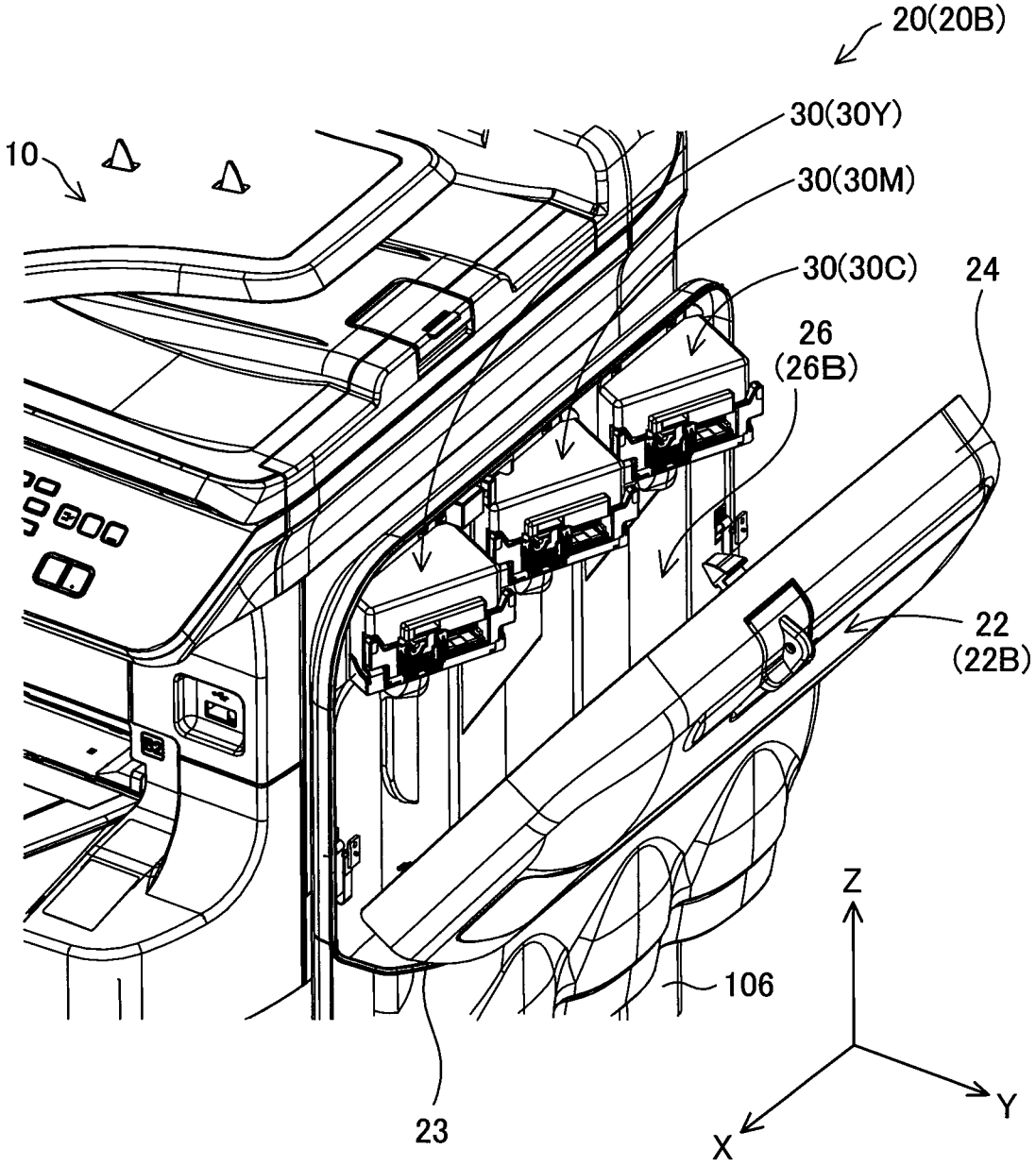
FIG. 4 is a second diagram illustrating the fluid supply device.
Figure 5:
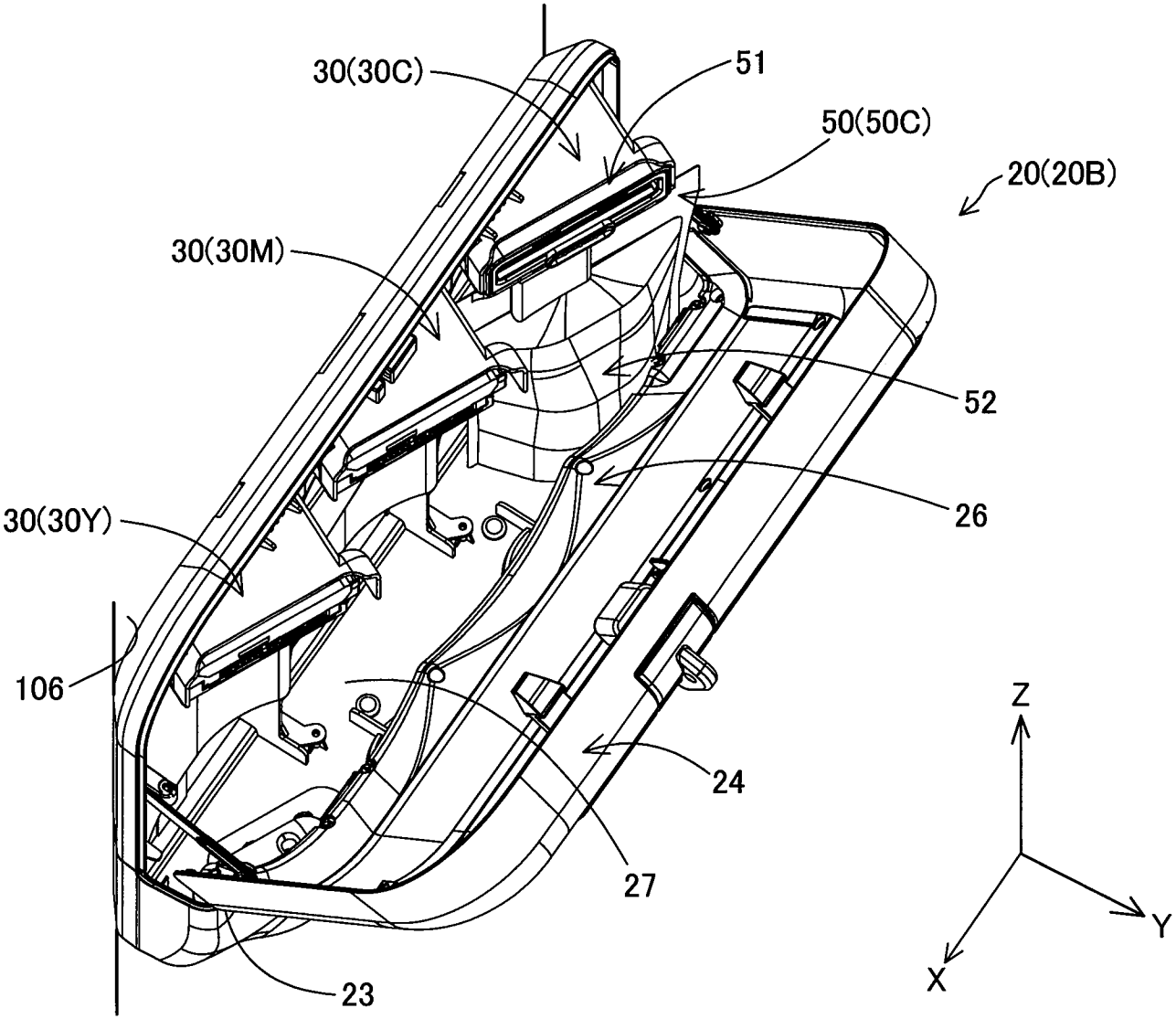
FIG. 5 is a third diagram illustrating the fluid supply device.

FIG. 1 is a first perspective view illustrating the general configuration of a fluid consuming system 1000. FIG. 2 is a second perspective view illustrating the general configuration of the fluid consuming system 1000. FIG. 3 is a first diagram illustrating a fluid supply device 20. FIG. 4 is a second diagram illustrating the fluid supply device 20. FIG. 5 is a third diagram illustrating the fluid supply device 20. FIGS. 3 and 4 illustrate the state that fluid containers 50 described later are demounted. FIG. 5 illustrates the state that one fluid container 50 is mounted. X-axis, Y-axis and Z-axis orthogonal to one another are shown in FIGS. 1 to 5.

As shown in FIG. 1, the fluid consuming system 1000 includes a printer 10 as a fluid consuming device and two fluid supply devices 20. In the use state of the fluid consuming system 1000, the printer 10 is placed on a horizontal plane defined by an X-axis direction and a Y-axis direction. In other words, a Z-axis direction is a vertical direction (direction of gravity, top-bottom direction); −Z-axis direction is vertically downward and +Z-axis direction is vertically upward. The fluid supply devices 20 are configured to supply inks as fluids to the printer 10. Each fluid container 50 (fluid containing unit 50) included in the fluid supply device 20 is detachably connected (attached) to the printer 10. At least part of the fluid supply device 20 may be regarded as a component of the printer 10. For example, the structure of the fluid supply device 20 excluding fluid containers described later may be regarded as a component of the printer 10.

The printer 10 is an inkjet printer. The printer 10 includes a recording mechanism 11, feed trays 16 and an eject tray 17. A plurality of the feed trays 16 are provided at different height positions in the vertical direction. The feed trays 16 are placed on a device first surface (device front surface) 102 constituting a front side of the printer 10. The feed trays 16 contain recording media (for example, paper sheets) on which images such as characters and letters are printed (recorded) by the printer 10.

The recording mechanism 11 includes a record head (not shown) configured to eject ink. The record head is connected with the fluid supply devices 20 through flow pipes such as tubes. The record head ejects ink supplied from the fluid supply device 20 on the recording medium to perform recording (printing). The recording medium after recording is discharged to the eject tray 17.

The two fluid supply devices 20 serve to supply inks to the printer 10. The two fluid supply devices 20 are respectively placed on a device second surface (also called device first side surface or device first side wall) 104 and a device third surface (also called device second side surface or device second side wall) 106 arranged to intersect with the device first surface (also called device front surface or device front wall) 102 of the printer 10. The device first surface 102 to the device third surface 106 are surfaces respectively perpendicular to the installation surface of the printer 10 in the use state of the printer 10. The device second surface 104 and the device third surface 106 are opposed to each other. In the description hereof, the fluid supply device 20 provided on the device second surface 104 is also called first fluid supply device 20A, and the fluid supply device 20 provided on the device third surface 106 is also called second fluid supply device 20B. When there is no necessity to distinguish between the first and the second fluid supply devices 20A and 20B, the first and the second fluid supply devices 20A and 20B are simply called fluid supply devices 20.

As shown in FIG. 1, the first fluid supply device 20A includes a cover member 22 as one fluid container housing member, one fluid container 50 and one mounting assembly unit (fluid supply connection unit) 30 (shown in FIG. 3). As shown in FIG. 2, the second fluid supply device 20B includes a cover member 22 as one fluid containing housing member, three fluid containers 50 and three mounting assembly units 30 provided corresponding to the respective fluid containers 50 (shown in FIG. 4). The two cover members 22 are distinguishable from each other by using symbols "22A" and "22B". The four fluid containers 50 are distinguishable from one another by using symbols "50K", "50C", "50M" and "50Y". The four mounting assembly units 30 are distinguishable from one another by using symbols "30K", "30C", "30M" and "30Y". The numbers of the cover members 22, the fluid containers 50 and the mounting assembly units 30 are not limited to this example. For example, the number of the fluid containers 50 may be three or less or may be five or more. The number of the mounting assembly units 30 may be determined corresponding to the number of the fluid containers 50. The number of the cover members 22 may be one or may be three or more.

The four fluid containers 50 contain (are filled with) different types of inks. According to this embodiment, yellow (Y), magenta (M), cyan (C) and black (K) inks are contained in the respective different fluid containers 50. The fluid container 50K has a fluid container body configured to contain black ink. The fluid container 50C has a fluid container body configured to contain cyan ink. The fluid container 50M has a fluid container body configured to contain magenta ink. The fluid container 50Y has a fluid container body configured to contain yellow ink. As shown in FIGS. 3 and 4, the fluid container 50 is contained in a housing space 26 defined by the cover member 22 for receiving the fluid container 50 therein. More specifically, the fluid container 50K is contained in a housing space 26A (shown in FIG. 3), and the fluid containers 50C, 50M and 50Y are respectively contained in housing space 26B (shown in FIG. 4). The mounting assembly unit 30 is placed in each housing space 26.

The mounting assembly units 30 shown in FIGS. 3 and 4 serve to mount the fluid containers 50 in a detachable manner. The mounting assembly unit 30K is placed inside of the cover member 22A, and the mounting assembly units 30C, 30M and 30Y are placed inside of the cover member 22B. As shown in FIG. 3, the mounting assembly unit 30K is provided on the device second surface 104 of the printer 10. As shown in FIG. 4, the mounting assembly units 30C, 30M and 30Y are provided on the device third surface 106 of the printer 10. In the state that the fluid container 50 is mounted on the mounting assembly unit 30, the ink contained in the fluid container 50 is supplied to the record head of the printer 10 by a supply mechanism (not shown) with a pump function included in the printer 10.

As shown in FIG. 3, the cover member 22A is attached to the device second surface 104 constituting an outer wall of the printer 10. As shown in FIG. 4, the cover member 22B is attached to the device third surface 106 constituting the outer wall of the printer 10. As shown in FIGS. 3 and 4, the cover member 22 is arranged to be openable and closable by rotating the other end portion (top) 24 on the upper side in the vertical direction about one end portion (bottom) 23 on the lower side in the vertical direction as the support point. After consumption of the ink contained in the fluid container 50, the user opens the cover member 22 and demounts the exhausted fluid container 50 from the mounting assembly unit 30. The use then mounts a new fluid container 50 to the mounting assembly unit 30 and closes the cover member 22. The exhausted fluid container 50 after ink consumption may be, for example, disposed.

As shown in FIG. 5, the cover member 22 has a bottom surface 27 constituting a bottom of the housing space 26. The bottom surface 27 is located below the mounting assembly unit 30 in the direction of gravity. The bottom surface 27 is arranged to be in contact with a bottom of the fluid container 50 (more specifically, bottom of a fluid container body 52). Alternatively, a protrusion may be provided on the bottom surface 27, such that the bottom of the fluid container 50 is in contact with the projection.

As shown in FIG. 5, the fluid container 50 includes a container body support assembly 51 and a fluid container body 52 connected with the container body support assembly 51. The container body support assembly 51 includes members (fluid supply assembly and circuit board described later) provided to be connected with the mounting assembly unit 30. In the state that the fluid container 50 is mounted to the mounting assembly unit 30 (i.e., in the mounting state), the fluid container body 52 is located below the container body support assembly 51 in the direction of gravity.

A-2. General Structure of Mounting Assembly Unit 30 and Mounting Method

Figure 6:
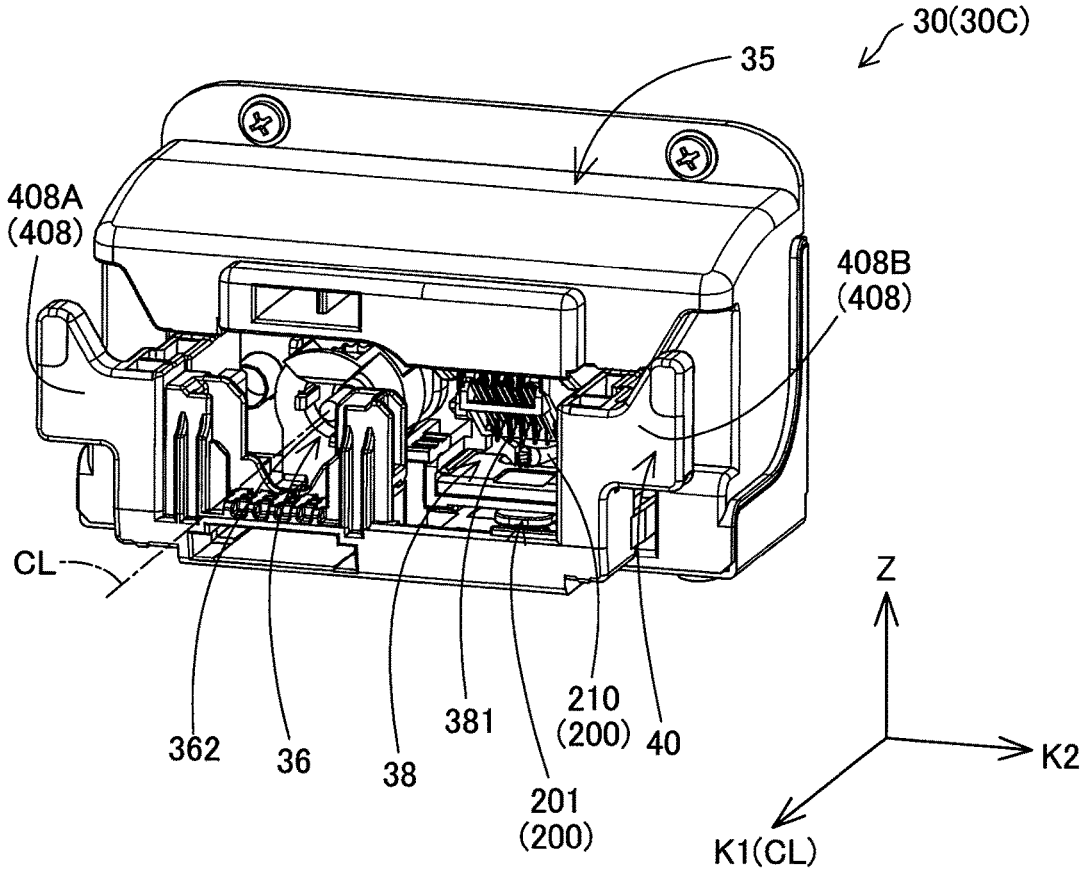
FIG. 6 is a first perspective view illustrating a mounting assembly unit.
Figure 7:
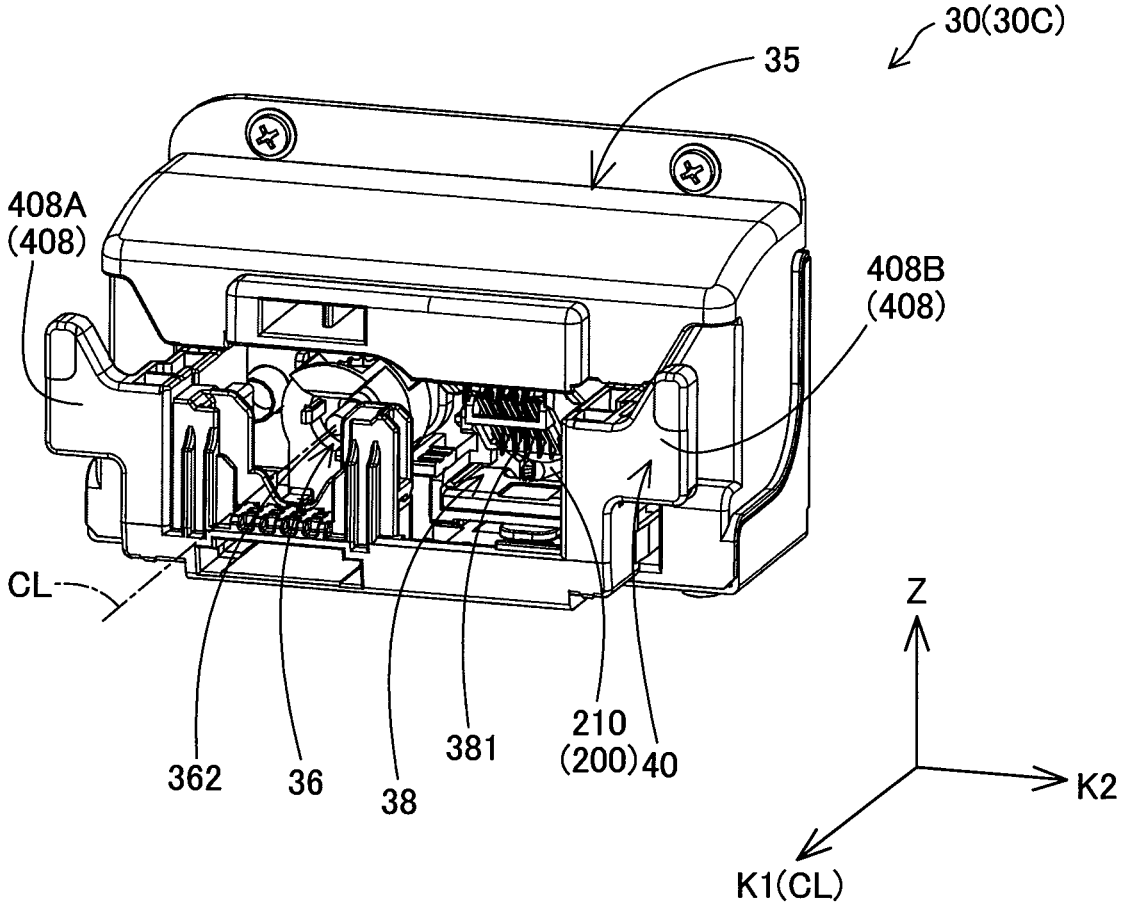
FIG. 7 is a second perspective view illustrating the mounting assembly unit.
Figure 8:
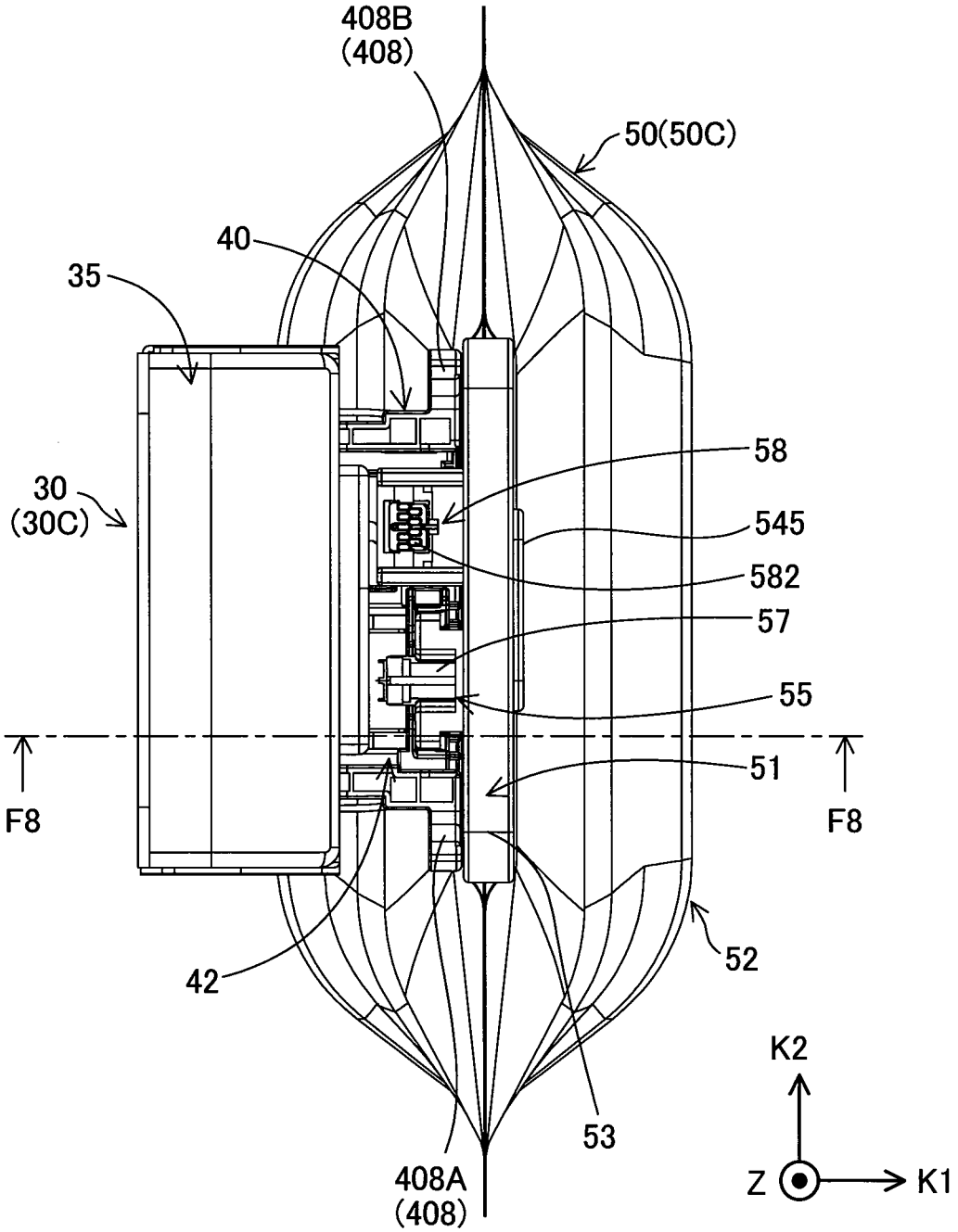
FIG. 8 is a top view of FIG. 6.
Figure 9:
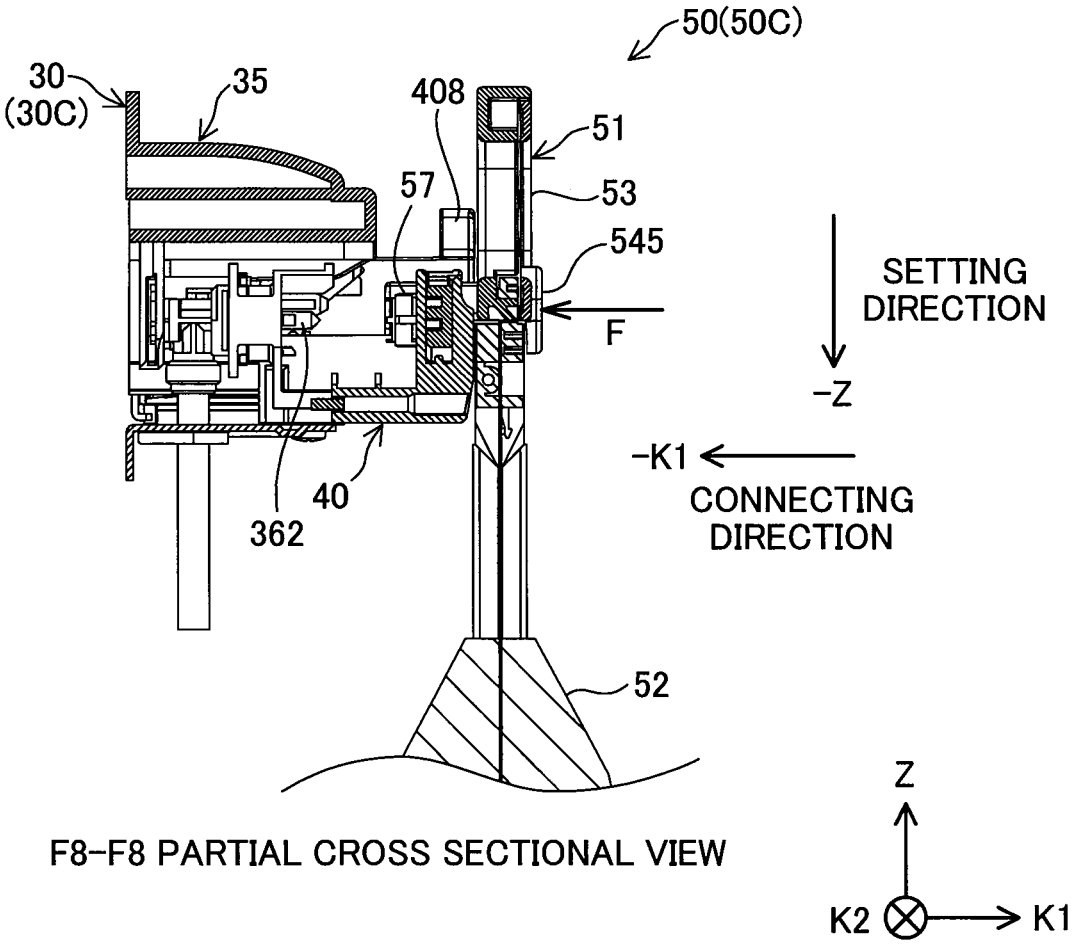
FIG. 9 is an F8-F8 partial cross sectional view of FIG. 8.
Figure 10:
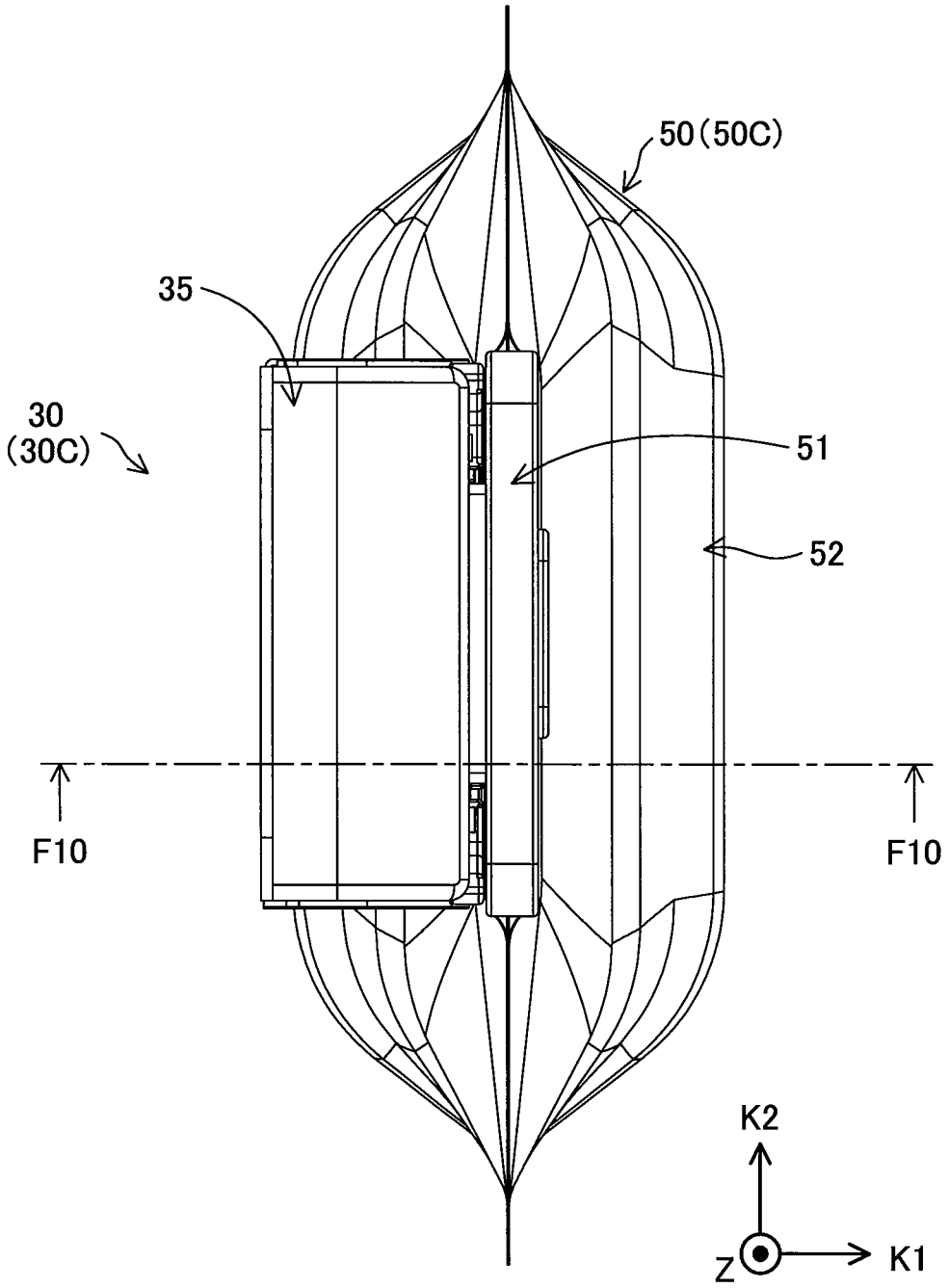
FIG. 10 is a top view of FIG. 7.
Figure 11:
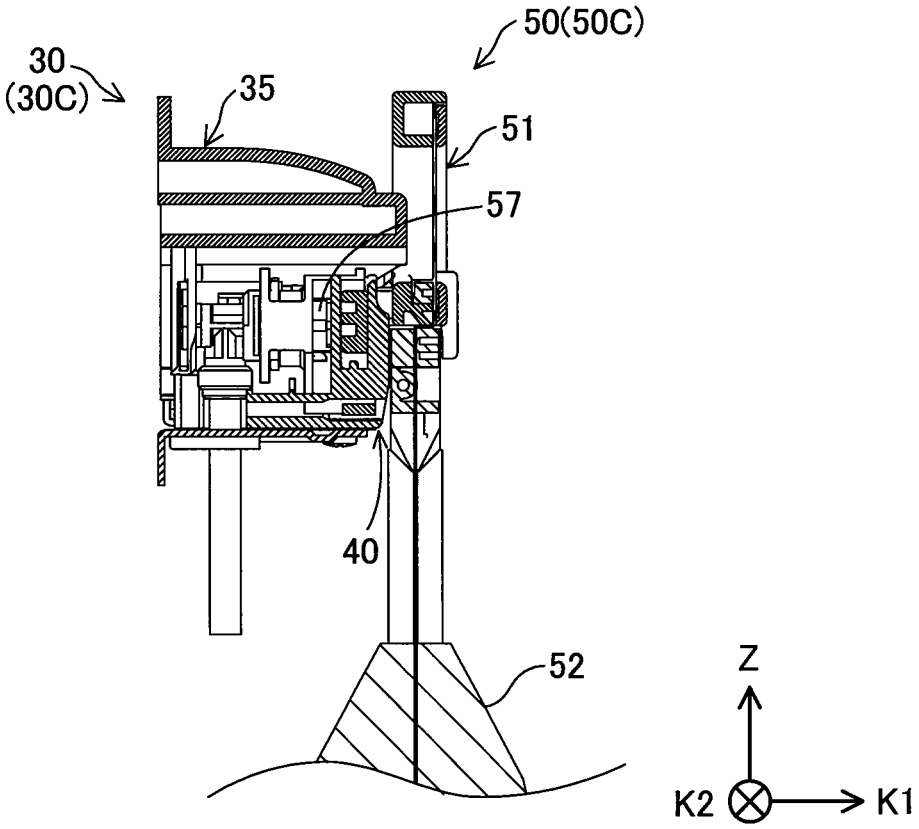
FIG. 11 is an F10-F10 partial cross sectional view of FIG. 10.

FIG. 6 is a first perspective view illustrating the mounting assembly unit 30. FIG. 7 is a second perspective view illustrating the mounting assembly unit 30. FIG. 8 is a top view of FIG. 6. FIG. 9 is an F8-F8 partial cross sectional view of FIG. 8. FIG. 10 is a top view of FIG. 7. FIG. 11 is an F10-F10 partial cross sectional view of FIG. 10. FIG. 6 illustrates a first state (setting state) in which a movable support structure (movable member) 40 is protruded most outward relative to a stationary member 35. FIG. 7 illustrates a second state (mounting state) in which the movable support structure 40 is placed in the stationary member 35. FIGS. 8 to 11 illustrate the fluid container 50 supported by the mounting assembly unit 30. The following describes the structure of the mounting assembly unit 30C as an example with reference to FIGS. 6 to 11. The other mounting assembly units 30K, 30M and 30Y have the same structures as that of the mounting assembly unit 30C. K1-axis, K2-axis and Z-axis orthogonal to one another are illustrated in FIGS. 6 to 11. The K1-axis, K2-axis and Z-axis are also illustrated in subsequent diagrams as appropriate.

As shown in FIGS. 6 and 7, the mounting assembly unit 30 includes the stationary member (stationary structure) 35 and the movable support structure (movable member) 40. The stationary member 35 is attached to and thereby supported by a casing of the printer 10 (for example, the device third surface 106 constituting the outer wall). The movable support structure 40 is supported on the stationary member 35 to be movable relative to the stationary member 35. More specifically, the stationary member 35 as the fluid supply connection unit guides the motion of the movable support structure 40 in a first direction (−K1-axis direction) or in a second direction (+K1-axis direction). The stationary member 35 is guided by a motion guide assembly of the stationary member 35 described later. The first direction is the connecting direction of the fluid container 50, and the second direction is the demounting direction of the fluid container 50. The movable support structure 40 includes a first protrusion member 408A and a second protrusion member 408B. The first and the second protrusion members 408A and 408B are plate-like members extended in the +Z-axis direction from the bottom of the movable support structure 40. The first protrusion member 408A has an upper end portion extended in the −K2-axis direction. The second protrusion member 408B has an upper end portion extended in the +K2-axis direction. In the state that the fluid container 50 is set in the movable support structure 40, the first and the second protrusion members 408A and 408B are arranged to face a handle member of the movable support structure 40 described later. When there is no necessity to distinguish between the first and the second protrusion members 408A and 408B, the first and the second protrusion members 408A and 408B are simply called "protrusion members 408".

As shown in FIG. 7, the stationary member 35 includes a fluid introducing unit (fluid introducing mechanism) 36 and an electrical connection unit (electrical connection mechanism, contact mechanism) 38. The fluid introducing unit 36 and the electrical connection unit 38 are aligned in the K2-axis direction. The fluid introducing unit 36 includes a fluid introducing structure 362 through which the ink contained in the fluid container 50 is introduced. The fluid introducing structure 362 is connected with the print head of the printer 10. The fluid introducing structure 362 is formed in a needle-like shape to have an inner cavity for an ink flow. The fluid introducing structure 362 has a center axis CL and has a tubular form extended in the direction of the center axis CL. The direction along the center axis CL (direction in which the fluid introducing structure 362 is extended) is the K1-axis direction. The K1-axis direction is orthogonal to the Z-axis direction and the K2-axis direction. The electrical connection unit 38 includes a plurality of device-side terminals 381. The plurality of device-side terminals 381 are in contact with a circuit board of the fluid container 50 to be electrically connected with the circuit board. According to this embodiment, the number of the device-side terminals 381 is nine.

The plane defined by the K1-axis direction and the K2-axis direction is parallel to the plane defined by the X-axis direction and the Y-axis direction shown in FIG. 1. With respect to the K1-axis direction, the outward direction of the printer 10 is the +K1-axis direction, and the inward direction of the printer 10 is the −K1-axis direction. As shown in FIGS. 6 and 7, the movable support structure 40 is supported on the stationary member 35 to be movable relative to the stationary member 35 in the K1-axis direction. The −K1-axis direction is the direction in which the movable support structure 40 approaches toward the stationary member 35, and the +K1-axis direction is the direction in which the movable support structure 40 moves away from the stationary member 35.

The fluid container 50 is mounted to the mounting assembly unit 30 by the following two operations. The state that the fluid container 50 is mounted to the mounting assembly unit 30 is also called "mounting state (connecting state)". The "mounting state (connecting state)" denotes the state that a fluid supply assembly 57 of the fluid container 50 (shown in FIG. 8) is connected with the fluid introducing structure (fluid introducing needle) 362 and that a circuit board 582 of the fluid container 50 (shown in FIG. 8) is electrically connected with the device-side terminals 381 of the mounting assembly unit 30. In the mounting state, the ink contained in the fluid container 50 can be flowed to the printer 10.

First Operation (Setting Operation):

The user makes the mounting assembly unit 30 in the first state and moves the fluid container 50 in the setting direction to be set in the movable support structure 40 (as shown in FIGS. 8 and 9).

Second Operation (Connecting Operation):

After the first operation, the user pushes the movable support structure 40 toward the stationary member 35-side via the fluid container 50 to make the mounting assembly unit 30 in the second state (as shown in FIGS. 10 and 11).

As shown in FIG. 9, the setting direction is the direction including a downward component in the direction of gravity. According to this embodiment, the setting direction is downward in the direction of gravity. The second operation is the operation of moving the movable support structure 40 in the −K1-axis direction.

As shown in FIGS. 8 and 9, after the mounting assembly unit 30 is made in the first state, the fluid container 50 is set at a predetermined position of the movable support structure 40. In the state that the fluid container 50 is set (in the setting state), the circuit board 582 of a substrate unit (container-side electrical connection structure) 58 in the fluid container 50 is arranged at a position facing the device-side terminals 381. In the setting state, the fluid supply assembly 57 of a fluid supply unit 55 in the fluid container 50 is arranged at a position facing the fluid introducing structure 362. As shown in FIG. 9, in the setting state, the fluid container 50 is supported by the movable support structure 40 to locate the fluid container body 52 below the container body support assembly 51 in the direction of gravity.

After the fluid container 50 is set in the movable support structure 40, as shown by an arrow F in FIG. 9, the user presses the fluid container 50 (more specifically, a pushing part 545) in the −K1-axis direction. This moves the fluid container 50 and the movable support structure 40 in the connecting direction (−K1-axis direction). When the pushing part 545 is pushed to move the fluid container 50 in the −K1-axis direction, an operation member 53 located above the pushing part 545 in the direction of gravity may be bent. In this case, the projection members 408 come into contact with the operation member 53 to suppress the deflection of the operation member 53. As shown in FIG. 11, in the second state of the mounting assembly unit 30, the fluid introducing structure 362 is inserted in (connected with) the fluid supply assembly 57. In the second state, the circuit board 582 (more specifically, contacts described later) comes into contact with the device-side terminals 381 of an electrical connection structure (shown in FIG. 7), so that the circuit board 582 is electrically connected with the device-side terminals 381.

In the second state of the mounting assembly unit 30, the motion of the movable support structure 40 relative to the stationary member 35 in the +K1-axis direction is restricted by a lock mechanism 200 of the mounting assembly unit 30. In the second state, the lock mechanism 200 is unlocked by pressing the movable support structure 40 inward (−K1-axis direction, first direction) relative to the stationary member 35. The movable support structure 40 may subsequently be moved to be protruded outward (+Z-axis direction) relative to the stationary member 35, so that the state of the mounting assembly unit 30 may be changed over from the second state to the first state. FIGS. 6 and 7 illustrate an engagement member 201 and a spring 210 arranged to bias the engagement member 201 in the lock mechanism 200. The engagement member 201 has an element (connection structure-side engagement element) to be engaged with the movable support structure 40. This engagement restricts the motion of the movable support structure 40 in the +K1-axis direction. The engagement element 201 is located immediately below the contact mechanism 38.

A-3. Detailed Structure of Fluid Container 50

Figure 12:
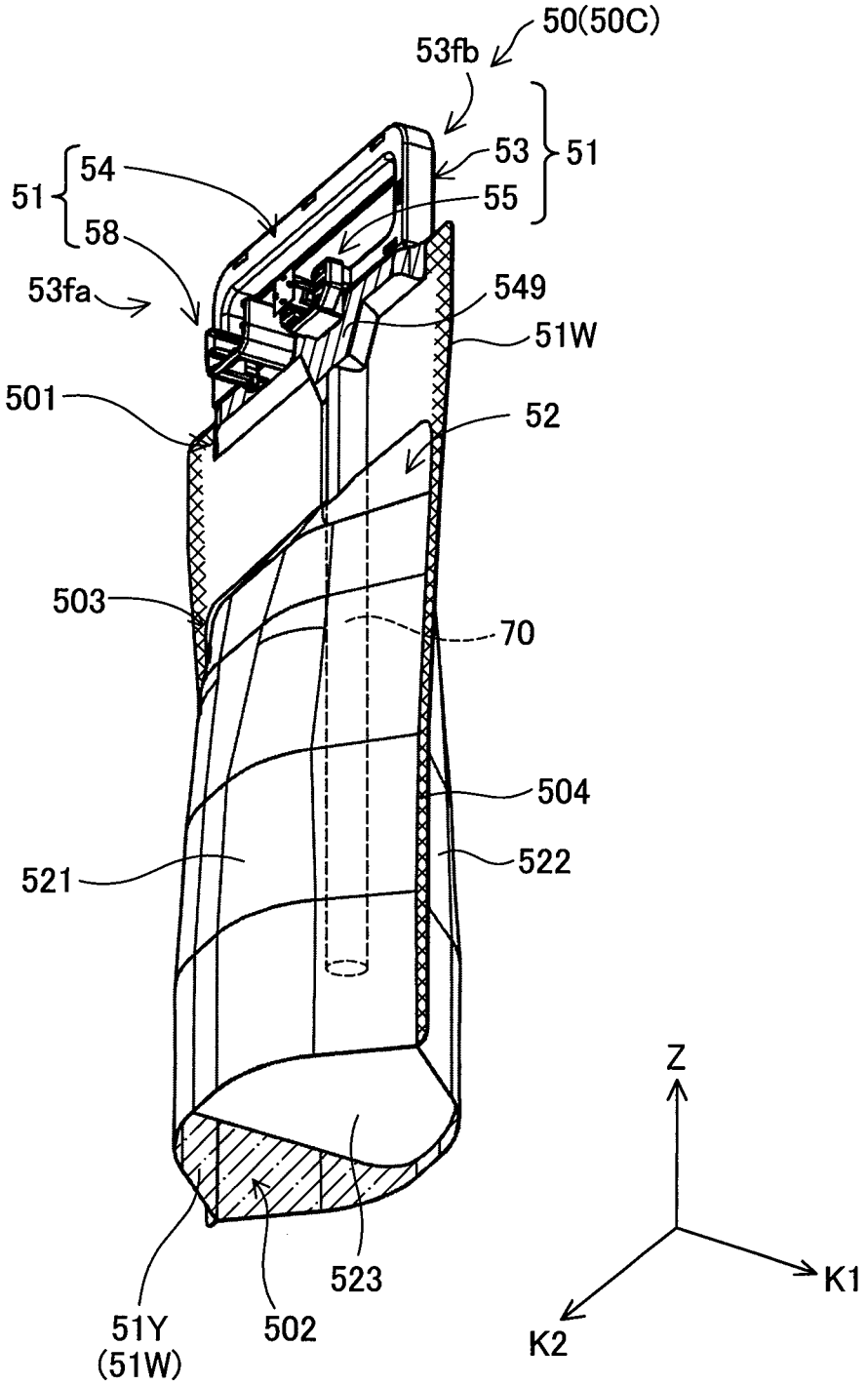
FIG. 12 is a first perspective view illustrating a fluid container.
Figure 13:
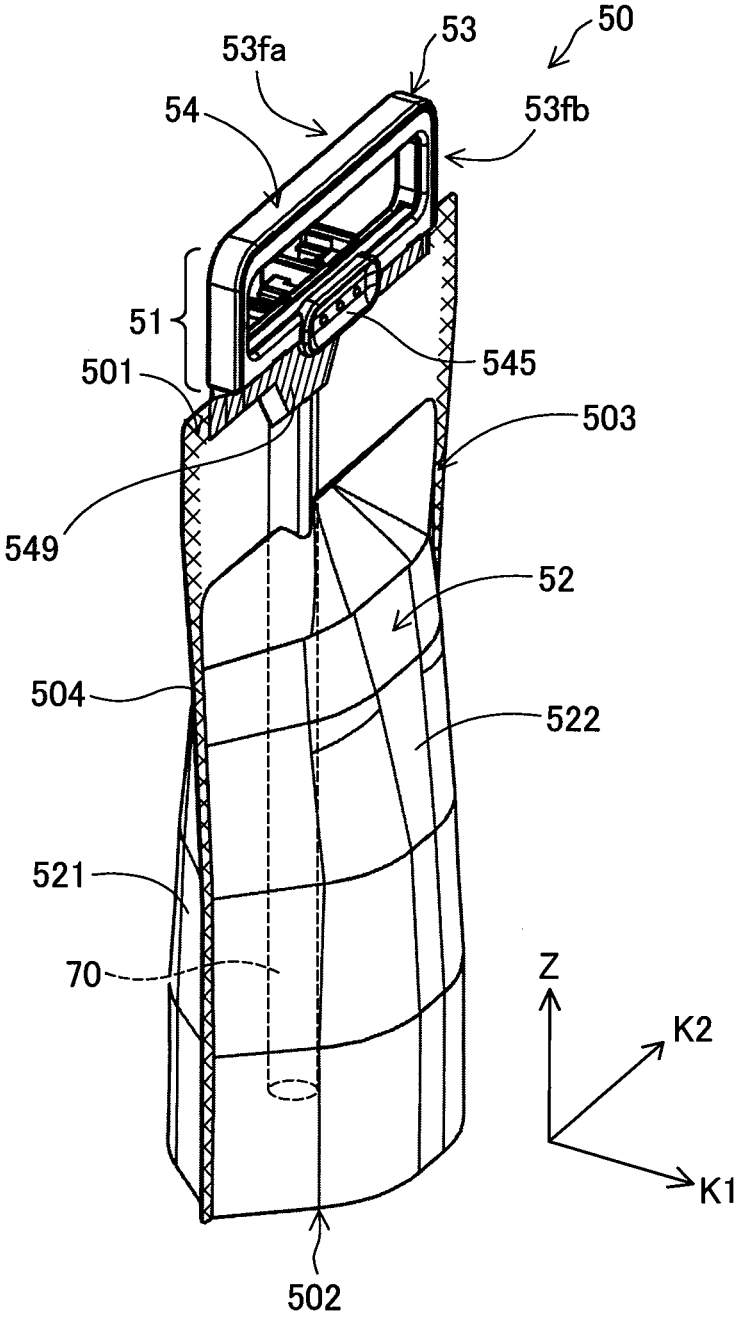
FIG. 13 is a second perspective view illustrating the fluid container.

FIG. 12 is a first perspective view illustrating the fluid container 50. FIG. 13 is a second perspective view illustrating the fluid container 50. FIGS. 12 and 13 show the Z-axis, the K1-axis and the K2-axis in the state that the fluid container 50 is mounted to the mounting assembly unit 30 (in the mounting state). FIGS. 12 and 13 also illustrate the fluid container 50 in the state of being filled with ink as a fluid before the fluid container 50 is mounted to the mounting assembly unit 30 (before the ink is consumed by the printer 10) (i.e., unused state, initial stage). The following describes the structure of the fluid container 50C as an example with reference to FIG. 12 and subsequent diagrams. The other fluid containers 50K, 50M and 50Y have the same structures as that of the fluid container 50C.

The Z-axis, the K1-axis and the K2-axis orthogonal to one another are illustrated as follows. In the state that the fluid container 50 is connected with the printer 10, the Z-axis direction is the direction of gravity (vertical direction). The +Z-axis direction is upward in the direction of gravity (vertically upward), and the −Z-axis direction is downward in the direction of gravity (vertically downward). The Z-axis direction is also called third direction. The K1-axis direction along the K1-axis is horizontal direction. The −K1-axis direction is the connecting direction (moving direction, first direction) of the fluid container 50 when the fluid container 50 is connected to the printer 10. More specifically, as described later, in the course of connection of the fluid container 50 to the printer 10, the fluid supply unit 55 described later (shown in FIG. 12) is moved in the connecting direction (−K1-axis direction), so that the fluid supply unit 55 (more specifically, the fluid supply assembly 57) is connected with the fluid introducing structure (fluid receiving structure) 362 provided on the printer 10, the substrate unit 58 (more specifically, the circuit board 582) is connected with the device-side terminals 381 of the electrical connection structure (shown in FIG. 6) provided on the printer 10. The +K1-axis direction is the demounting direction in which the fluid container 50 is demounted from the printer 10. The connecting direction is the −K1-axis direction that is the horizontal direction in this embodiment, but is not restrictive. The connecting direction may be any direction including a horizontal direction component. The K2-axis direction is the direction orthogonal to both the direction of gravity (Z-axis direction) and the K1-axis direction.

As shown in FIG. 12, the fluid container 50 includes the fluid container body 52 and the container body support assembly 51 attached to the fluid container body 52. The fluid container body 52 is configured to contain ink as the fluid. The fluid container body 52 is attached to the container body support assembly 51 in the state that the outer surface of the fluid container body 52 is exposed. In other words, the fluid container body 52 is not placed in a casing but is made visible from outside. The fluid container body 52 has the volume decreasing with a decrease in amount of the ink contained. In the description below, a −K1-axis direction side of the fluid container 50 is expressed as first side 53*fa*, and a +K1-axis direction side is expressed as second side 53*fb*.

The fluid container body 52 includes a first film 521, a second film 522 and a third film 523. The first to the third films 521 to 523 are arranged to define an inner space for containing ink. A side of the fluid container body 52 attached to the container body support assembly 51 is expressed as one end portion (one end portion, upper end portion) 501-side, and a side opposite to the one end portion 501 is expressed as the other end portion (the other end portion, bottom end portion) 502-side. One end portion side (+K2-axis direction side) of the fluid container body 52 is expressed as first side end portion (first side end portion) 503-side, and the other end portion side (−K2-axis direction side) is expressed as second side end portion (second side end portion) 504-side.

As shown in FIGS. 12 and 13, in the mounting state of the fluid container 50, the first film 521 and the second film 522 constitute a side surface of the fluid container body 52. In the mounting state of the fluid container 50, the third film 523 constitutes a bottom surface of the fluid container body 52. The first film 521 and the second film 522 are arranged to face each other. The first film 521 and the second film 522 respectively have peripheral areas 51W partly welded. More specifically, a one end portion 501-side part, a first side end portion 503-side part and a second side end portion 504-side part of the peripheral areas 51W are welded. In order to facilitate understanding, the welded parts of the first film 521 to the second film 522 are shown by cross-hatching in FIGS. 12 and 13. The container body support assembly 51 is welded to the one end portion 501 of the fluid container body 52 (more specifically, the one end portions of the first and the second films 521 and 522). In other words, the container body support assembly 51 is a member located on the one end portion 501 of the fluid container body 52. In order to facilitate understanding, the welded part of the container body support assembly 51 to the first and the second films 521 and 522 is shown by the solid line single-hatching in FIGS. 12 and 13.

As shown in FIG. 12, a peripheral area 51Y of the third film 523 is welded to part of the peripheral areas 51W of the first and the second films 521 and 522. The welded part of the third film 523 to the first and the second films 521 and 522 is shown by the one-dot chain line single-hatching. As described above, the fluid container body 52 of the embodiment is in a form that the three films 521, 522 and 523 are bonded by, for example, welding (pouch-like form having a bottom surface).

The first to the third films 521 to 523 are members having flexibility. The material used for the first to the third films 521 to 523 may be, for example, polyethylene terephthalate (PET), nylon or polyethylene. The first to the third films 521 to 523 may have layered structure formed by stacking a plurality of films made of these materials. In the layered structure, for example, an outer layer may be made of PET or nylon having excellent impact resistance, and an inner layer may be made of polyethylene having excellent ink resistance. A film having a deposited layer of, for example, aluminum may be included as one component member of the layered structure. This enhances the gas barrier property and suppresses, for example, a change in concentration of the ink contained in the fluid container body 52. In this manner, the material of the fluid container body 52 may be determined arbitrarily.

The shape and the size of the fluid container body 52 may be determined arbitrarily. For example, the fluid container body 52 containing black ink may be made to have the larger capacity (larger size) than that of the fluid container body 52 containing another color ink (for example, cyan ink). According to this embodiment, the fluid container body 52 is in the form that the first to the third films 521 to 523 are bonded by, for example, welding. The fluid container body 52 may alternatively be in a form that the first and the second films 521 and 522 are bonded by, for example, welding with omission of the third film 523 (pillow-like form). As described above, the fluid container body 52 and the operation member 53 are separate members. Accordingly, the type of the fluid container body 52 (shape, size and material) may be readily changed, while the same operation member 53 is employed. In other words, the shape, the size and the material of the fluid container body 52 may be determined according to the properties and the volume of the fluid to be contained in the fluid container body 52. This increases the flexibility of design.

The container body support assembly 51 includes the operation member (handle member) 53, the fluid supply unit 55 and the substrate unit (container-side electrical connection structure) 58. The operation member 53 is a frame-like member open in the K1-axis direction. The operation member 53 has a grip part 54 located on its +Z-axis direction side end portion and the pushing part 545 located on its −Z-axis direction side (shown in FIG. 13). The grip part 54 is a part grasped by the user to support the fluid container 50. The grip part 54 is extended along the K2-axis direction.

Figure 18:
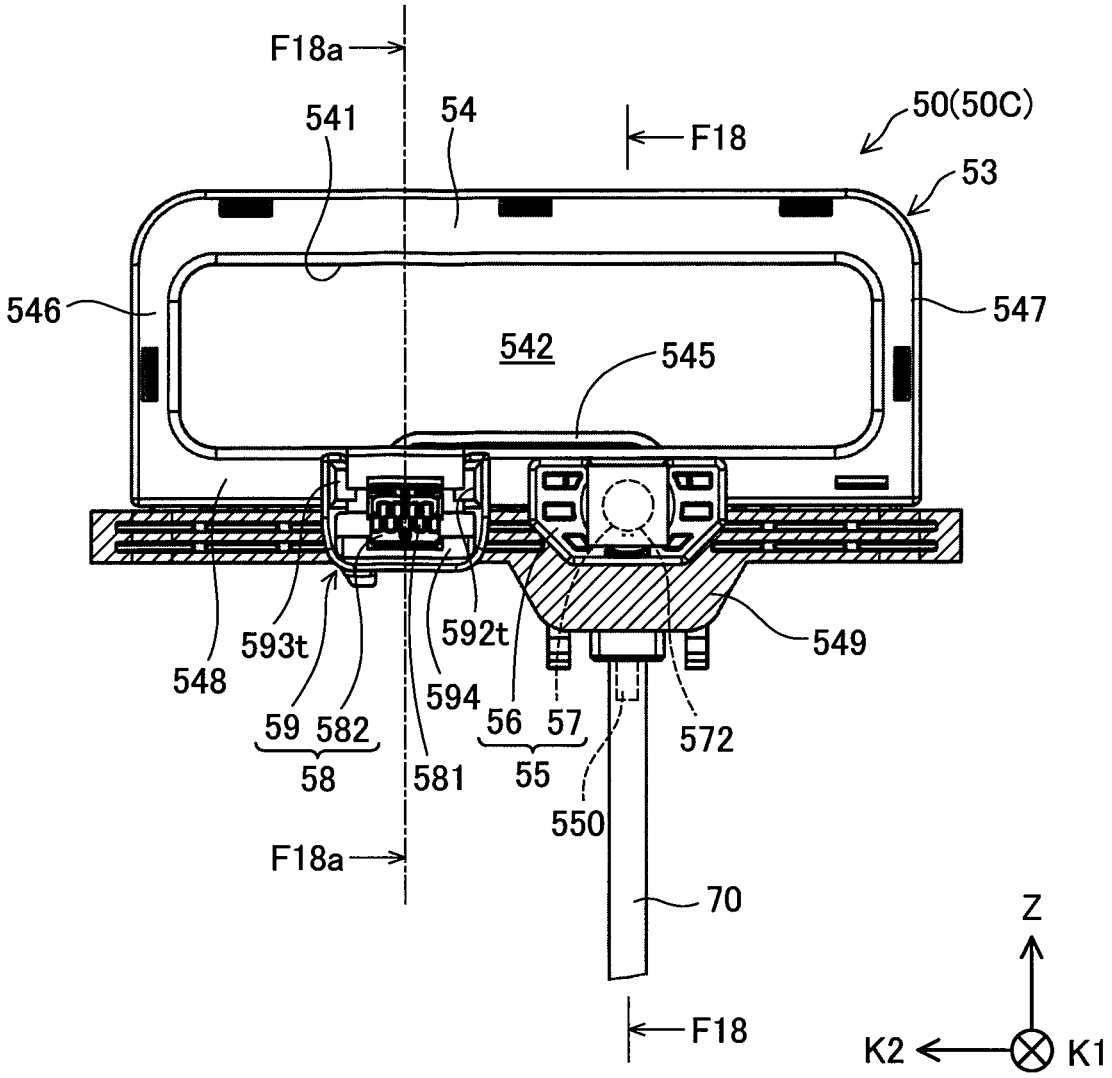
FIG. 18 is a front view illustrating part of the fluid container.
Figure 19:
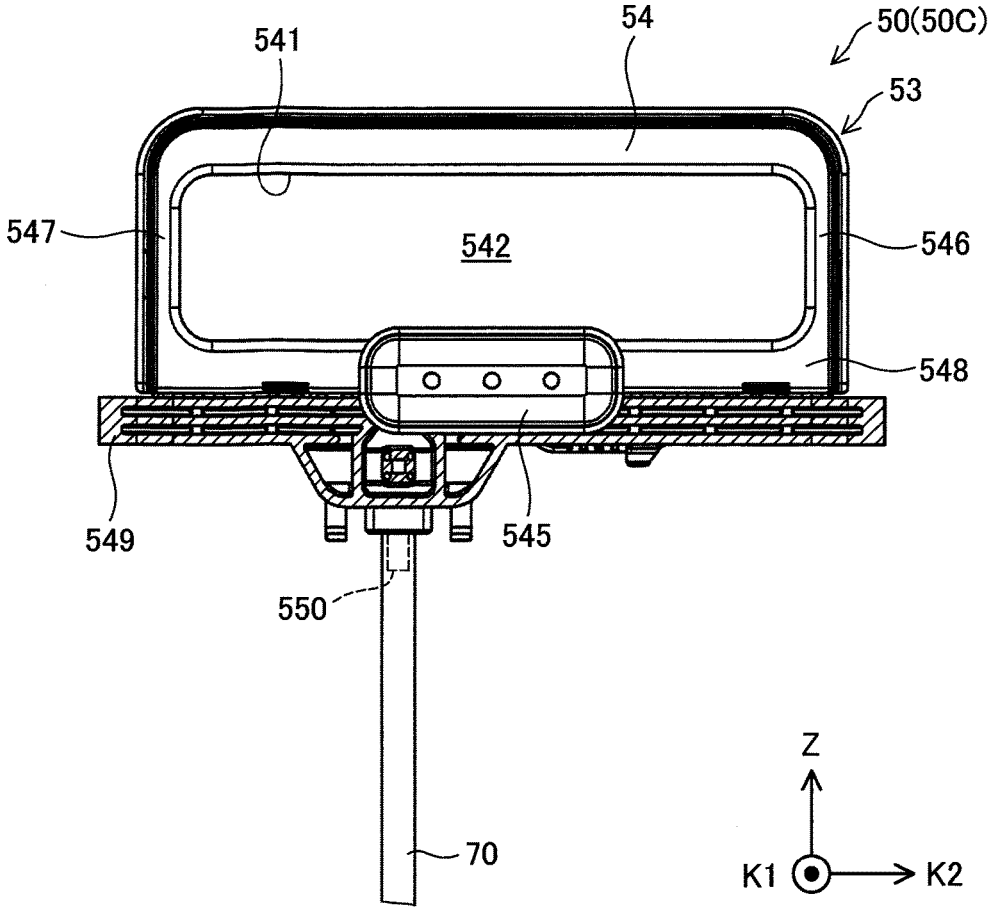
FIG. 19 is a rear view illustrating part of the fluid container.

The pushing part 545 is a part pushed by the user when the fluid container 50 is connected to the printer 10. In other words, the pushing part 545 is a manually pushed part. The pushing part 545 is pushed in the −K1-axis direction (first direction), so as to move the movable support structure 40 in which the fluid container 50 is set (as shown in FIG. 9) in the −K1-axis direction. The pushing part 545 is placed on the opposite side to the side of the operation member 53 where the fluid supply unit 55 and the substrate unit 58 are placed. As shown in FIGS. 18 and 19, the pushing part 545 is located on the +K1-axis direction side (second side 53*fb*) of the fluid supply unit 55 and the substrate unit 58. The pushing part 545 is provided to be protruded outward (+K1-axis direction) from the operation member 53. This makes the pushing part 545 more easily distinguishable from the other part.

As shown in FIG. 12, the fluid supply unit 55 and the substrate unit 58 are provided on a −Z-axis direction side end portion of the operation member 53. The fluid supply unit 55 and the substrate unit 58 are aligned in the K2-axis direction. The fluid supply unit 55 has a function of supplying the ink contained in the fluid container body 52 to outside (for example, the fluid introducing structure 362 shown in FIG. 7). The substrate unit 58 has a function of electrically connecting with the device-side terminals 381 of the contact mechanism 38. The fluid supply unit 55 and the substrate unit 58 are provided to be protruded outward (−K1-axis direction) from the operation member 53. In this embodiment, the fluid supply unit 55 and the substrate unit 58 are protruded in the same direction. The protruding direction of the substrate unit 58 and the protruding direction of the fluid supply unit 55 may, however, be not necessarily the same but may be different as long as the protruding directions are substantially parallel to each other. The substrate unit 58 and the fluid supply unit 55 are protruded from the operation member 53 toward the same side of the operation member 53 (−K1-axis direction side).

Figure 14:
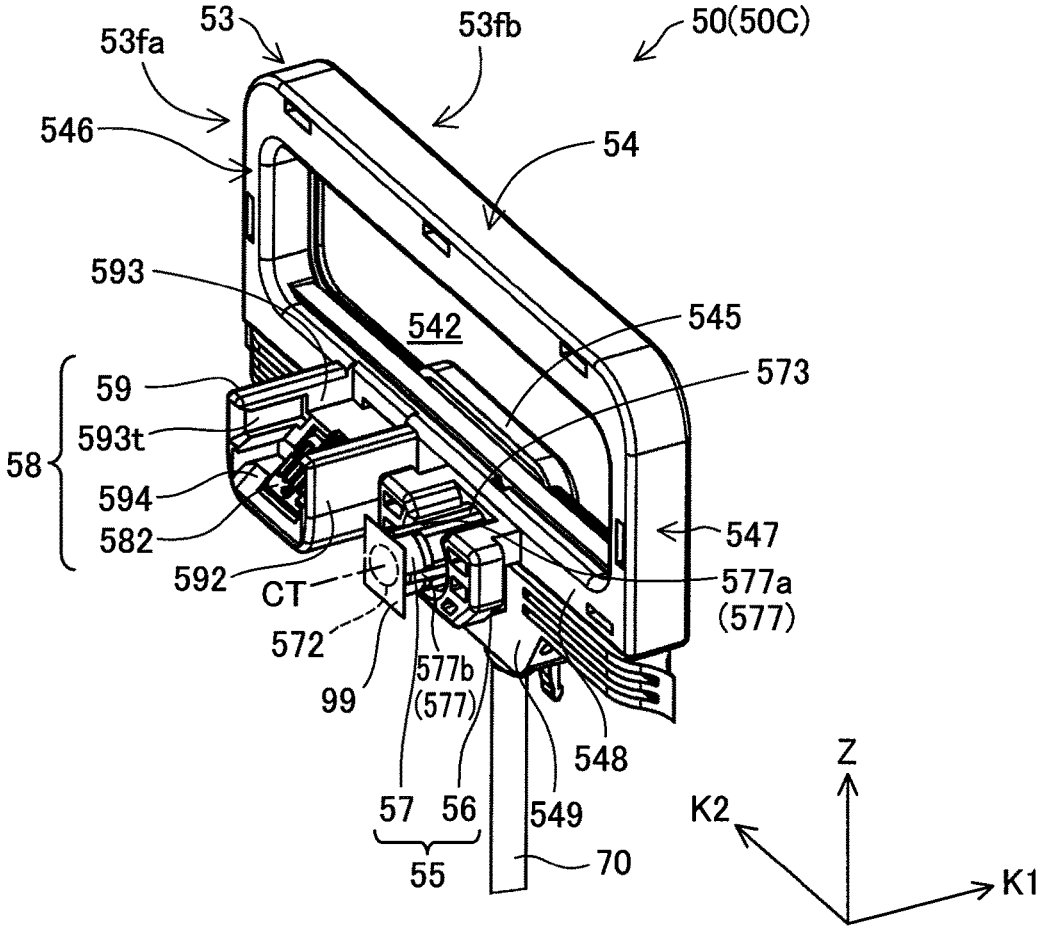
FIG. 14 is a first perspective view illustrating part of the fluid container.
Figure 15:
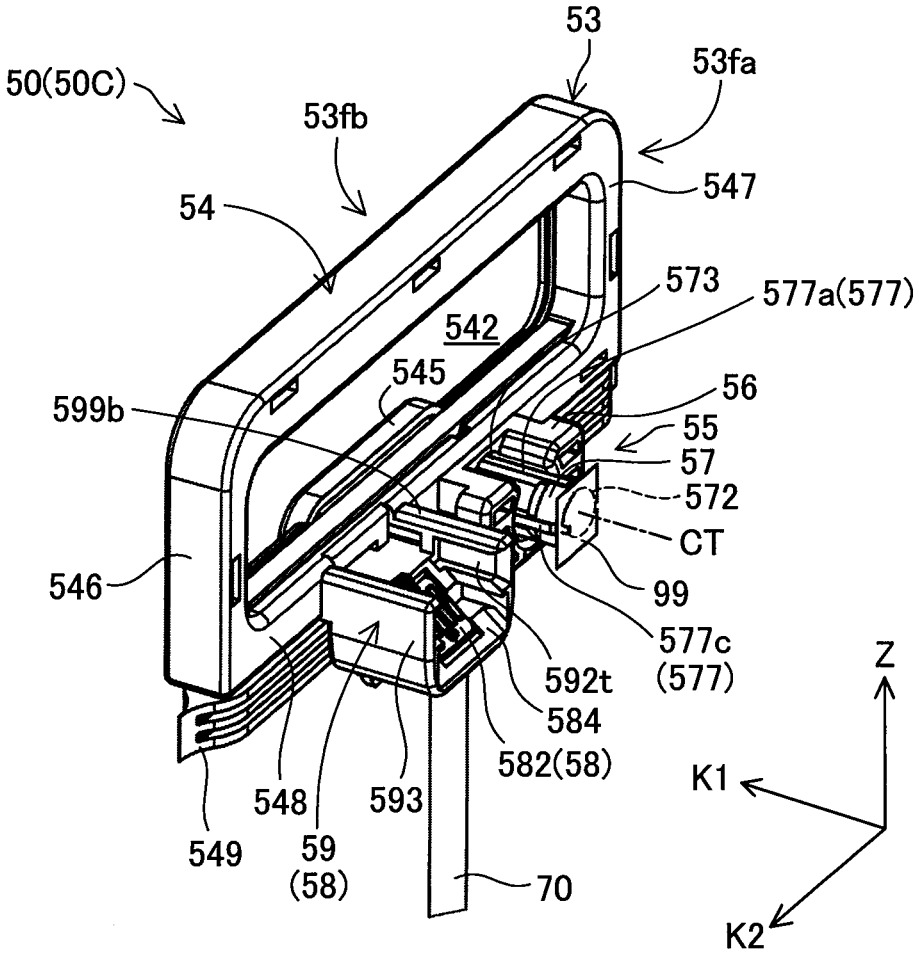
FIG. 15 is a second perspective view illustrating part of the fluid container.
Figure 16:
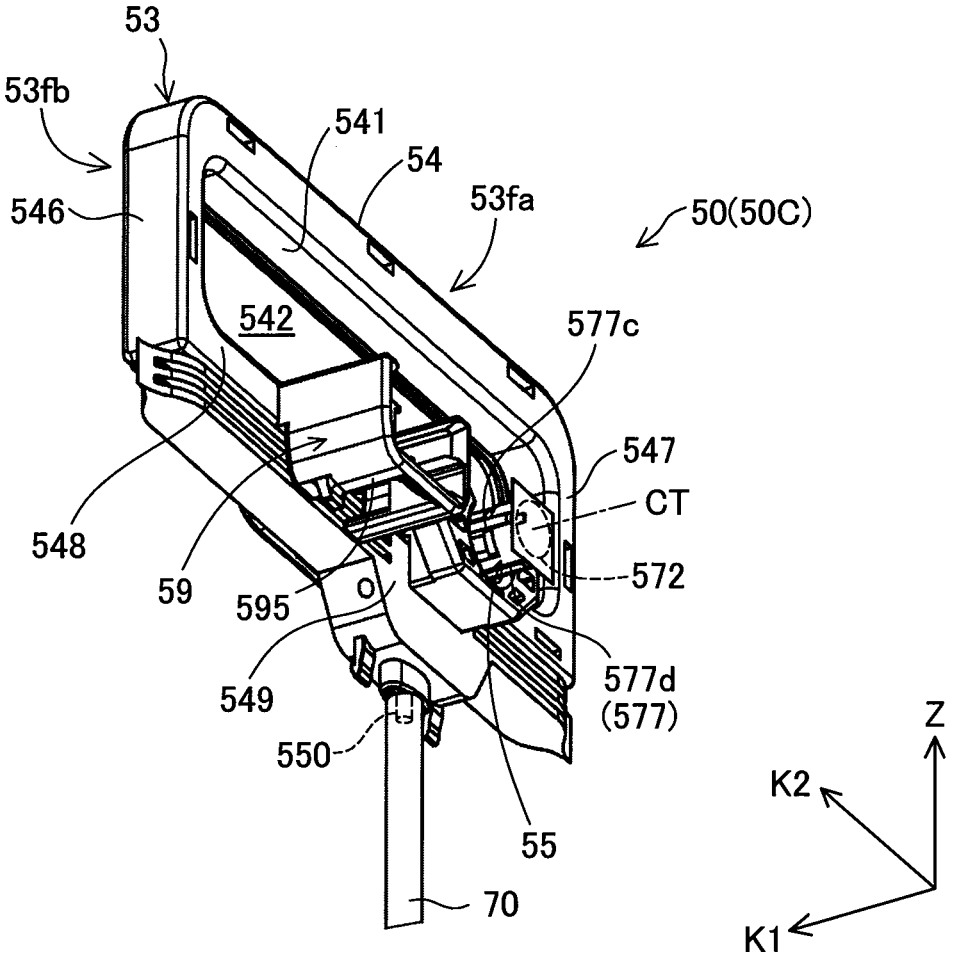
FIG. 16 is a third perspective view illustrating part of the fluid container.
Figure 17:
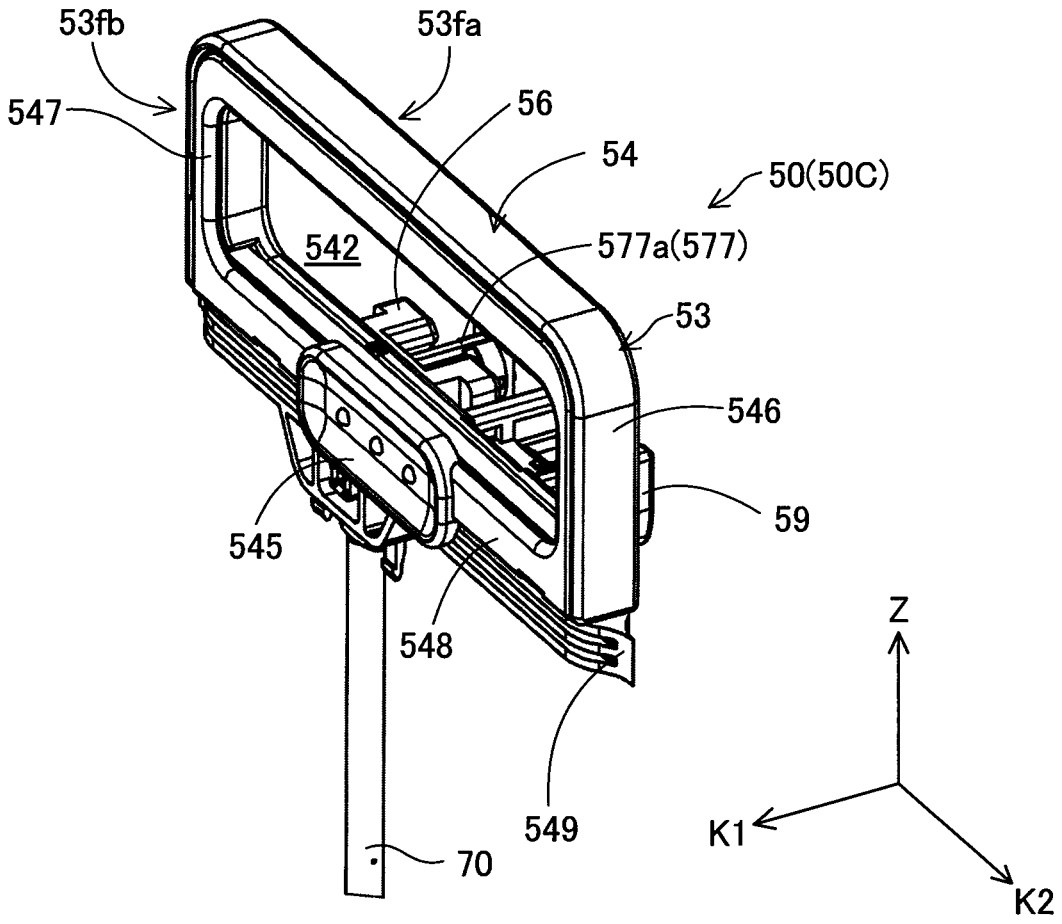
FIG. 17 is a fourth perspective view illustrating part of the fluid container.
Figure 20:
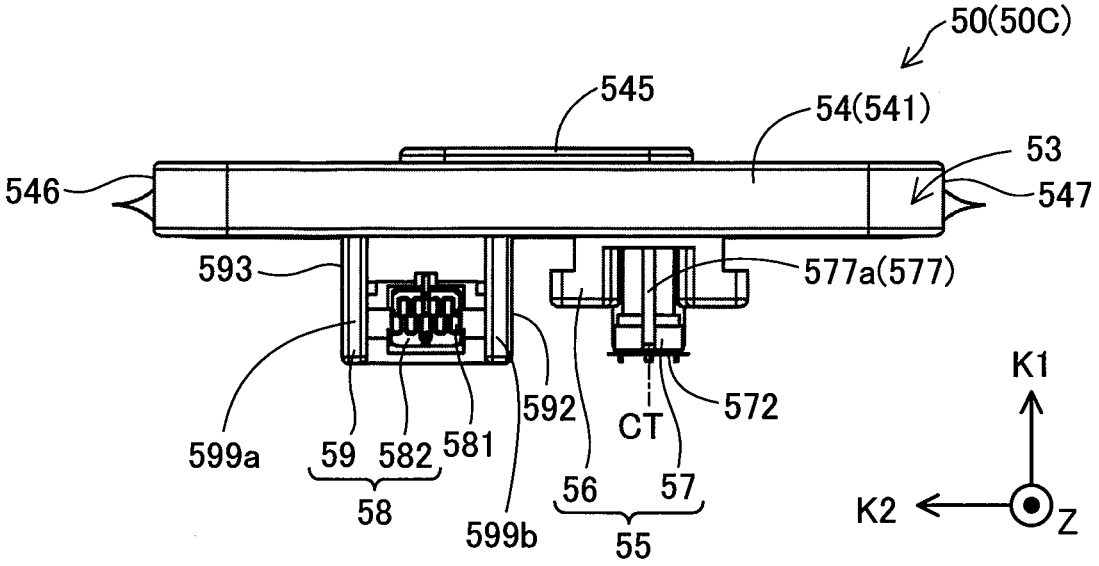
FIG. 20 is a top view illustrating part of the fluid container.
Figure 21:
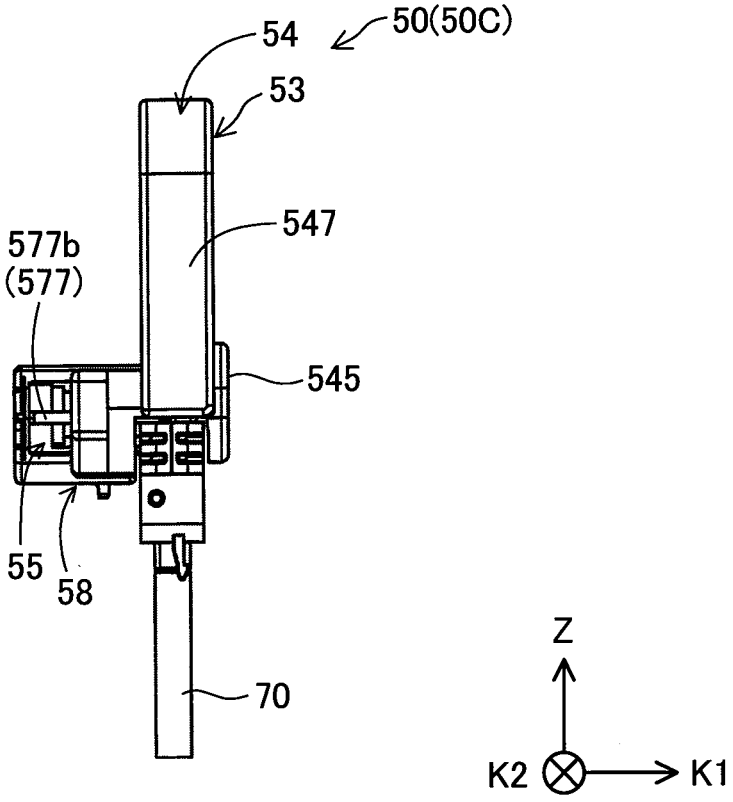
FIG. 21 is a right side view illustrating part of the fluid container.
Figure 22:
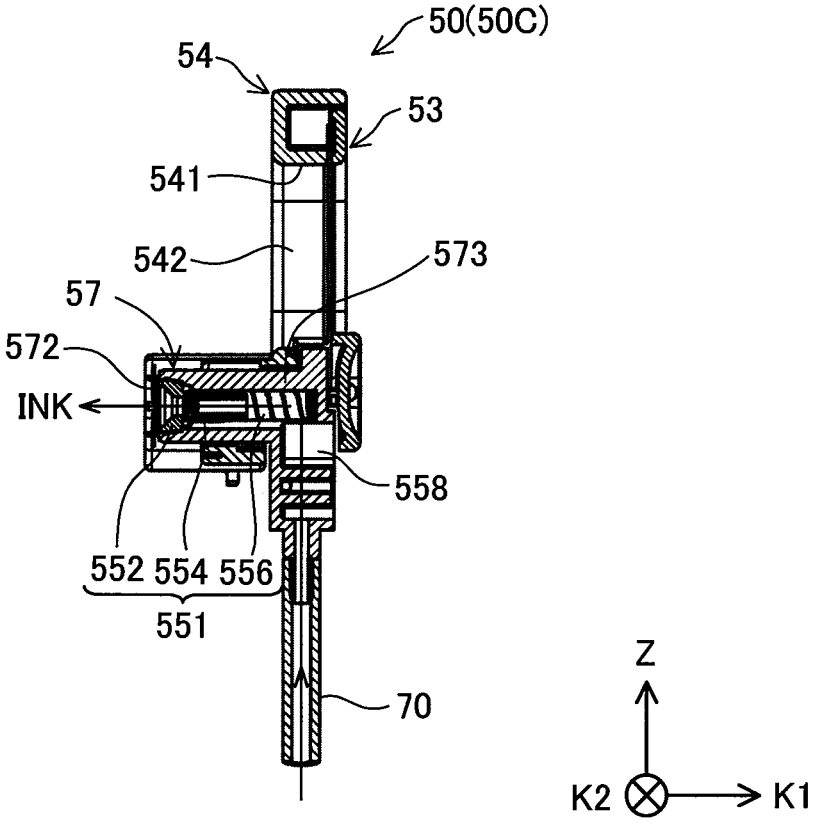
FIG. 22 is an F18-F18 cross sectional view of FIG. 18.
Figure 23:
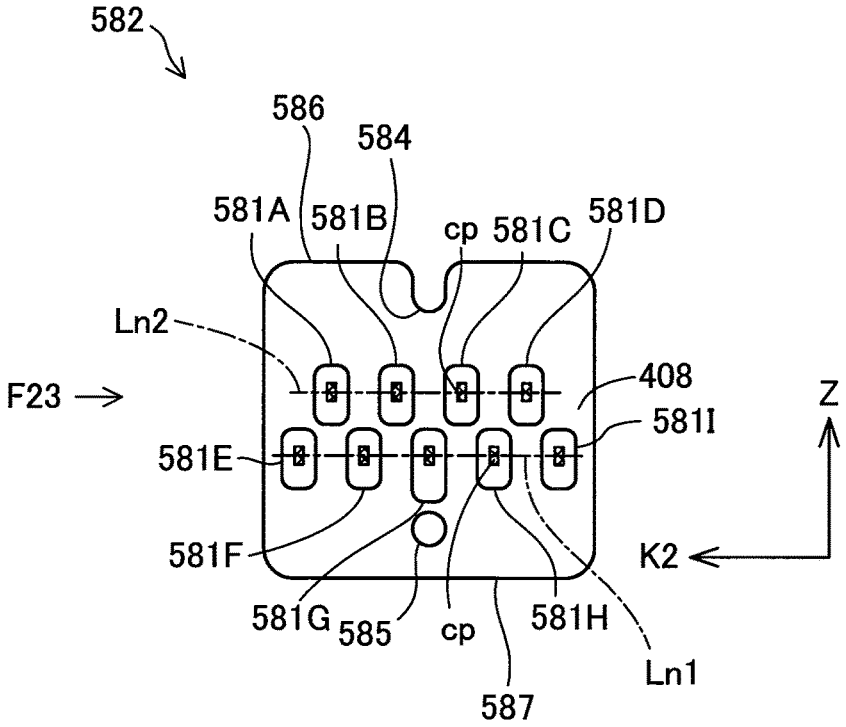
FIG. 23 is a front view illustrating a circuit board.
Figure 24:
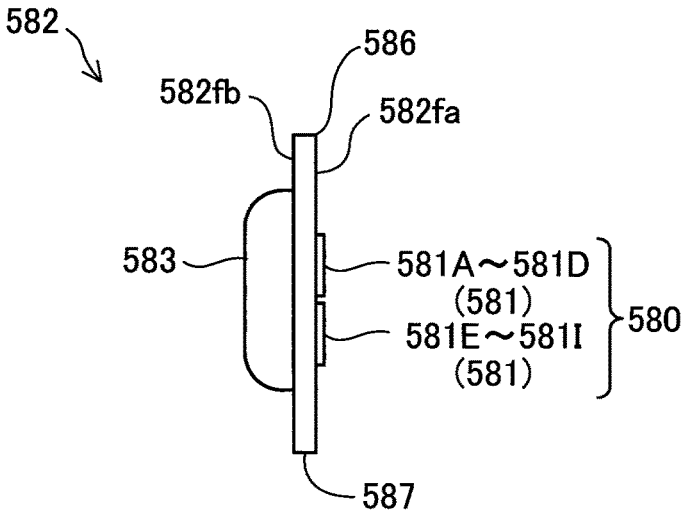
FIG. 24 is a view from an arrow F24 in FIG. 23.
Figure 25:
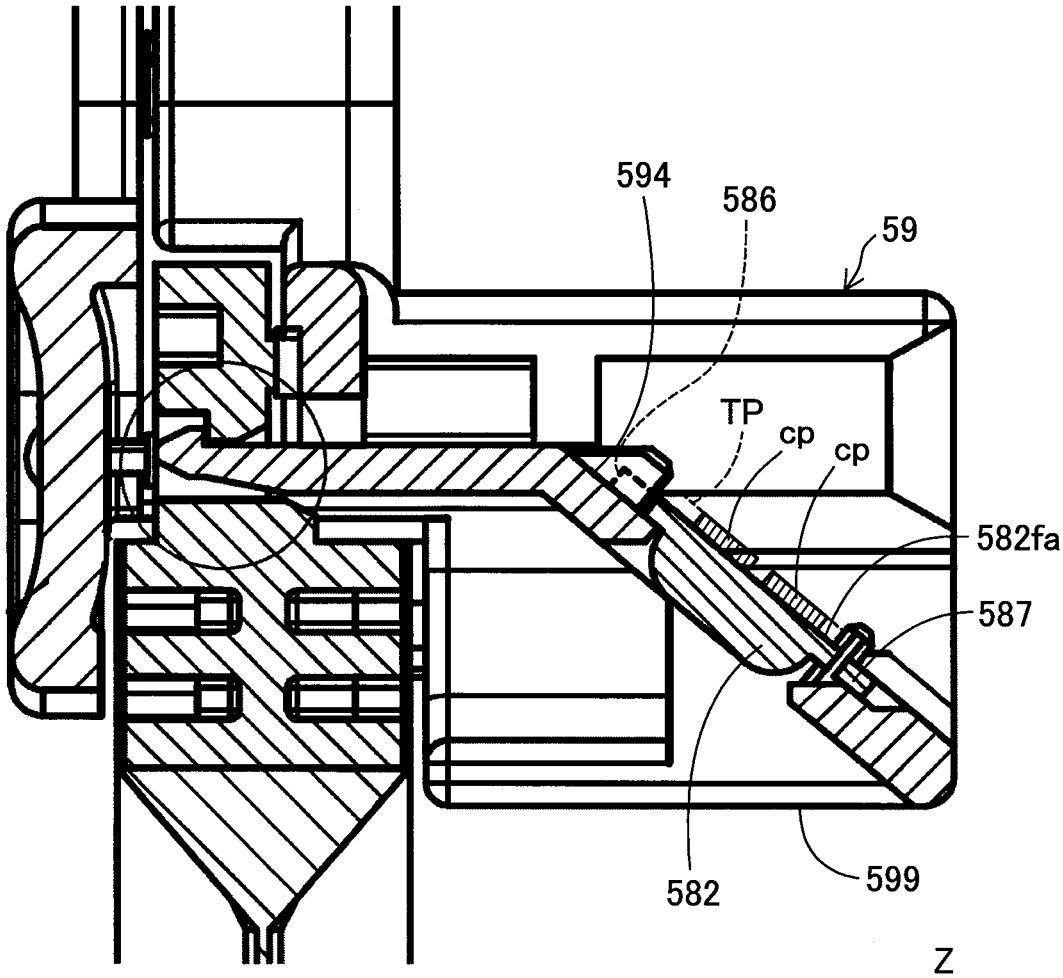
FIG. 25 is an F18*a*-F18*a* partial cross sectional view of FIG. 18.
Figure 25:
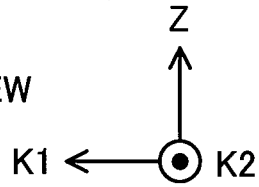

FIG. 14 is a first perspective view illustrating part of the fluid container 50. FIG. 15 is a second perspective view illustrating part of the fluid container 50. FIG. 16 is a third perspective view illustrating part of the fluid container 50. FIG. 17 is a fourth perspective view illustrating part of the fluid container 50. FIG. 18 is a front view illustrating part of the fluid container 50. FIG. 19 is a rear view illustrating part of the fluid container 50. FIG. 20 is a top view illustrating part of the fluid container 50. FIG. 21 is a right side view illustrating part of the fluid container 50. FIG. 22 is an F18-F18 cross sectional view of FIG. 18. FIG. 23 is a front view illustrating the circuit board 582. FIG. 24 is a view from an arrow F24 in FIG. 23. FIG. 25 is an F18*a*-F18*a* partial cross sectional view of FIG. 18. In FIGS. 14 to 22, the fluid container body 52 of the fluid container 50 is omitted from the illustration.

With respect to the operation member 53, the Z-axis direction is also called "height direction", the K1-axis direction is also called "thickness direction", and the K2-axis direction is also called "width direction". According to this embodiment, the "height direction", the "thickness direction" and the "width direction" of the operation member 53 correspond to the "height direction", the "thickness direction" and the "width direction" of the fluid container 50. In this embodiment, the fluid container 50 has the height, the width and the thickness in descending order.

As shown in FIGS. 14 and 15, the operation member 53 has a first connecting part 546, a second connecting part 547, a base part 548 and an attachment part 549, in addition to the grip part 54. The attachment part 549 is a part which the fluid container body 52 is attached to by, for example, welding.

The grip part 54, the first connecting part 546, the second connecting part 547 and the base part 548 are all formed in rod-like shape. The grip part 54, the first connecting part 546, the second connecting part 547 and the base part 548 form a frame-like member. This accordingly forms an approximately rectangular insertion space 542 to accept the user's hand in the operation member 53. As shown in FIG. 16, the grip part 54 has a grip surface (support surface) 541 that is in contact with the insertion space 542. The grip surface 541 is a plane substantially perpendicular to the Z-axis direction in the mounting state.

As shown in FIG. 14, the base part 548 is extended along the K2-axis direction. The fluid supply unit 55 and the substrate unit 58 are attached to the base part 548. More specifically, the fluid supply unit 55 and the substrate unit 58 are interconnected via the base part 548 of the handle member 53. The fluid supply unit 55 and the substrate unit 58 accordingly move in conjunction with the motion of the base part 548. This configuration enables the user to operate the motions of the fluid supply unit 55 and a circuit board holding member 59 for connecting the fluid container 50 to the printer 10 by simply operating the motion of only one member (base part 548 in this embodiment). The term "interconnecting" herein means that members are connected and linked with each other to move in conjunction with each other.

The attachment part 549 is located across the base part 548 on the opposite side to the side where the grip part 54 is located. The attachment part 549 is located adjacent to the base part 548. The attachment part 549 is extended along the K2-axis direction. The attachment part 549 is a part which the one end portion 501 of the fluid container body 52 (shown in FIG. 12) is attached to (joined with) by, for example, welding. As shown in FIGS. 18 and 19, the attachment part 549 includes an outlet element 550 configured to flow the ink contained in the fluid container body 52 to the fluid supply assembly 57. A flow path member 70 is connected with the outlet element 550, so that the ink flowing in the flow path member 70 flows through the outlet element 550 to the fluid supply assembly 57. In order to facilitate understanding, the part of the attachment part 549 which the fluid container body 52 is attached to is shown by single-hatching in FIGS. 18 and 19.

As shown in FIGS. 14 and 15, the fluid supply unit 55 includes the fluid supply assembly (fluid outlet assembly) 57 and a container-side support structure 56. The container-side support structure 56 and the fluid supply assembly 57 are formed as separate components, and there is a slight gap between the container-side support structure 56 and the fluid supply assembly 57.

The fluid supply assembly 57 makes a flow of the ink contained in the fluid container body 52 to the printer 10. The fluid supply assembly 57 has a fluid supply port 572 on one end portion and a supply connection part 573 on the other hand. The fluid supply port 572 communicates with inside of the fluid container body 52 and flows out the ink contained in the fluid container body 52 to outside (printer 10). The fluid supply assembly 57 is extended to face in the first direction (−K1-axis direction), which is the direction intersecting with the direction of gravity (Z-axis direction), from the operation member 53 during supply of ink to the printer 10. The fluid introducing structure 362 (shown in FIG. 7) is inserted into the fluid supply port 572 in the mounting state of the fluid container 50. The fluid supply port 572 forms a plane (plane defined by the Z-axis direction and the K2-axis direction). The fluid supply port 572 is open toward the first direction (−K1-axis direction, connecting direction). The opening direction is a direction perpendicular to the plane formed by the fluid supply port 572 and is a direction toward the outside. The fluid supply port 572 is, however, not necessarily open toward the first direction but may be open in any direction including a first direction component.

The supply connection part 573 is connected with the operation member 53. The fluid supply assembly 57 has a center axis CT, which is parallel to the K1-axis direction. The fluid supply assembly 57 is a tubular member (ring-shaped member) extended along the K1-axis direction (direction of the center axis CT). With respect to the K1-axis direction, a direction from the fluid supply port 572 toward the supply connection part 573 is the +K1-axis direction, and a direction from the supply connection part 573 toward the fluid supply port 572 is the −K1-axis direction.

As shown in FIG. 20, when the fluid container 50 is viewed from the +Z-axis direction side (i.e., the side where the grip part 54 is located), the fluid supply port 572 is located at a position that does not overlap with the operation member 53.

As shown in FIG. 14, in the unused state of the fluid container 50, the fluid supply port 572 is closed by a film 99. This suppresses leakage of ink through the fluid supply port 572 to outside before the fluid container 50 is mounted to the mounting assembly unit 30 (shown in FIG. 5). The film 99 is broken by the fluid introducing structure 362 (shown in FIG. 5) when the fluid container 50 is mounted to the mounting assembly unit 30.

As shown in FIGS. 14 to 16, a positioning structure 577 is provided on the outer periphery about the center axis CT of the fluid supply assembly 57. The positioning structure 577 comes into contact with a supply assembly positioning structure of the fluid introducing structure 362 described later, so as to position the fluid supply assembly 57 relative to the fluid introducing structure 362, when the fluid container 50 is connected to the printer 10. The positioning structure 577 may be regarded as part of the fluid supply assembly 57.

The positioning structure 577 includes a first container-side positioning member 577*a*, a second container-side positioning member 577*b*, a third container-side positioning member 577*c* and a fourth container-side positioning member 577*d*. The first to the fourth container-side positioning members 577*a* to 577*d* are respectively members protruded from the fluid supply assembly 57 (projection members). The first to the fourth container-side positioning members 577*a* to 577*d* are members extended along the K1-axis direction. Respective −K1-axis direction side end portions of the first to the fourth container-side positioning members 577*a* to 577*d* are placed near to the fluid supply port 572.

The first container-side positioning member 577*a* is placed on an upper side part in the direction of gravity (+Z-axis direction side part) of the fluid supply assembly 57. The second container-side positioning member 577*b* is placed on a −K2-axis direction side part of the fluid supply assembly 57. The third container-side positioning member 577*c* is placed on a +K2-axis direction side part of the fluid supply assembly 57. The fourth container-side positioning member 577*d* is placed on a lower side part in the direction of gravity (−Z-axis direction side part) of the fluid supply assembly 57. The first and the fourth container-side positioning members 577*a* and 577*d* are opposed to each other in the Z-axis direction. The second and the third container-side positioning members 577*b* and 577*c* are opposed to each other in the K2-axis direction.

As shown in FIG. 22, a valve mechanism 551 is placed inside of the fluid supply assembly 57 to pen and close a fluid flow path formed by the fluid supply assembly 57. The valve mechanism 551 includes a valve seat (sealing element) 552, a valve element 554 and a spring 556. The valve seat 552, the valve element 554 and the spring 556 are placed in the fluid supply assembly 57 in this sequence from the fluid supply port 572 toward the supply connection part 573 of the fluid supply assembly 57.

The valve seat 552 is an approximately circular member. The valve seat 552 is made of an elastic material such as rubber or elastomer. The valve seat 552 is pushed in the fluid supply assembly 57. The valve element 554 is an approximately cylindrical member. The valve element 554 is placed to close a hole (valve hole) formed in the valve seat 552 in the state before the fluid container 50 is mounted to the mounting assembly unit 30. The spring 556 is a compression coil spring. The spring 556 is arranged to bias the valve element 554 in a direction toward the valve seat 552. In the mounting state of the fluid container 50, the fluid introducing structure 362 (shown in FIG. 7) presses the valve element 554 toward the supply connection part 573, so as to move the valve element 554 toward the supply connection part 573. This motion separates the valve element 554 from the valve seat 552 to set the valve mechanism 551 in the open position. In the open position of the valve mechanism 551, the ink contained in the fluid container body 52 (shown in FIG. 12) may flow out through the flow path member 70, an inner flow path 558 of the operation member 53 and the fluid supply assembly 57 to outside.

As shown in FIG. 14, the container-side support structure 56 positions the fluid container body 52 including the fluid supply port 572 relative to the printer 10 to some extent when the fluid container 50 is connected to the printer 10. The container-side support structure 56 is formed in a concave shape that is open on its +Z-axis direction side. The container-side support structure 56 is arranged to surround the periphery of the fluid supply assembly 57 about the center axis except the Z-axis direction part (upper part in the direction of gravity). The container-side support structure 56 is located at a position adjacent to the fluid supply port 572 of the fluid supply assembly 57. In the case that the operation member 53 is made of a material unlikely to be deformed, the container-side support structure 56 may be provided at a position of the operation member 53 slightly away from the fluid supply port 572. The container-side support structure 56 is protruded from the operation member 53 in the −K1-axis direction.

The container-side support structure 56 is located at a predetermined position (more specifically, inside of a supply assembly support structure described later) in the movable support structure 40 when the fluid container 50 is connected to the printer 10. The container-side support structure 56 accordingly comes into contact with the movable support structure 40, so as to restrict the motion of the fluid supply assembly 57 and position the fluid container 50 to some extent. The container-side support structure 56 is also supported by the movable support structure 40, such that the fluid container body 52 hangs down by its own weight below the grip part 54 in the direction of gravity when the fluid container 50 is set in the movable support structure 40 of the mounting assembly unit 30.

The fluid supply unit 55 has a function of supplying the ink contained in the fluid container body 52 (shown in FIG. 12) to the printer 10. The fluid supply unit 55 may thus be regarded as "fluid supply structure". In this sense, the fluid supply unit 55 as the fluid supply structure includes the fluid supply assembly (fluid flow assembly) 57 having the fluid supply port 572 on one end portion thereof, and the container-side support structure 56. The fluid supply unit 55 as the fluid supply structure is attached to the one end portion part 501 of the fluid container body 52. In other words, the fluid supply unit 55 as the fluid supply structure is located at the one end portion 501 of the fluid container body 52.

As shown in FIGS. 14 and 15, the substrate unit 58 includes the circuit board 582 as the container-side electrical connection structure and the circuit board holding member 59 serving as a holding member. As shown in FIG. 14, when the fluid container 50 is connected to the printer 10, the circuit board holding member 59 positions the circuit board 582 relative to the printer 10. The circuit board holding member 59 is integrated with the operation member 53. According to this embodiment, the circuit board holding member 59 is formed by integral molding with the operation member 53 to be integrated with the operation member 53. The term "integrated with" herein means that the circuit board holding member 59 is provided on the operation member 53 to be moved in conjunction with the motion of the operation member 53. According to another embodiment, the circuit board holding member 59 may be mounted to the operation member 53 by, for example, welding, so as to be integrated with the operation member 53.

The circuit board holding member 59 is aligned with the fluid supply assembly 57 in the direction (K2-axis direction) intersecting with the first direction (−K1-axis direction). The circuit board holding member 59 is placed to hold (support) the circuit board 582. More specifically, the circuit board holding member 59 holds the circuit board 582 above the fluid container body 52 when the fluid container 50 is connected to the printer 10. The circuit board holding member 59 is a member having rigidity. More specifically, the circuit board holding member 59 has such rigidity as not to displace the circuit board 582 when the fluid container 50 is set in the movable support structure 40 of the mounting assembly unit 30. The circuit board holding member 59 may be made of a material such as ABS resin or polystyrene (PS). The circuit board holding member 59 is supported by the movable support structure 40 when being set in the movable support structure 40.

As shown in FIG. 14, the circuit board holding member 59 is formed in a concave shape that is open on the +Z-axis direction side (i.e., the side where the grip part 54 is located). The −K1-axis direction side of the circuit board holding member 59 is also open to receive the contact mechanism 38 therein. The circuit board holding member 59 has a bottom part (bottom surface) 595 (shown in FIG. 16), a first side wall part 592 and a second side wall part 593. The bottom part 595, the first side wall part 592 and the second side wall part 593 define the concave shape of the circuit board holding member 59. The first side wall part 592 is a wall part extended upward in the direction of gravity from a −K2-axis direction side part of the bottom part 595. The second side wall part 593 is a wall part extended upward in the direction of gravity from a +K2-axis direction side part of the bottom part 595. The first and the second side wall parts 592 and 593 are opposed to each other.

As shown in FIG. 14, the circuit board holding member 59 also has a placement element (placement surface) 594. The circuit board 582 is mounted on the placement element 594. The placement element 594 is located between the first side wall part 592 and the second side wall part 593. The placement element 594 is inclined such that its lower end portion is located on the −K-axis direction side of its upper end portion. The placement element 594 is inclined in a direction including a +Z-axis direction component and a −K1-axis direction component. The placement element 594 is located on the +Z-axis direction side of the bottom part 595.

As shown in FIGS. 15 and 20, the first side wall part 592 has a groove 592*t* serving as a holding member-side positioning structure. As shown in FIGS. 14 and 20, the second side wall part 593 has a groove 593*t* serving as a holding member-side positioning structure.

As shown in FIG. 18, the two grooves 592*t* and 593*t* are provided on the respective sides of the circuit board 582 in the K2-axis direction across the circuit board 582. The two grooves 592*t* and 593*t* are in approximately rectangular parallelepiped shape. Part of the electrical connection unit 38 (more specifically, a device-side circuit board positioning structure) enters the two grooves 592*t* and 593*t*, so that the circuit board holding member 59 and the circuit board 582 are finally positioned relative to the device-side terminals 381.

When the circuit board 582 comes into contact with and is thereby electrically connected with the device-side terminals 381 (shown in FIG. 7), the circuit board 582 is positioned relative to the device-side terminals 381 in the first direction (−K1-axis direction) and in the directions intersecting with the first direction (Z-axis direction and K2-axis direction).

As shown in FIG. 23, a boss groove 584 is formed on an upper end portion 586 of the +Z-axis direction side of the circuit board 582, and a boss hole 585 is formed in a lower end portion 587 on the −Z-axis direction side of the circuit board 582. The circuit board 582 is fixed to the placement element 594 by means of the boss groove 584 and the boss hole 585.

As shown in FIGS. 23 and 24, the circuit board 582 includes a fluid container-side terminal group 580 provided on a surface 582*fa* and a storage unit 583 provided on a rear face 582*fb*. The surface 582*fa* and the rear face 582*fb* are planes.

The fluid container-side terminal group 580 includes nine terminals 581A to 581I. The storage unit 420 stores information regarding the fluid container 50 (for example, the remaining amount of ink and the color of ink).

As shown in FIG. 23, the nine fluid container-side terminals 581A to 581I are respectively formed in approximately rectangular shape. The nine fluid container-side terminals 581A to 581I are arranged to form two lines Ln1 and Ln2 at different positions in the Z-axis direction that is the direction intersecting with the connecting direction (−K1-axis direction). The lines Ln1 and Ln2 are parallel to the K2-axis direction.

Each of the fluid container-side terminals 581A to 581I has a contact cp on its center to come into contact with the corresponding device-side terminal 381. The above lines Ln1 and Ln2 may be regarded as lines formed by a plurality of contacts cp. When there is no necessity to distinguish the nine fluid container-side terminals 581A to 581I from one another, the fluid container-side terminals are expressed by a symbol "581".

As shown in FIG. 25, in the mounting state of the fluid container 50, the surface 582*fa* which the plurality of contacts cp are placed on is inclined, such that its upper end portion 587 is located on the first direction side (i.e., −K1-axis direction side, connecting direction side) of its upper end portion 586. A virtual plane (contact plane) TP defined by the surface of the plurality of contacts cp is inclined in the connecting direction (i.e., in the −K1-axis direction). More specifically, the virtual plane TP is inclined, such that its lower side is located on the first direction side of its upper side. The surface 582*fa* and the virtual plane TP are inclined to face in a direction including a +Z-axis direction (upward in the direction of gravity) component and a −K1-axis direction (first direction) component. The virtual plane (contact plane) TP is a plane which the plurality of contacts cp go through.

A-4. Structure of Mounting Assembly Unit 30

A-4-1. General Structure of Mounting Assembly Unit 30

Figure 26:
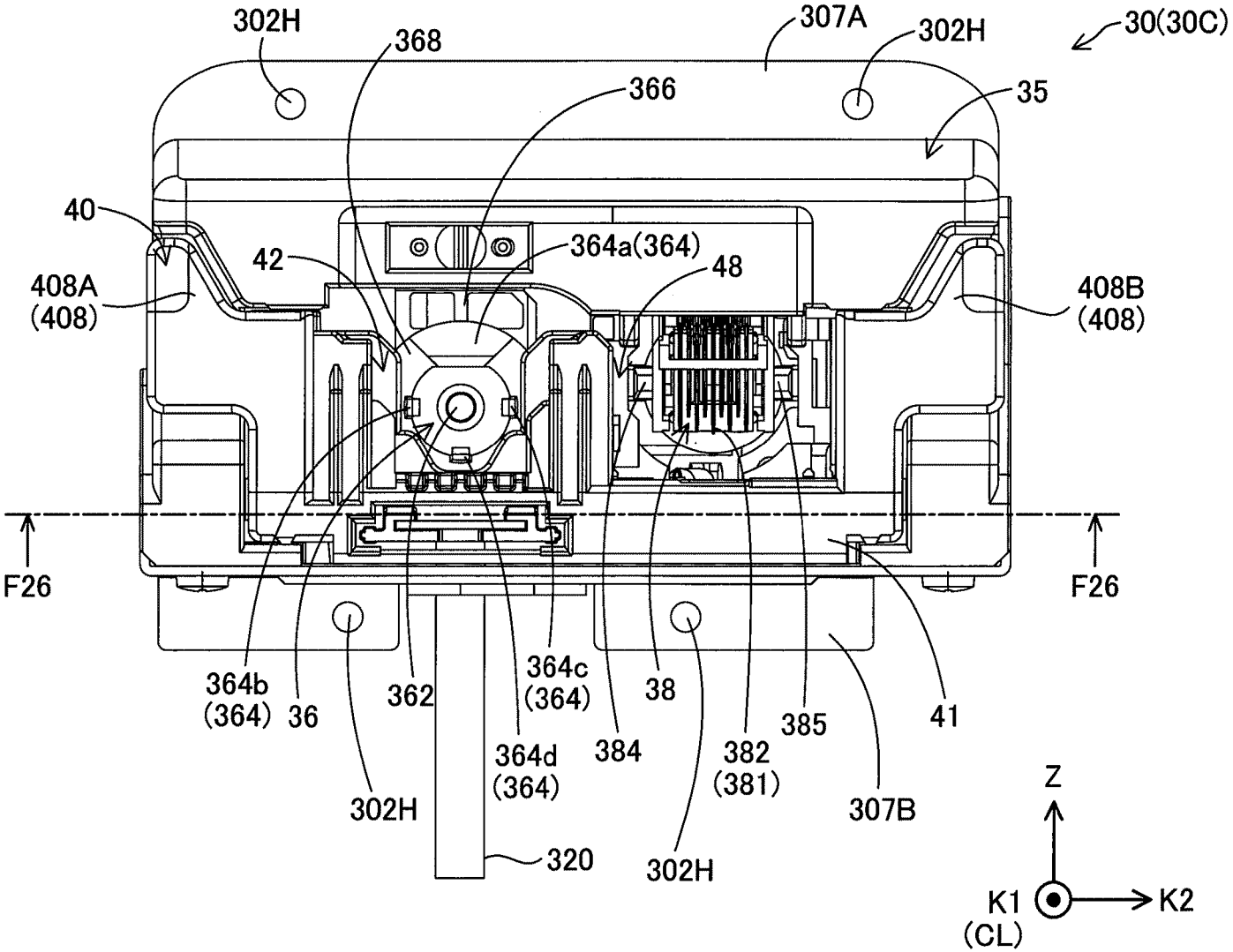
FIG. 26 is a front view illustrating the mounting assembly unit.
Figure 27:
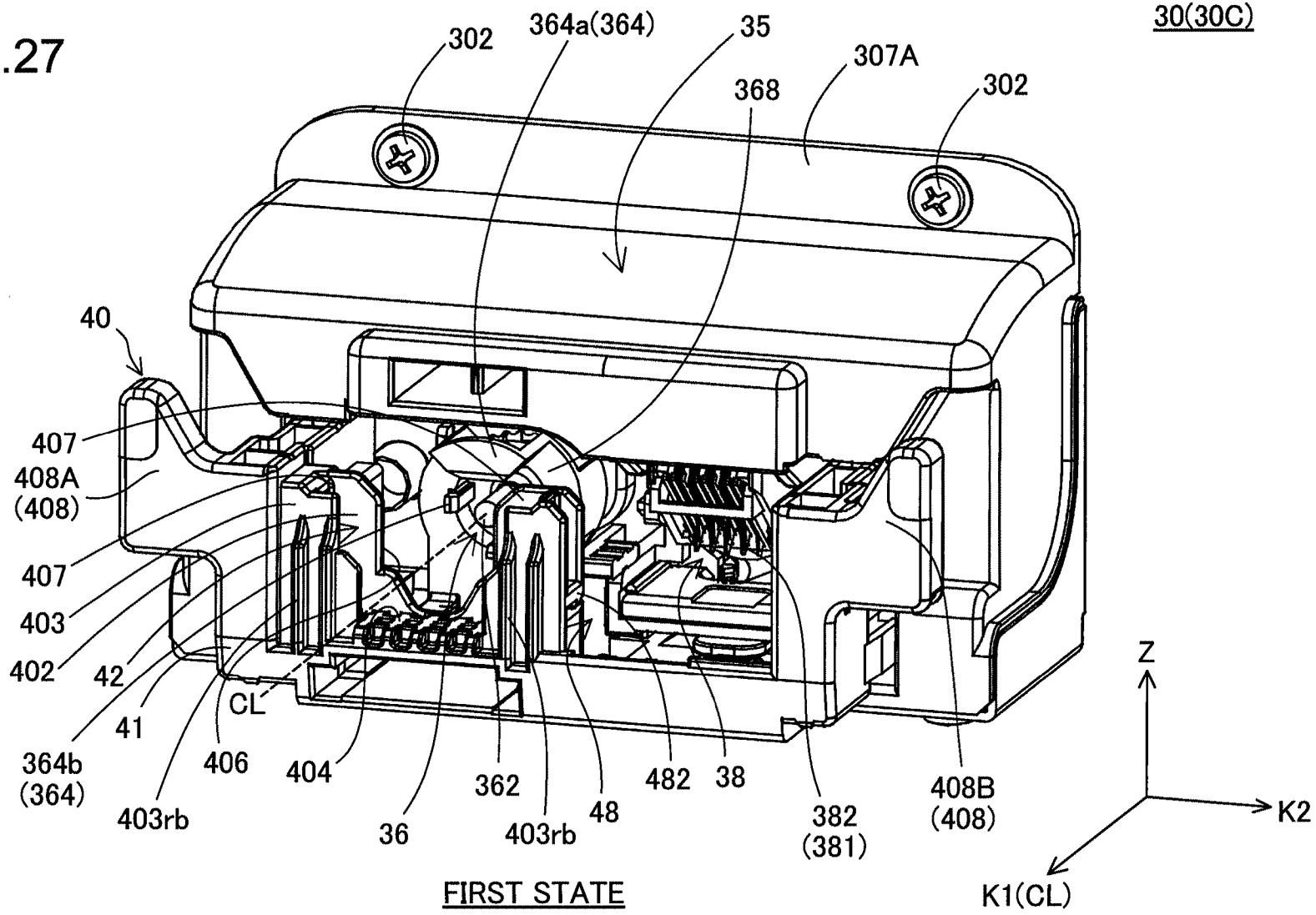
FIG. 27 is a first perspective view illustrating the mounting assembly unit.
Figure 28:
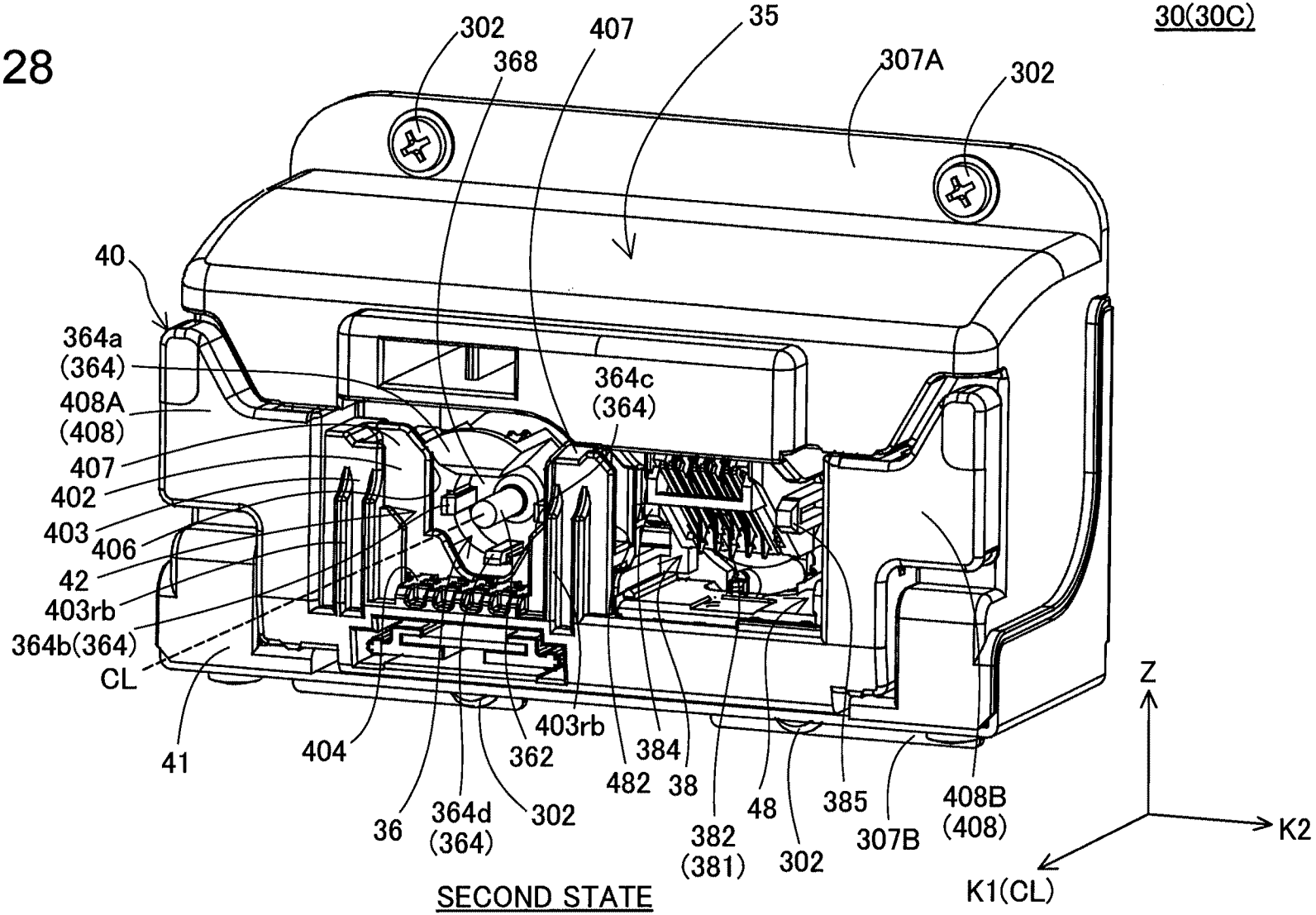
FIG. 28 is a second perspective view illustrating the mounting assembly unit.
Figure 29:
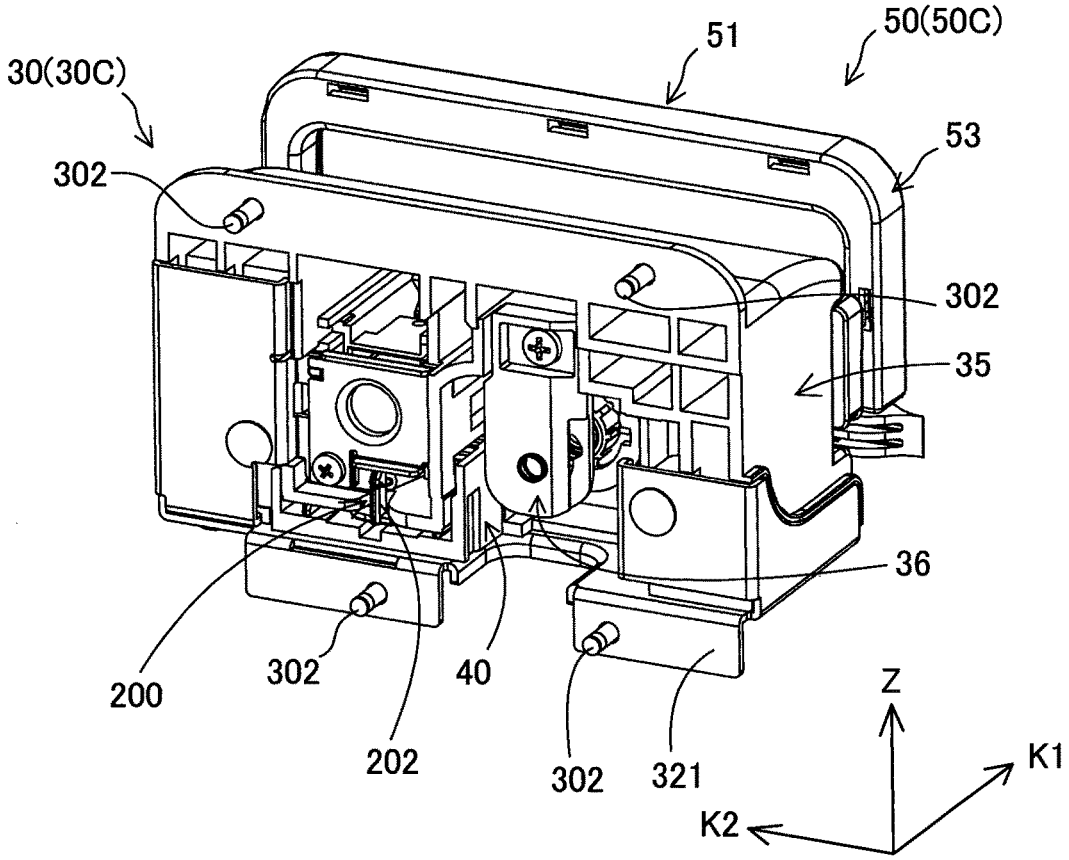
FIG. 29 is a perspective view illustrating the mounting assembly unit.
Figure 30:
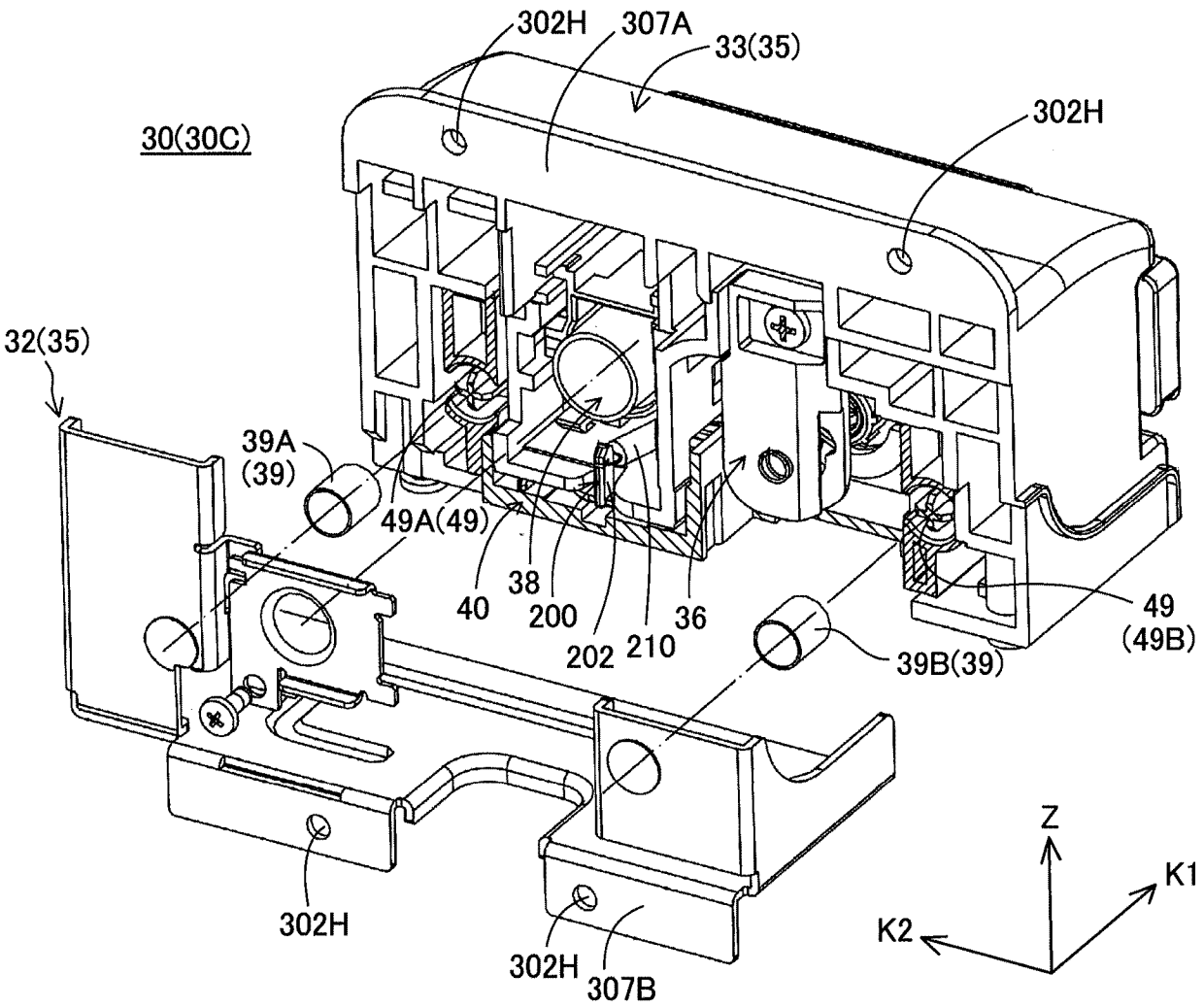
FIG. 30 is an exploded perspective view illustrating the mounting assembly unit.

FIG. 26 is a front view illustrating the mounting assembly unit 30. FIG. 27 is a first perspective view illustrating the mounting assembly unit 30. FIG. 28 is a second perspective view illustrating the mounting assembly unit 30. FIG. 27 illustrates the first state (setting state) in which the movable support structure 40 is protruded outward relative to the stationary member 35. FIG. 28 illustrates the second state (mounting state) in which the movable support structure 40 is placed in the stationary member 35. FIG. 29 is a perspective view illustrating the mounting assembly unit 30. FIG. 30 is an exploded perspective view illustrating the mounting assembly unit 30. The following describes the structure of the mounting assembly unit 30C as an example with reference to FIGS. 26 to 30. The other mounting assembly units 30K, 30M and 30Y have the same structures as that of the mounting assembly unit 30C. In order to facilitate understanding, the movable support structure 40 is shown by single-hatching in FIG. 30.

As shown in FIG. 26, the stationary member 35 has a first mounting wall 307A protruded upward in the direction of gravity and a second mounting wall 307B protruded downward in the direction of gravity. The first mounting wall 307A has two through holes 302H, and the second mounting wall 307B has two through holes 302H. Screws 302 (shown in FIG. 27) as fixation elements are inserted into the respective through holes 302H. The mounting assembly unit 30 (more specifically the stationary member 35) is fixed to the surfaces 104 and 106 of the printer 10 (shown in FIGS. 3 and 4) by means of the four screws 302. More specifically, the mounting assembly unit 30K (shown in FIG. 3) is fixed to the device second surface 104 by means of a plurality of the screws 302. The mounting assembly units 30C, 30M and 30Y (shown in FIG. 4) are fixed to the device third surface 106 by means of a plurality of the screws 302.

As shown in FIG. 26, the stationary member 35 includes the fluid introducing mechanism 36 and the contact mechanism 38. The fluid introducing mechanism 36 and the contact mechanism 38 are respectively fixed to the stationary member 35 to be supported on the outer wall (for example, device third surface 106) of the printer 10 via the stationary member 35.

The fluid introducing mechanism 36 and the contact mechanism 38 are aligned in the K2-axis direction. The fluid introducing structure (fluid supply connection structure) 362 of the fluid introducing mechanism 36 and an electrical connection structure (device-side electrical connection structure, main body-side electrical connection structure) 382 of the contact mechanism 38 are arranged adjacent to each other in the K2-axis direction in such a manner that the fluid introducing structure 362 and the electrical connection structure 382 are visible simultaneously. With respect to the K2-axis direction, the direction from the fluid introducing mechanism 36 toward the contact mechanism 38 is the +K2-axis direction, and the direction from the contact mechanism 38 toward the fluid introducing mechanism 36 is the −K2-axis direction. With respect to the mounting assembly unit 30, the Z-axis direction is also called "height direction", the K1-axis direction is also called "width direction", and the K2-axis direction is also called "depth direction".

The fluid introducing mechanism 36 includes a fluid introducing main body 368, the fluid introducing structure 362 and a supply assembly positioning structure 364. The fluid supply assembly 57 of the fluid container 50 (shown in FIG. 14) is connected with the fluid introducing structure 362, so as to make a flow of the ink contained in the fluid container 50. More specifically, the fluid supply assembly (fluid outlet assembly) 57 of the fluid container 50 (shown in FIG. 9) is moved in the −K1-axis direction (first direction) accompanied with the motion of the movable support structure 40, so that the fluid introducing structure 362 is connected with the fluid supply assembly 57. The fluid introducing structure 362 communicates with the record head of the printer 10 through a fluid flow tube 320. The fluid flow tube 320 is a flexible hose.

As shown in FIG. 27, with respect to the K1-axis direction, the outward direction of the printer 10 is the +K1-axis direction, and the inward direction of the printer 10 is the −K1-axis direction. The fluid introducing structure 362 and the supply assembly positioning structure 364 are provided on the fluid introducing main body 368 to be protruded in the +K1-axis direction from the fluid introducing main body 368.

As shown in FIG. 26, the supply assembly positioning structure 364 is arranged around the fluid introducing structure 362 about the center axis CL. The supply assembly positioning structure 364 positions the fluid supply assembly 57 in the direction intersecting with the K1-axis direction (according to this embodiment, the direction along the plane parallel to the Z-axis direction and the K2-axis direction) when the fluid supply assembly (fluid outlet assembly) 57 is connected with the fluid introducing structure 362.

The supply assembly positioning structure 364 includes a first supply assembly positioning member 364*a*, a second supply assembly positioning member 364*b*, a third supply assembly positioning member 364*c* and a fourth supply assembly positioning member 364*d*. The first to the fourth supply assembly positioning members 364*a* to 364*d* are members protruded from the fluid introducing main body 368. The first supply assembly positioning member 364*a* is more protruded to the +K1-axis direction side than the other supply assembly positioning members 364*b* to 364*d*. The first supply assembly positioning member 364*a* is located immediately above the fluid introducing structure 362 and is protruded to the +K1-axis direction side of the fluid introducing structure 362. In other words, the first supply assembly positioning member 364*a* is arranged to cover the upper side of the fluid introducing structure 362.

The first supply assembly positioning member 364*a* is located above the fluid introducing structure 362 in the direction of gravity (on the +Z-axis direction side of the fluid introducing structure 362). The second supply assembly positioning member 364*b* is located on the −K2-axis direction side of the fluid introducing structure 362. The third supply assembly positioning member 364*c* is located on the +K2-axis direction side of the fluid introducing structure 362. The fourth supply assembly positioning member 364*d* is located below the fluid introducing structure 362 in the direction of gravity (on the −Z-axis direction side of the fluid introducing structure 362). The first and the fourth supply assembly positioning members 364*a* and 364*d* are opposed to each other across the fluid introducing structure 362 in the direction of gravity. The second and the third supply assembly positioning members 364*b* and 364*c* are opposed to each other across the fluid introducing structure 362 in the K2-axis direction.

The first to the fourth supply assembly positioning members 364*a* to 364*d* respectively have planes facing the fluid introducing structure 362. The first to the fourth container-side positioning members 577*a* to 577*d* (shown in FIGS. 14 to 16) of the fluid supply assembly 57 come into contact with the corresponding planes. This positions the fluid supply assembly 57 relative to the fluid introducing structure 362 in the planar direction perpendicular to the K1-axis direction. More specifically, the first to the fourth container-side positioning members 577*a* to 577*d* (shown in FIGS. 14 to 16) are located inside of the first to the fourth supply assembly positioning members 364*a* to 364*d*, so that the fluid supply assembly 57 is positioned relative to the fluid introducing structure 362 in the planar direction perpendicular to the K1-axis direction.

As shown in FIGS. 26 to 28, the contact mechanism 38 includes the electrical connection structure (device-side electrical connection structure) 382 with a plurality of (nine in this embodiment) device-side terminals 381 and a plurality of (two in this embodiment) device-side substrate positioning structures 384 and 385. In the mounting state of the fluid container 50, the device-side terminals 381 of the electrical connection structure 382 come into contact with the contacts cp of the circuit board 582 (shown in FIG. 23) to be electrically connected with the circuit board 582. This allows for communication of various information (for example, the color of ink contained in the fluid container 50 and the date of manufacture of the fluid container 50) between the storage unit 583 of the circuit board 582 (shown in FIG. 24) and the printer 10. The device-side terminals 381 are made of elastically deformable metal flat springs. More specifically, the device-side terminals 381 are formed to be elastically deformable along the plane defined by the K1-axis direction and the Z-axis direction.

The device-side substrate positioning structures 384 and 385 are arranged across the device-side terminals 381 of the electrical connection structure 382 in the K2-axis direction (direction in which the fluid introducing mechanism 36 and the contact mechanism 38 are aligned). The device-side substrate positioning structures 384 and 385 serve to eventually position the circuit board 582 of the fluid container 50 relative to the electrical connection structure 382 when the fluid container 50 is mounted to the mounting assembly unit 30. The device-side substrate positioning structures 384 and 385 are members extended along the K1-axis direction. The device-side substrate positioning structures 384 and 385 start entering the corresponding holding member-side positioning structures 592*t* and 593*t* shown in FIG. 18, before the device-side terminals 381 come into contact with the contacts cp of the circuit board 582, so that the circuit board 582 is positioned relative to the electrical connection structure 382.

As shown in FIG. 27, the movable support structure 40 is supported by the stationary member 35 to be movable relative to the stationary member 35 along the K1-axis direction. The movable support structure 40 includes a base part 41, a supply assembly support part 42 and a substrate support part 48. The base part 41 forms a front surface (front wall) of the movable support structure 40 located on the +K1-axis direction side. The base part 41 is arranged substantially parallel to the Z-axis direction and the K2-axis direction. The supply assembly support part 42 and the substrate support part 48 are connected with the base part 41. The supply assembly support part 42 and the substrate support part 48 are members extended from the base part 41 in the +Z-axis direction (upward).

The supply assembly support structure 42 is a member serving to determine the position of the fluid container 50 (more specifically, the fluid supply assembly 57) relative to the fluid introducing structure 362. The supply assembly support part 42 comes into contact with the container-side support structure 56 of the fluid container 50 (shown in FIG. 14), so as to support the fluid supply unit 55 such that the fluid container body 52 is located below the fluid supply unit 55 in the direction of gravity. When the mounting assembly unit 30 is viewed along the K1-axis direction, the supply assembly support part 42 is located at a position overlapping with the fluid introducing structure 362. The supply assembly support part 42 is formed in a concave shape in the −Z-axis direction. The supply assembly support part 42 has grooves 407 formed on both sides thereof in the K2-axis direction. The container-side support structure 56 enters the grooves 407, so as to restrict the motion of the fluid supply assembly 57 of the fluid container 50 and position the fluid container 50 relative to the mounting assembly unit 30 to some extent. More specifically, a plurality of planes defining the supply assembly support part 42 (for example, a first support plane 402, second support planes 403 and a third support plane 404) restrict the motion of the fluid supply assembly 57 of the fluid container 50. As shown in FIG. 27, the second support planes 403 constituting a +K1-axis direction side wall of the supply assembly support part 42 have reinforcement ribs 403*rb*.

The first support plane 402 of the supply assembly support part 42 located on the fluid introducing structure 362-side has a cut 406. The cut 406 is formed in a concave shape open on the +Z-axis direction side. When the mounting assembly unit 30 is viewed along the K1-axis direction, the cut 406 is located at a position overlapping with the fluid introducing structure 362. In the first state that the movable support structure 40 is moved to the most +K1-axis direction side relative to the stationary member 35, the cut 406 is located on the +K1-axis direction side of the fluid introducing structure 362. As shown in FIG. 28, in the second state, an end portion of the fluid introducing structure 362 is located inside of the cut 406.

The substrate support part 48 is a member serving to determine the position of the fluid container 50 (more specifically, the circuit board 582) relative to the contact mechanism 38. When the mounting assembly unit 30 is viewed along the K1-axis direction, the substrate support part 48 is located at a position overlapping with the contact mechanism 38. The substrate support part 48 is formed in a concaves shape in the −Z-axis direction. A plurality of planes defining the substrate support part 48 (for example, a first substrate support plane 482) restrict the motion of the circuit board 582 of the fluid container 50.

As shown in FIG. 30, the stationary member 35 includes a first stationary member 32 and a second stationary member 33. A second mounting wall 307B is provided on the first stationary member 32, and a first mounting wall 307A is provided on the second stationary member 33. The first stationary member 32 serves as an auxiliary member to support the second stationary member 33. Two coil springs 39A and 39B serving as biasing members are placed between the first stationary member 32 and the movable support structure 40. The coil springs 39A and 39B are arranged across the contact mechanism 38 and the fluid introducing mechanism 36 placed therebetween in the K2-axis direction. When there is no necessity to distinguish between the two coil springs 39A and 39B, the coil springs are expressed by a symbol "39".

The coil spring 39 has one end portion coming into contact with the first stationary member 32 and the other end portion coming into contact with the movable support structure 40. The movable support structure 40 includes a spring holder 49A inserted into the other end portion side of the coil spring 39A and a spring holder 49B inserted into the other end portion side of the coil spring 39B. When there is no necessity to distinguish between the two spring holders 49A and 49B, the spring holders are expressed by a symbol "49".

The coil springs 39 bias the movable support structure 40 in the +K1-axis direction (second direction). In the second state, the motion of the movable support structure 40 in the +K1-axis direction is restricted by the lock mechanism 200. When the lock mechanism 200 is unlocked, the movable support structure 40 is pushed toward the +K1-axis direction by the biasing force of the coil springs 39, so that the mounting assembly unit 30 is made in the first state (shown in FIG. 27). FIG. 30 illustrates a spring (tension spring) 210 serving as a biasing member and a mounting element 202 to which one end portion of the spring 210 is mounted in the lock mechanism 200.

A-4-2. General Structure of Lock Mechanism 200

Figure 31:
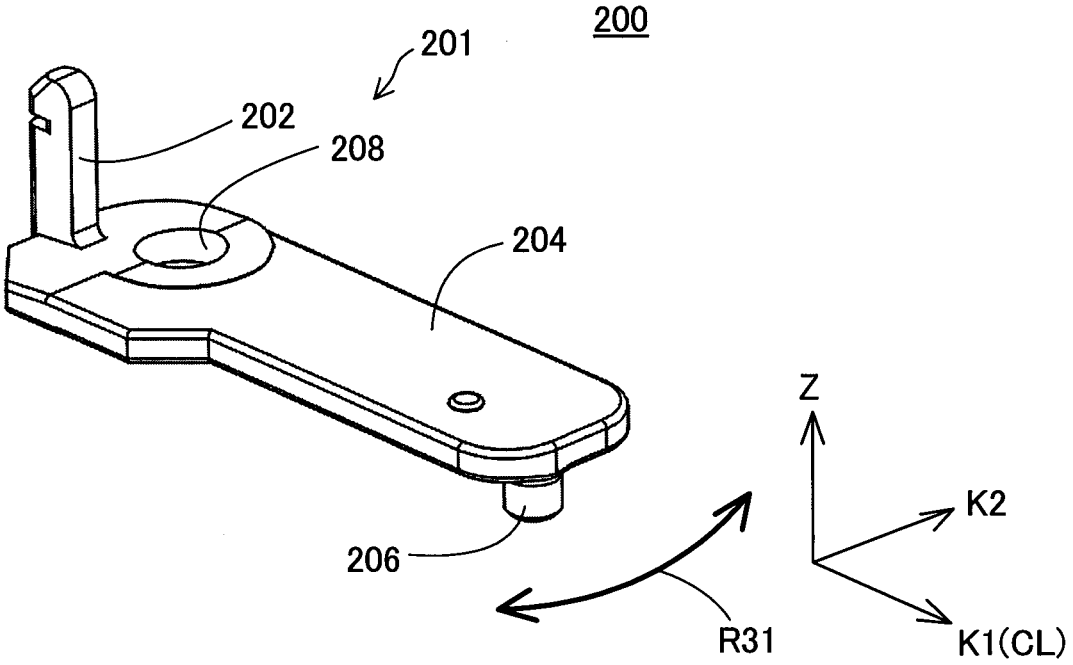
FIG. 31 is a perspective view illustrating an engagement member of a lock mechanism.

FIG. 31 is a perspective view illustrating the engagement member 201 of the lock mechanism 200. The engagement member 201 includes a plate-like engagement main body 204, the mounting element 202 and a projection 206 serving as a connection structure-side engagement element. The engagement main body 204 has a groove 208 forming a rotating axis of the projection 206. A projection of the stationary member 35 described later is inserted into the groove 208. The projection 206 is provided to be movable in the direction of an arrow R31 including a K2-axis direction component about the groove 208 as the support point. The mounting element 202 is provided on a −K1-axis direction side end portion of the engagement main body 204. The mounting element 202 is a projection member extended from the engagement main body 204 in the +Z-axis direction. One end portion of the spring 210 is mounted to the mounting element 202. The other end portion of the spring 210 is mounted to the stationary member 35. The engagement member 201 is accordingly biased in the +K1-axis direction by the spring 210. The projection 206 is provided on a +K1-axis direction side end portion of the engagement main body 204. The projection 206 is extend portioned from the engagement main body 204 in the −Z-axis direction.

A-4-3. Detailed Structure of Movable Support Structure 40

Figure 32:
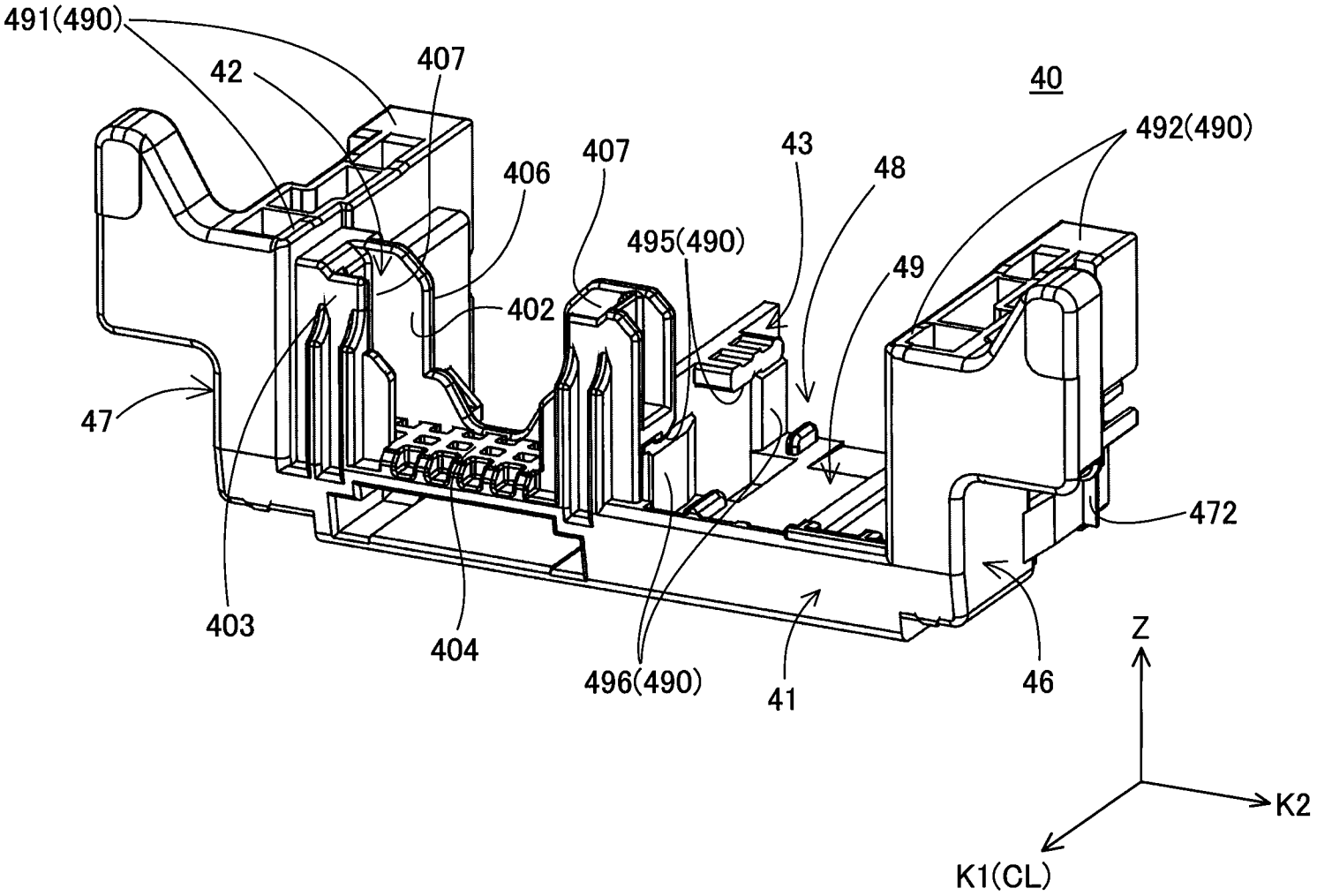
FIG. 32 is a first perspective view illustrating a movable support structure.
Figure 33:
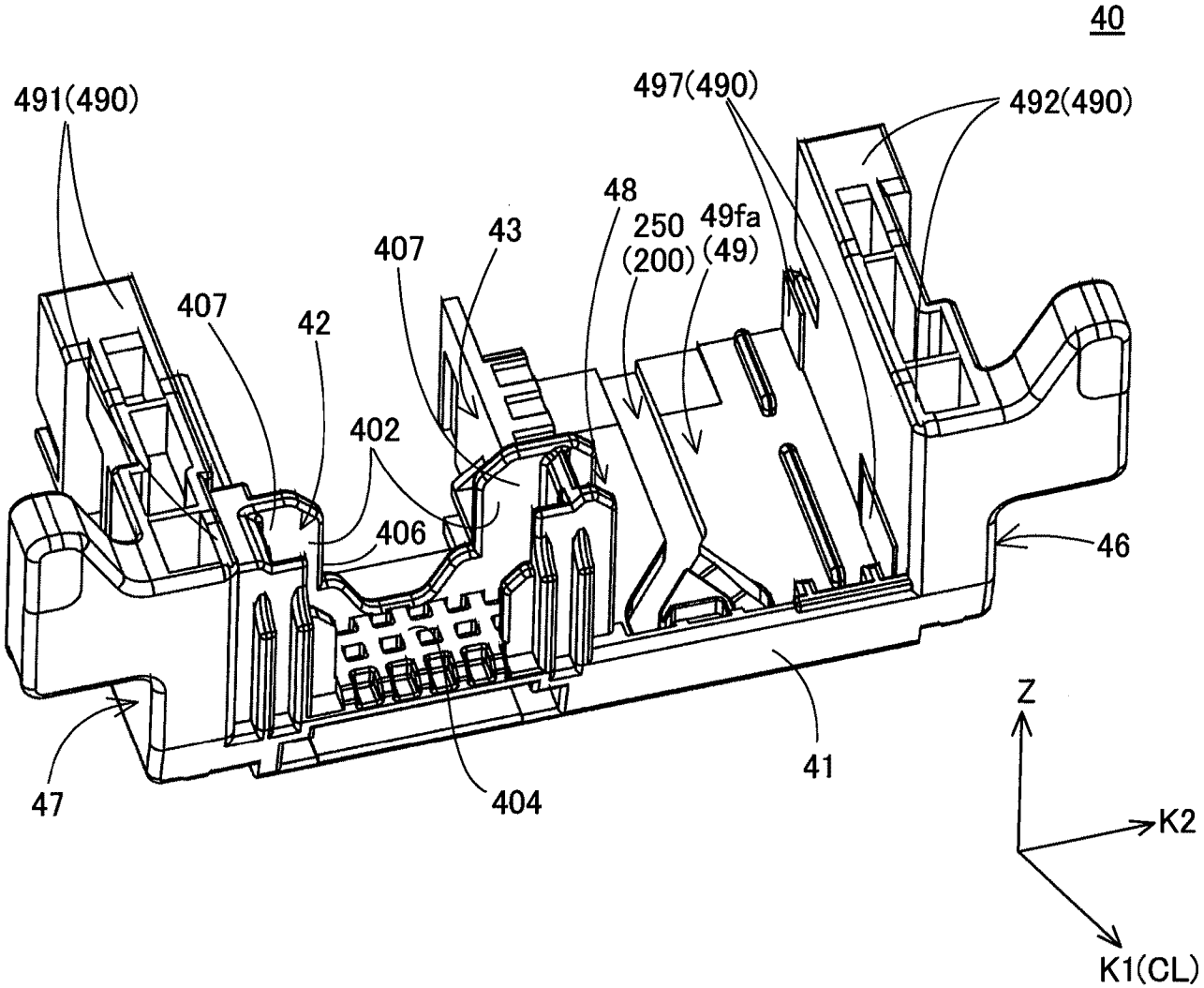
FIG. 33 is a second perspective view illustrating the movable support structure.
Figure 34:
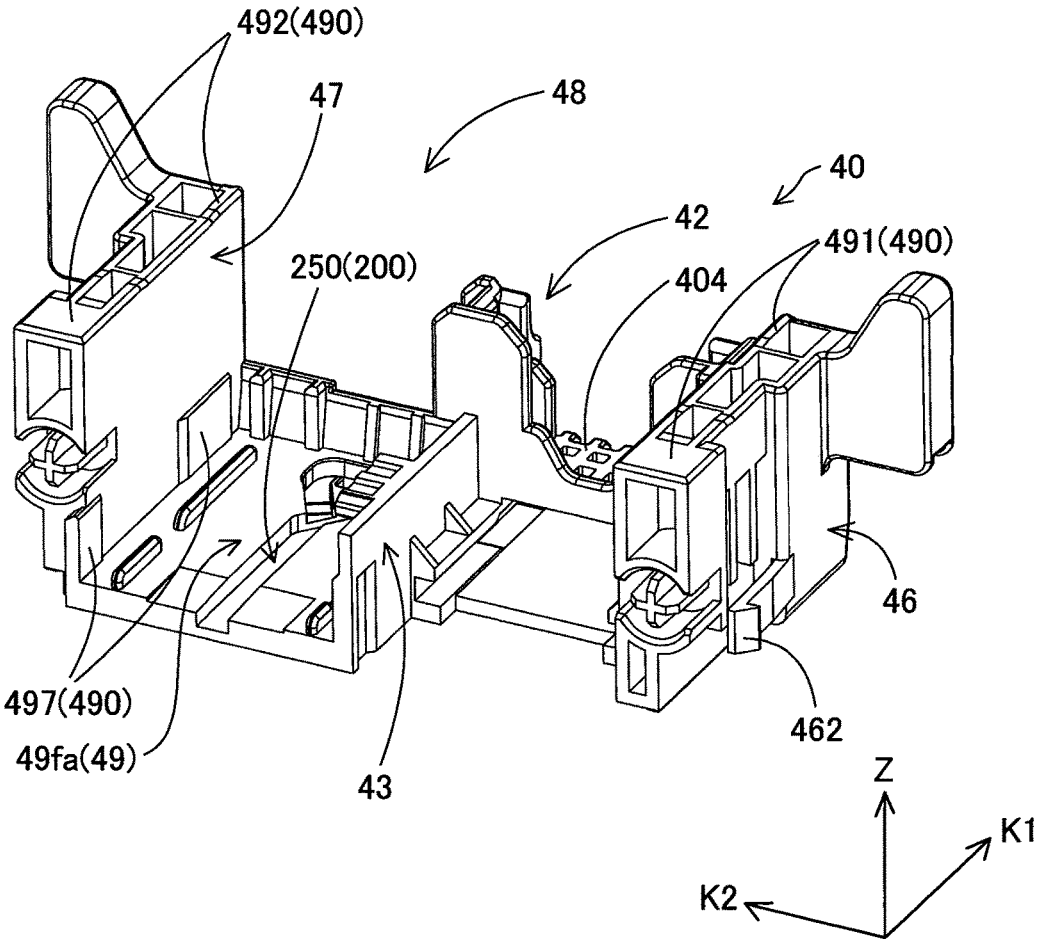
FIG. 34 is a third perspective view illustrating the movable support structure.
Figure 35:
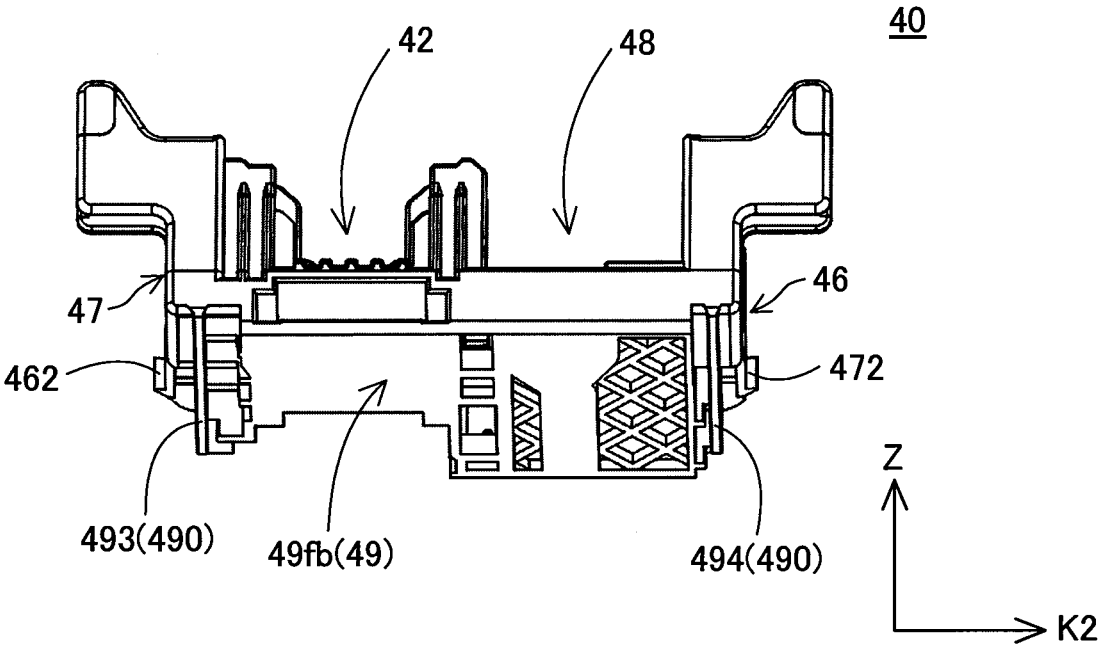
FIG. 35 is a fourth perspective view illustrating the movable support structure.

FIG. 32 is a first perspective view illustrating the movable support structure 40. FIG. 33 is a second perspective view illustrating the movable support structure 40. FIG. 34 is a third perspective view illustrating the movable support structure 40. FIG. 35 is a fourth perspective view illustrating the movable support structure 40.

As shown in FIG. 32, the movable support structure 40 also has a first side surface (first side wall) 46, a second side surface (second side wall) 47, a partition surface (partition wall) 43 and a bottom (bottom wall) 49. The base part 41, the first side surface 46, the second side surface 47 and the partition surface 43 are members respectively extended in the +Z-axis direction from the bottom 49. The first side surface 46 and the second side surface 47 are opposed to each other in the K2-axis direction. The partition surface 43 is placed between the first side surface 46 and the second side surface 47. The first side surface 46, the second side surface 47 and the partition surface 43 are arranged substantially parallel to the Z-axis direction and the K1-axis direction. The bottom 49 is arranged substantially parallel to the K1-axis direction and the K2-axis direction.

As shown in FIG. 34, a locking click 462 is provided on the first side surface 46. As shown in FIG. 32, a locking click 472 is provided on the second side surface 47, like the first side surface 46. The locking clicks 462 and 472 are engaged with the stationary member 35, so as to prevent the excessive motion of the movable support structure 40 in the +K1-axis direction. This prevents the movable support structure 40 from being unintentionally detached from the stationary member 35.

As shown in FIG. 33, a guide structure 250 is formed as part of the lock mechanism 200 on a bottom upper surface 49*fa* on the +Z-axis direction side of the bottom 49. The guide structure 250 is a groove formed in the bottom upper surface 49*fa*. The guide structure 250 is located immediately below the contact mechanism 38 (shown in FIG. 38). The guide structure 250 receives the projection 206 of the engagement member 201 and guides the projection 206 along the shape of the guide structure 250. The guide structure 250 has a support structure-side engagement element to be engaged with the projection 206 in the mounting state of the fluid container 50. The detailed structure of the lock mechanism 200 will be described later.

As shown in FIGS. 32 to 35, the movable support structure 40 includes a support structure-side guide assembly 490 configured to guide the motion of the movable support structure 40 relative to the stationary member 35 in the K1-axis direction. The support structure-side guide assembly 490 comes into contact with the stationary member 35, so as to restrict the motion of the movable support structure 40 in the directions perpendicular to the K1-axis direction.

The support structure-side guide assembly 490 includes a first part 491 (shown in FIG. 33), a second part 492 (shown in FIG. 33), a third part 493 (shown in FIG. 35), a fourth part 494 (shown in FIG. 35), a fifth part 495 (shown in FIG. 32), a sixth part 496 (shown in FIG. 32) and a seventh part 497 (shown in FIG. 33).

As shown in FIG. 33, the first part 491 and the second part 492 constitute an upper end surface of the movable support structure 40. More specifically, the first part 491 constitutes an upper end surface of the second side surface 47, and the second part 492 constitutes an upper end surface of the first side surface 46. The first part 491 and the second part 492 are arranged across the guide structure 250 placed therebetween in the K2-axis direction.

As shown in FIG. 35, the third part 493 and the fourth part 494 constitute a lower end surface of the movable support structure 40. The third part 493 and the fourth part 494 are formed on a rear surface 49*fb* of the bottom 49. More specifically, the third part 493 constitutes a lower end surface of the second side surface 47, and the fourth part 494 constitutes a lower end surface of the first side surface 46. The third part 493 and the fourth part 494 are arranged across the guide structure 250 placed therebetween in the K2-axis direction.

As shown in FIG. 32, the fifth part 495 and the sixth part 496 are provided on the partition surface 43. More specifically, the fifth part 495 constitutes a lower end surface of a member protruded from the partition surface 43 in the +K2-axis direction. The sixth part 496 is located on the −Z-axis direction side of the fifth part 495 and constitutes surfaces of members (protruded members) provided on the partition surface 43.

As shown in FIG. 33, the seventh part 497 is provided on the first side surface 46. More specifically, the seventh part 497 constitutes surfaces of members (protruded members) provided on the first side surface 46. The sixth part 496 and the seventh part 497 are arranged across the guide structure 250 placed therebetween in the K2-axis direction. As shown in FIGS. 32 to 35, the first part 491 to the seventh part 497 are located on at least the +K1-axis direction side end portion and the −K1-axis direction side end portion of the movable support structure 40, so as to guide the motion of the movable support structure 40 between the position relative to the stationary member 35 in the first state and the position in the second state.

A-4-4. Detailed Structure of Stationary Member 35

Figure 36:
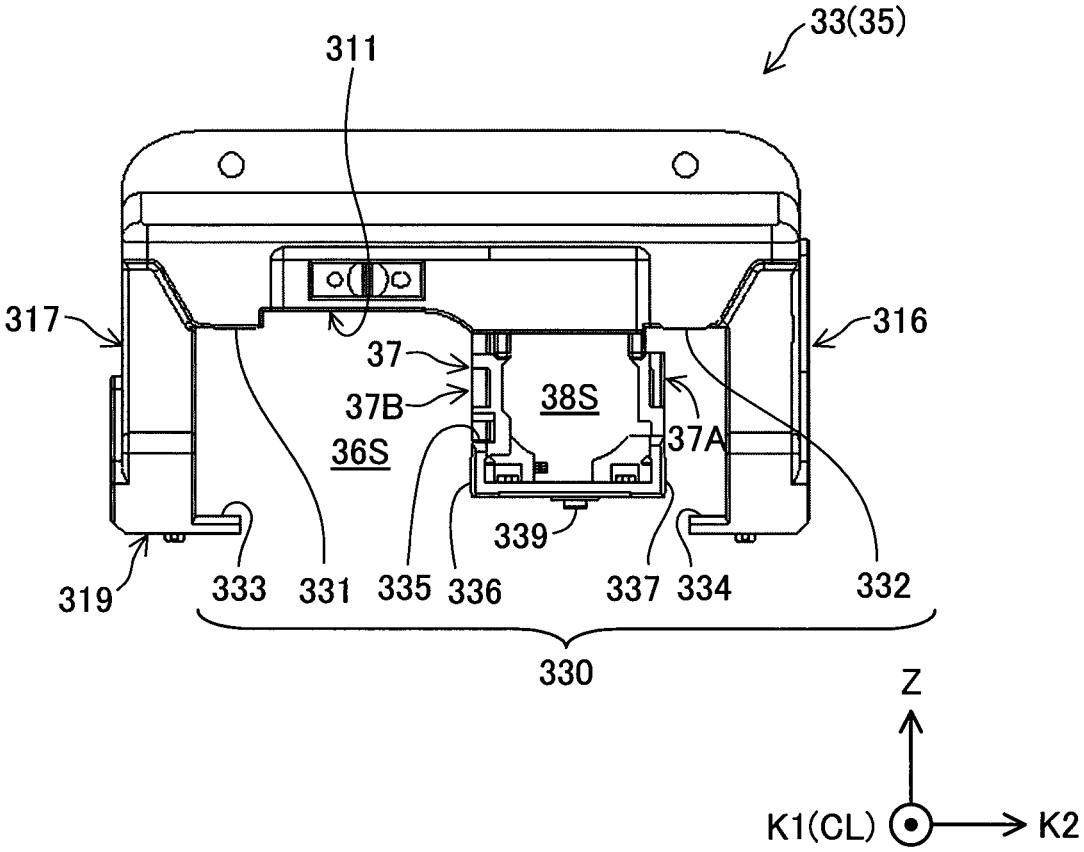
FIG. 36 is a front view illustrating a second stationary member.
Figure 37:
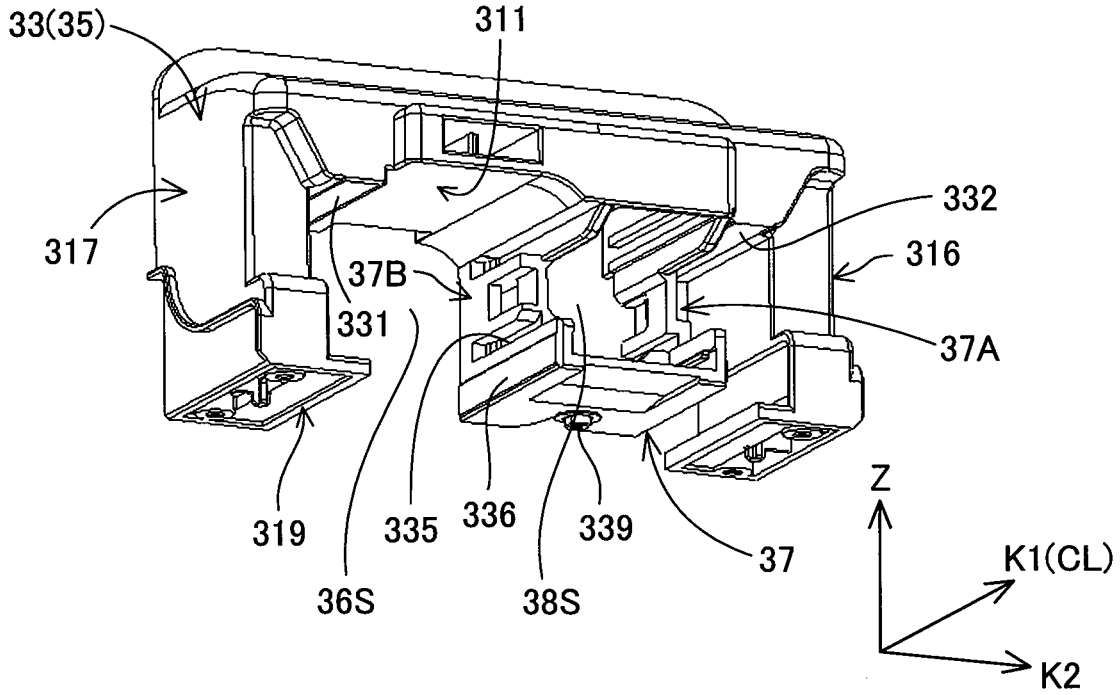
FIG. 37 is a first perspective view illustrating the second stationary member.
Figure 38:
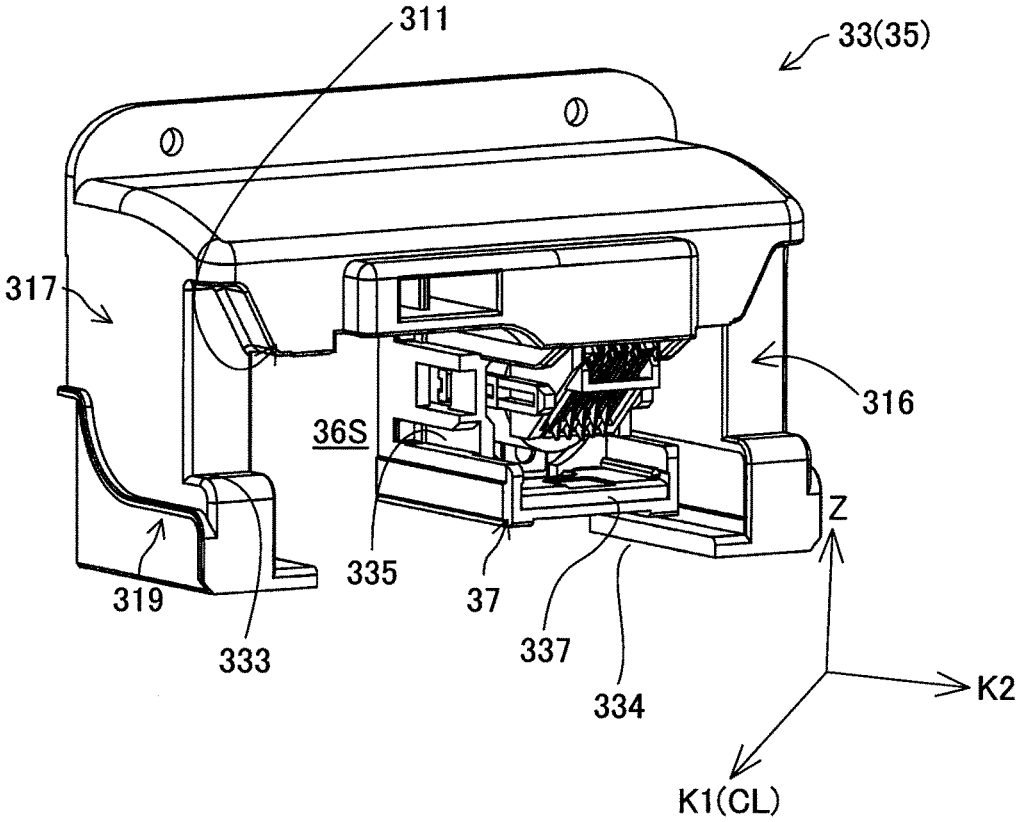
FIG. 38 is a second perspective view illustrating the second stationary member.

FIG. 36 is a front view illustrating the second stationary member 33. FIG. 37 is a first perspective view illustrating the second stationary member 33. FIG. 38 is a second perspective view illustrating the second stationary member 33. In FIGS. 36 to 38, the contact mechanism 38 and the fluid introducing mechanism 36 are omitted from the illustration.

As shown in FIG. 36, the stationary member 35 has a first placement section 36S as a space in which the fluid introducing mechanism 36 is placed, and a second placement section 38S as a space in which the contact mechanism 38 is placed. The second placement section 38S is defined by a contact mechanism mounting structure 37 provided on an upper surface (upper wall) 311 of the stationary member 35. The contact mechanism mounting structure 37 is a frame-like member extended from the upper surface 311 in the −Z-axis direction. The stationary member 35 also has a first side surface (first side wall) 316, a second side surface (second side wall) 317 and a bottom surface (bottom wall) 319. The first side surface 316 and the second side surface 317 are members respectively extended in the −Z-axis direction from the upper surface 311. The first side surface 316 and the second side surface 317 are opposed to each other in the K2-axis direction. The contact mechanism mounting structure 37 is located between the first side surface 316 and the second side surface 317. The upper surface 311 and the bottom surface 319 are opposed to each other in the Z-axis direction. The contact mechanism mounting structure 37 has a projection 339 formed on its bottom to be inserted into the groove 208 of the engagement member 201 (shown in FIG. 31).

As shown in FIG. 36, the stationary member 35 includes a motion guide assembly 330 configured to guide the motion of the movable support structure 40 in the first direction (−K1-axis direction) or in the second direction (+K1-axis direction). When the movable support structure 40 is moved in the K1-axis direction, the motion guide assembly 330 comes into contact with the support structure-side guide assembly 490 of the movable support structure 40 (shown in FIGS. 32 to 35), so as to restrict the motion of the movable support structure 40 in the directions perpendicular to the K1-axis direction.

The motion guide assembly 330 includes a first guide section (first guide restriction part) 331, a second guide part (second guide restriction part) 332, a third guide part (third guide restriction part) 333, a fourth guide part (fourth guide restriction part) 334, a fifth guide part (fifth guide restriction part) 335, a sixth guide part (sixth guide restriction part) 336 and a seventh guide part (seventh guide restriction part) 337. The first to the seventh guide parts 331 to 337 serve to restrict the motion of the movable support structure 40 relative to the stationary member 35 in the directions perpendicular to the first direction (−K1-axis direction) (i.e., directions parallel to the plane defined by the K2-axis direction and the Z-axis direction).

As shown in FIG. 37, the first guide part 331 and the second guide part 332 constitute the upper surface 311 of the stationary member 35. The first guide part 331 is located on the second side surface 317-side, and the second guide part 332 is located on the first side surface 316-side. The first guide part 331 and the second guide part 332 are arranged across the guide structure 250 (shown in FIG. 33) placed therebetween in the K2-axis direction.

As shown in FIG. 38, the third guide part 333 and the fourth guide part 334 constitute the bottom surface 319 (shown in FIG. 37) of the stationary member 35. The third guide part 333 is a member extended in the +K2-axis direction from the second side surface 317. The fourth guide part 334 is a member extended in the −K2-axis direction from the first side surface 316. The third guide part 333 and the fourth guide part 334 are arranged across the guide structure 250 (shown in FIG. 33) placed therebetween in the K2-axis direction. The first guide part 331 to the fourth guide part 334 are planes extended along both end portions of the stationary member 35 in the K1-axis direction.

As shown in FIG. 37, the fifth guide part 335 and the sixth guide part 336 are provided on a −K2-axis direction side surface 37B of the contact mechanism mounting structure 37. The fifth guide part 335 constitutes a bottom surface of a cut formed in the side surface 37B. The sixth guide part 336 constitutes a surface of a member protruded from the side surface 37B. The seventh guide part 337 is provided on a +K2-axis direction side surface 37A of the contact mechanism mounting structure 37. As shown in FIG. 36, the seventh guide part 337 constitutes a surface of a member protruded from the side surface 37A. The sixth guide part 336 with the fifth guide part 335 and the seventh guide part 337 are arranged across the guide structure 250 (shown in FIG. 33) placed therebetween in the K2-axis direction. The fifth guide part 335 is extended by a predetermined length from the −K1-axis direction side end portion of the contact mechanism mounting structure 37. The sixth guide part 336 and the seventh guide part 337 are extended along both ends of the contact mechanism mounting structure 37 in the K1-axis direction. The length of the contact mechanism mounting structure 37 in the K1-axis direction is slightly smaller than the length of the stationary member 35 in the K1-axis direction.

When the movable support structure 40 is moved in the K1-axis direction relative to the stationary member 35, the motion guide assembly 330 guides the motion of the movable support structure 40 in the K1-axis direction, while restricting the motion of the movable support structure 40 in the directions perpendicular to the K1-axis direction. More specifically, the first part 491 (shown in FIG. 32) comes into contact with the first guide part 331, and the second part 492 (shown in FIG. 32) comes into contact with the second guide part 332. This restricts the motion of the movable support structure 40 in the +Z-axis direction. The third part 493 (shown in FIG. 35) comes into contact with the third guide part 333, and the fourth part 494 (shown in FIG. 35) comes into contact with the fourth guide part 334. This restricts the motion of the movable support structure 40 in the −Z-axis direction. The fifth part 495 (shown in FIG. 32) comes into contact with the fifth guide part 335, so as to restrict the motion of the movable support structure 40 in the −Z-axis direction. The sixth part 496 (shown in FIG. 36) comes into contact with the sixth guide part 336, so as to restrict the motion of the movable support structure 40 in the +K2-axis direction. The seventh part 497 (shown in FIG. 33) comes into contact with the seventh guide part 337, so as to restrict the motion of the movable support structure 40 in the −K2-axis direction.

As shown in FIG. 36, the contact mechanism 38 is placed in the second placement section 38S. More specifically, when the stationary member 35 is viewed from the +K1-axis direction side, the electrical connection structure (main body-side electrical connection structure) 382 including the device-side terminals 381 (shown in FIG. 26) is placed in the second placement section 38S. As shown in FIG. 36, the electrical connection structure 382 is located between the first guide part 331 with the second guide part 332 and the third guide part 333 with the fourth guide part 334 in the Z-axis direction. The electrical connection structure 382 is also located between the sixth guide part 336 with the fifth guide part 335 and the seventh guide part 337 in the K2-axis direction. In other words, the electrical connection structure 382 is located between the guide parts 331 to 337 of the motion guide assembly 330.

A-4-5. Detailed Structure of Contact Mechanism 38

Figure 39:
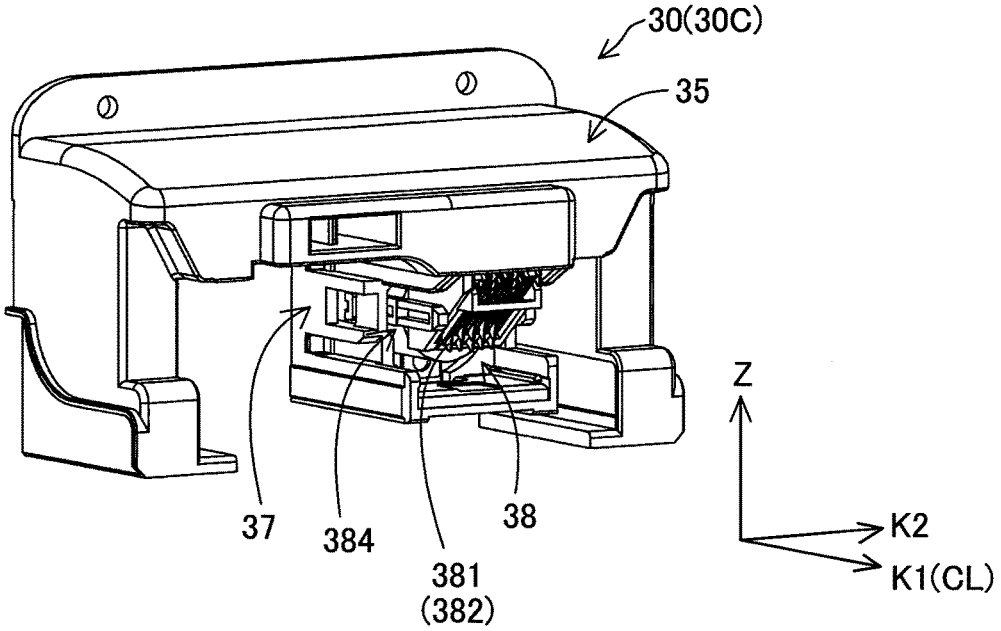
FIG. 39 is a perspective view illustrating a contact mechanism mounted to a stationary member.
Figure 40:
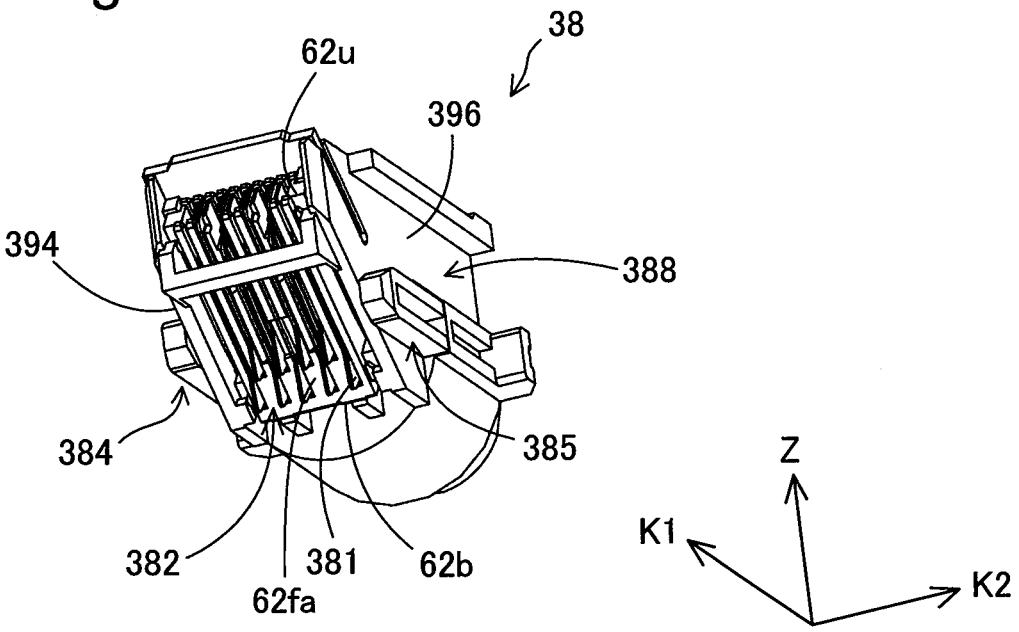
FIG. 40 is a perspective view illustrating the contact mechanism.
Figure 41A:
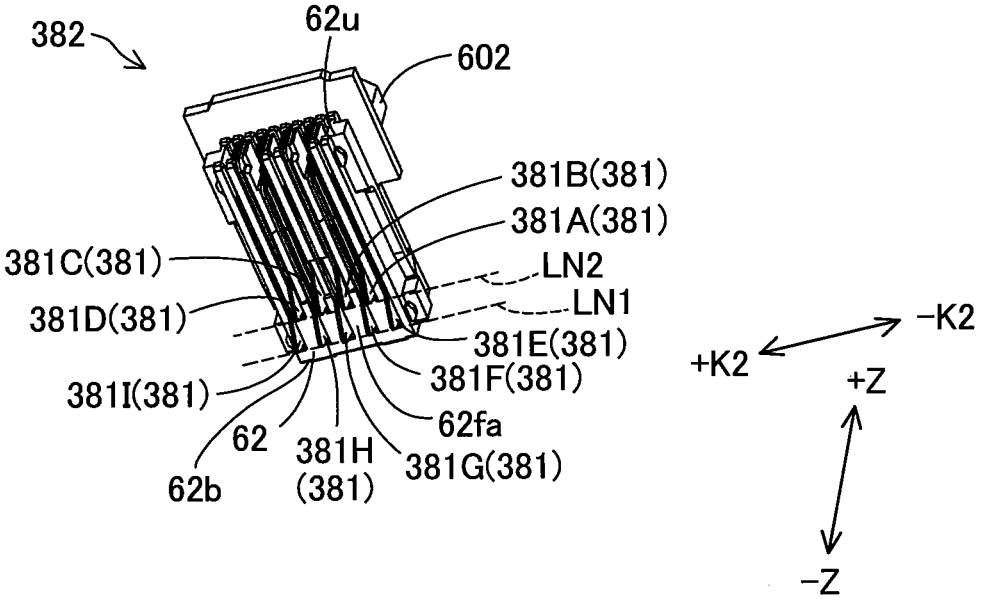
FIG. 41A is a perspective view illustrating an electrical connection structure.
Figure 41B:
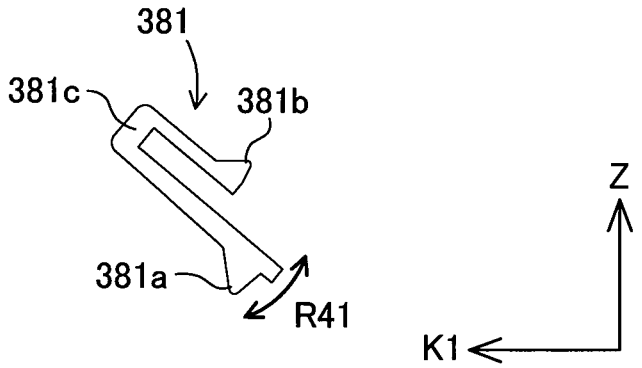
FIG. 41B is a diagram illustrating a device-side terminal.

FIG. 39 is a perspective view illustrating the contact mechanism 38 mounted to the stationary member 35. FIG. 40 is a perspective view illustrating the contact mechanism 38. FIG. 41A is a perspective view illustrating the electrical connection structure 382. FIG. 41B is a diagram illustrating the device-side terminal 381.

As shown in FIG. 39, the contact mechanism 38 is mounted to the contact mechanism mounting structure 37. More specifically, the contact mechanism 38 is mounted to the stationary member 35 with a certain backlash set in the directions perpendicular to the k1-axis direction. This configuration allows the electrical connection structure 382 of the contact mechanism 38 to be displaced in the direction intersecting with the first direction (−K1-axis direction) (in this embodiment, in the direction along the plane parallel to the Z-axis direction and the K2-axis direction).

As shown in FIG. 40, the contact mechanism 38 includes the electrical connection structure 382 (shown in FIG. 39) and a holding member 388 provided to hold the electrical connection structure 382. The holding member 388 has a first side wall portion 394 and a second side wall portion 396. The first side wall portion 394 and the second side wall portion 396 are opposed to each other. The first side wall portion 394 is located on the −K2-axis direction side, and the second side wall portion 396 is located on the +K2-axis direction side. The first side wall portion 394 and the second side wall portion 396 are planes arranged substantially along the direction of gravity (Z-axis direction).

As shown in FIGS. 39 and 40, the contact mechanism 38 includes the first device-side substrate positioning structure 384 and the second device-side substrate positioning structure 385 serving as the positioning structures (device-side substrate positioning structures). In the course of mounting the fluid container 50, the first and the second device-side substrate positioning structures 384 and 385 start entering the corresponding holding member-side positioning structures 592*t* and 593*t* (shown in FIG. 18), before the device-side terminals 381 come into contact with the contacts cp of the circuit board 582 (shown in FIG. 23). This positions the contacts cp of the circuit board 582 relative to the device-side terminals 381 of the electrical connection structure 382. This positioning results in positioning of the fluid container-side terminals 581 relative to the device-side terminals 381 in the +K1-axis direction (first direction) and in the direction intersecting with the +K1-axis direction (direction along the plane parallel to the Z-axis direction and the K2-axis direction).

The first and the second device-side substrate positioning structures 384 and 385 are arranged across the electrical connection structure 382 placed therebetween in the K2-axis direction. The first and the second device-side substrate positioning structures 384 and 385 are located at different positions but have the same shape.

The first and the second device-side substrate positioning structures 384 and 385 are members extended along the K1-axis direction (connecting direction). As shown in FIG. 39, the first device-side substrate positioning structure 384 is protruded outward from the first side wall portion 394. As shown in FIG. 40, the second device-side substrate positioning structure 385 is protruded outward from the second side wall portion 396.

As shown in FIG. 40, the electrical connection structure 382 is held in a +K1-axis direction side part of the holding member 388. As shown in FIG. 41A, the electrical connection structure 382 includes a terminal holding structure 62 held by the holding member 388, nine device-side terminals 381A to 381I held by the terminal holding structure 62, and a connector 602 held by the terminal holding structure 62. When there is no necessity to distinguish the nine device-side terminals 381A to 381I from one another, the device-side terminals are expressed by a symbol "381".

As shown in FIG. 41A, the terminal holding structure 62 has a surface 62*fa* inclined such that its lower end portion 62*b* is located on the −K1-axis direction side of an upper end portion 62*u*. One end portion 381*a* of the device-side terminal 381 (shown in FIG. 41B) is exposed on the surface 62*fa*. The other end portion 381*b* of the device-side terminal 381 (shown in FIG. 41B) is electrically connected with the connector 602. The connector 602 is electrically connected with the controller of the printer 10 via wiring.

As shown in FIG. 41B, the device-side terminal 381 is a plate-like member. The device-side terminal 381 is elastically deformable. More specifically, the device-side terminal 381 is held by the terminal holding structure 62, such that its one end portion 381*a* is elastically deformed in the direction of an arrow R41 about a bent 381*c*. The direction of the arrow R41 is parallel to the K1-axis direction and the Z-axis direction.

As shown in FIG. 41A, the plurality of device side terminals 381A to 381I constituting the device-side terminal group (more specifically, their one end portions 381*a*) are arranged to form two lines LN1 and LN2 at different positions in the Z-axis direction. The lines LN1 and LN2 are parallel to the K2-axis direction.

A-4-6. Restriction of Movable Support Structure 40 and Setting of Fluid Container 50

Figure 42:
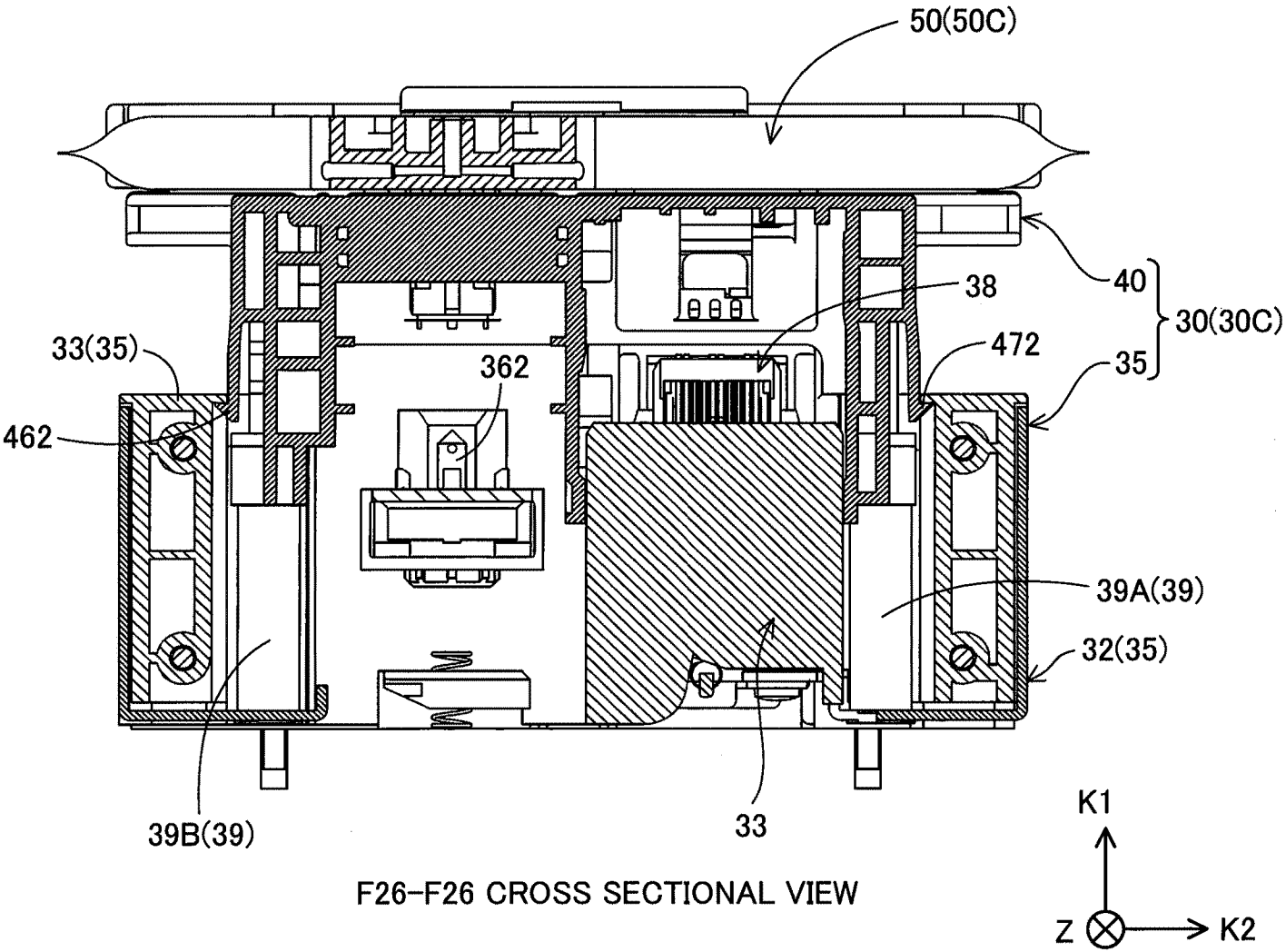
FIG. 42 is an F26-F26 cross sectional view of FIG. 26.

FIG. 42 is an F26-F26 cross sectional view of FIG. 26. FIG. 42 also illustrates the fluid container 50. As shown in FIG. 42, in the first state that the movable support structure 40 is protruded outward relative to the stationary member 35, the coil springs 39 bias the movable support structure 40 in the second direction (+K1-axis direction). Engagement of the locking clicks 462 and 472 of the movable support structure 40 with the stationary member 35, however, restricts the excessive motion of the movable support structure 40 relative to the stationary member 35 in the +K1-axis direction. This prevents the movable support structure 40 from being unintentionally detached from the stationary member 35.

Figure 43:
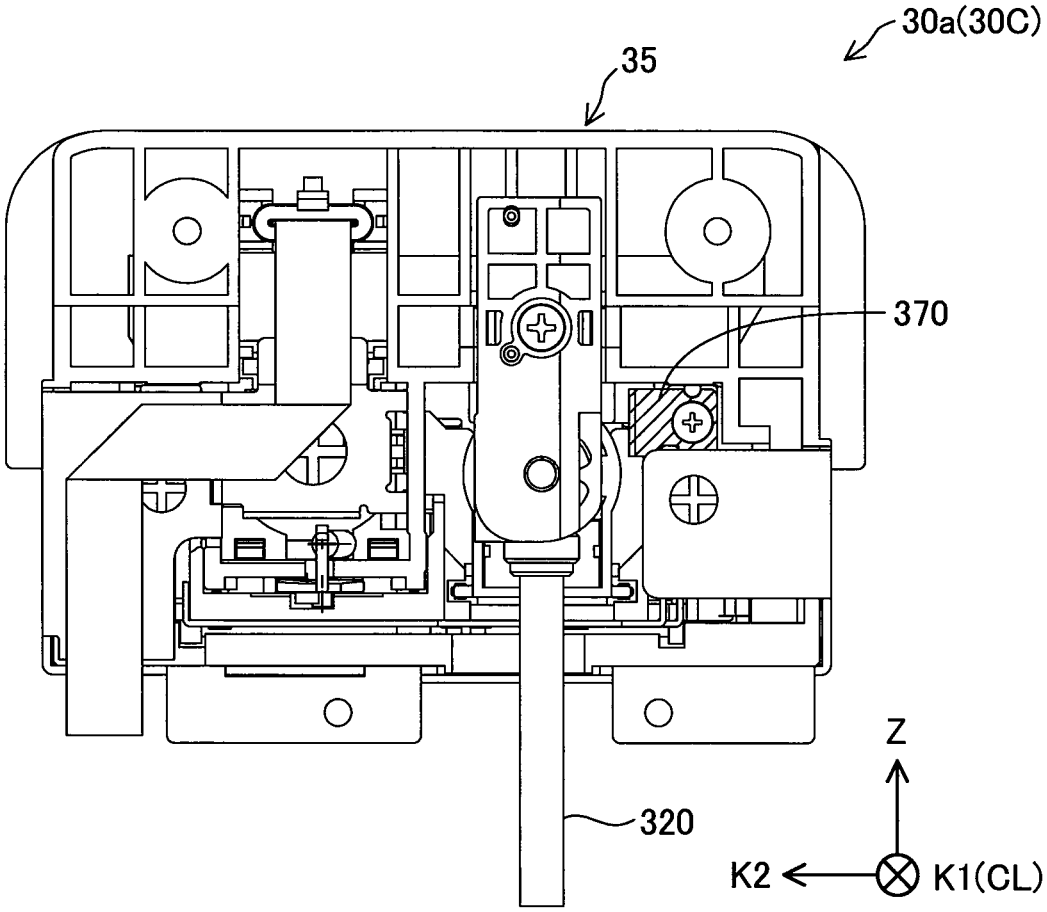
FIG. 43 is a rear view illustrating a mounting assembly unit of modified structure.
Figure 44:
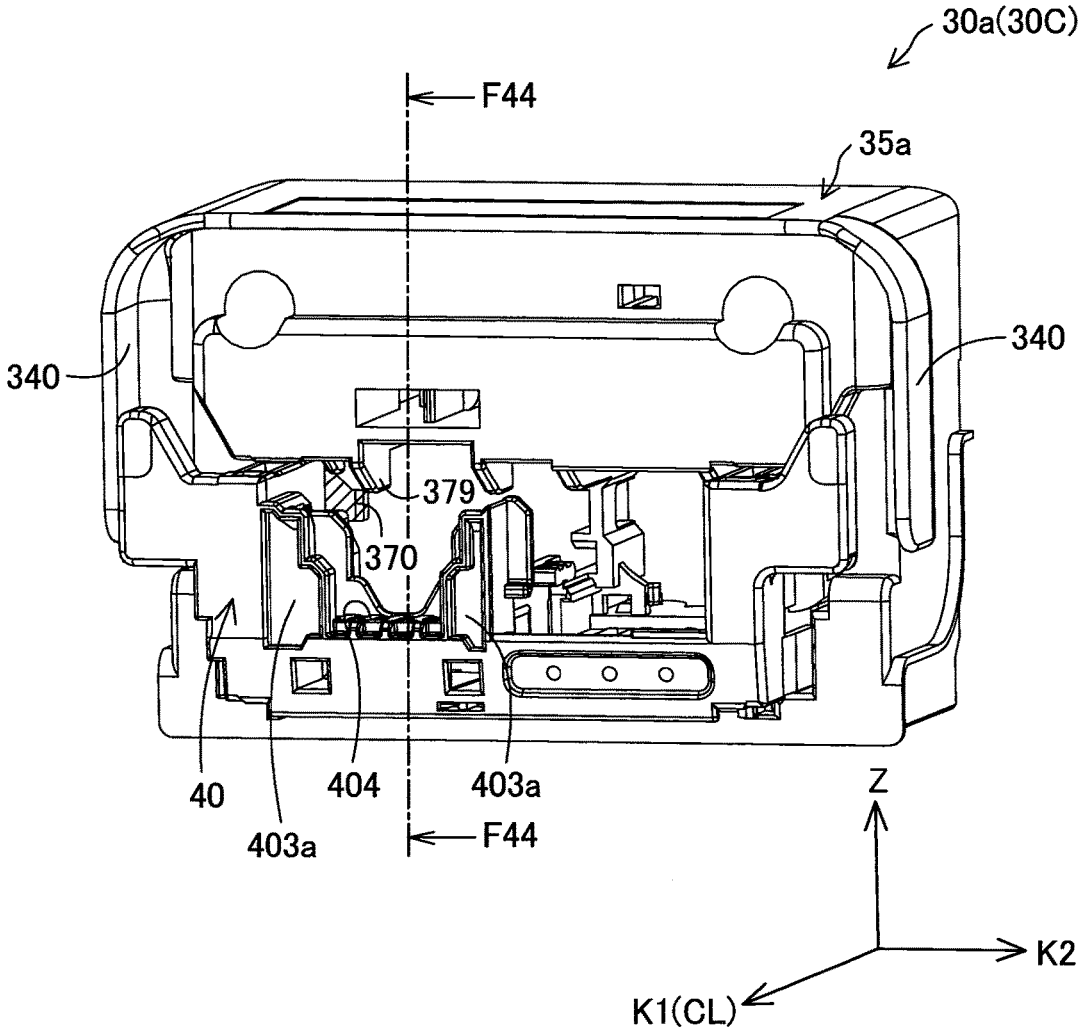
FIG. 44 is a first diagram illustrating a restriction element.
Figure 45:
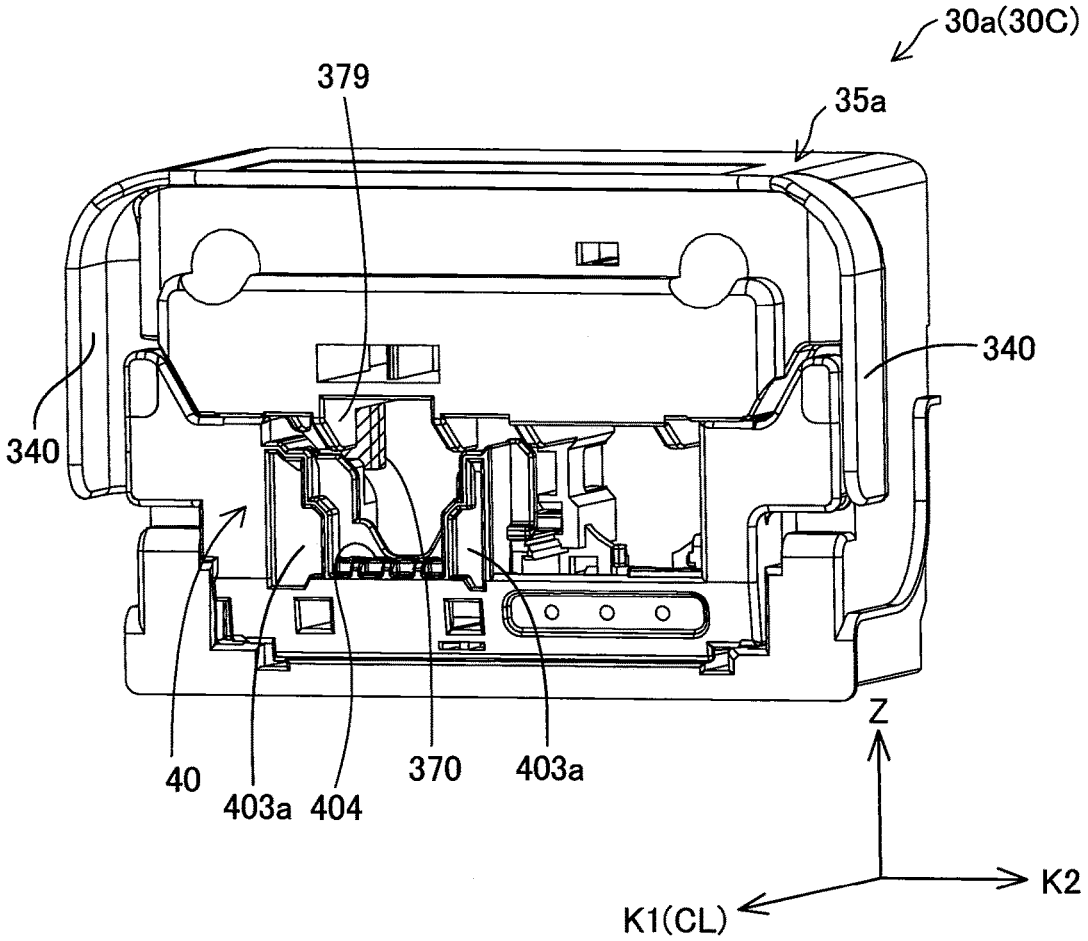
FIG. 45 is a diagram illustrating the restriction element.
Figure 46:
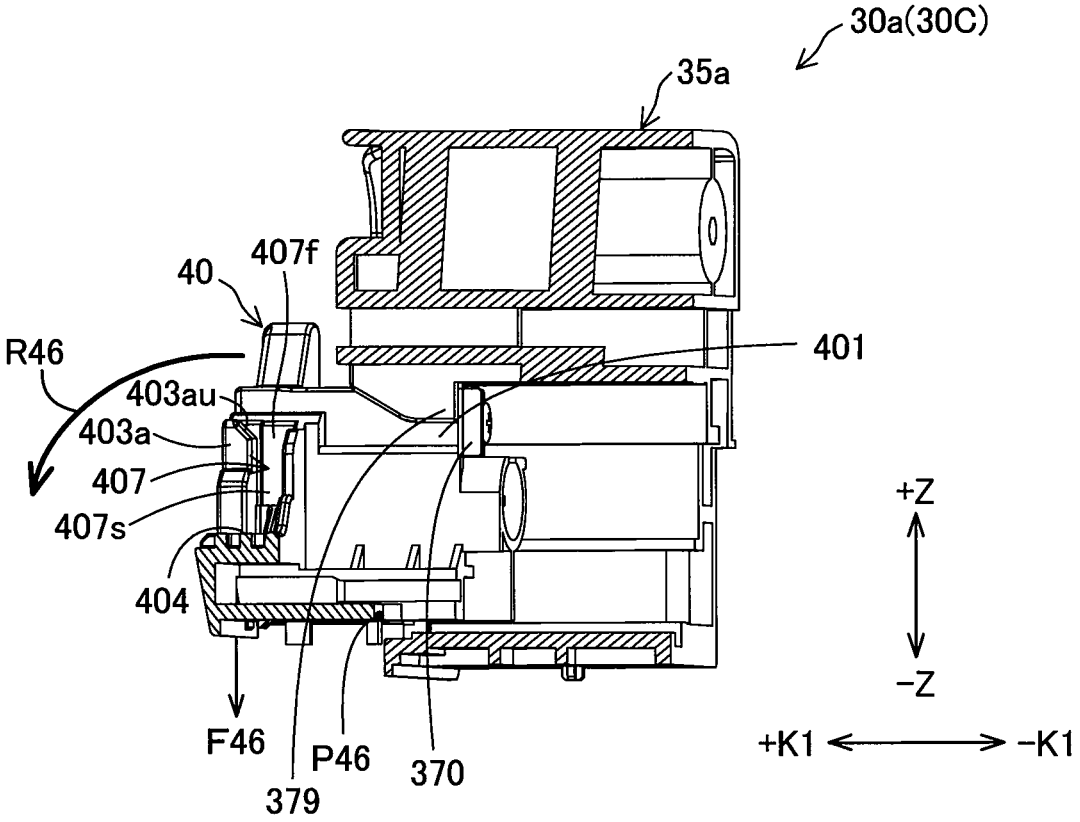
FIG. 46 is an F44-F44 cross sectional view of FIG. 44.

FIG. 43 is a rear view illustrating a mounting assembly unit 30*a* of modified structure. FIG. 44 is a first diagram illustrating a restriction element 370. FIG. 45 is a diagram illustrating the restriction element 370. FIG. 46 is an F44-F44 cross sectional view of FIG. 44. In FIGS. 44 and 45, the fluid introducing mechanism 36 and the contact mechanism 38 are omitted from the illustration of the mounting assembly unit 30*a*. In FIGS. 43 to 45, in order to facilitate understanding, the restriction element 370 is shown by single-hatching. The following describes the mounting assembly unit 30*a* having a partly modified structure from the structure of the mounting assembly unit 30*a* of the first embodiment. At least part of the modification of the mounting assembly unit 30*a* may be applied to the mounting assembly unit 30.

The mounting assembly unit 30*a* differs from the mounting assembly unit 30 mainly by addition of a restriction element 370, an abutment part 379 and a cover member 340, omission of the reinforcement ribs 403*rb* (shown in FIG. 27) and the shape of second support planes 403*a*. The cover member 340 will be described in detail in a second embodiment.

As shown in FIGS. 43 to 45, the movable support structure 40 has the restriction element 370. According to this embodiment, the restriction element 370 is a sheet metal. The restriction element 370 is provided at a corner 401 of the movable support structure 40 between the −K1-axis direction side and the +Z-axis direction side. The restriction element 370 comes into contact with the fluid container 50 when the fluid container 50 is set in the movable support structure 40, so that the restriction element 370 is located in the direction of gravity above a part of the movable support structure 40 (for example, the third support plane 404) receiving the own weight (load) of the fluid container 50.

As shown in FIG. 46, when the fluid container 50 is set in the movable support structure 40 in the state that the movable support structure 40 is protruded outward relative to the stationary member 35 (in the first state), the movable support structure 40 receives an external force F46 downward in the direction of gravity by the own weight of the fluid container 50 and an external force for the setting. When receiving the external force F46, the movable support structure 40 is going to rotate in the direction of an arrow R46 about a contact point P46 between the stationary member 35 and the movable support structure 40 on the lower side in the direction of gravity as the support point. The direction of the arrow R46 includes a downward component in the direction of gravity (−Z-axis direction component) intersecting with the second direction (+K1-axis direction). The restriction element 370 comes into contact with the abutment part 379 as part of the stationary member 35, so as to restrict the motion of the movable support structure 40 in the direction of the arrow R46. This reduces the likelihood that the movable support structure 40 is unintentionally detached from the stationary member 35. This accordingly suppresses a fall of the movable support structure 40 from the printer 10 and a resulting damage by the fall.

As shown in FIGS. 44 and 45, the second support planes 403*a* have a greater thickness (length in the K1-axis direction) than that of the second support planes 403 (shown in FIG. 27) by omission of the reinforcement ribs 403*rb* (shown in FIG. 27). The second support planes 403*a* constitute wall surfaces of the grooves 407 in which the container-side support structure 56 of the fluid container 50 (shown in FIG. 14) is inserted when the fluid container 50 is set in the mounting assembly unit 30*a*. As shown in FIG. 46, the second support plane 403*a* has a +Z-axis direction side end portion 403*au* inclined in the K2-axis direction. The +Z-axis direction side end portion 403*au* has a tapered shape. More specifically, the +Z-axis direction side end portion 403*au* is inclined such that a +Z-axis direction side end portion 407*f* of the groove 407 in which the container-side support structure 56 is inserted first has a greater length in the K1-axis direction (i.e., greater width of receiving the container-side support structure 56) than that of a −Z-axis direction side end portion 407*s* of the groove 407. This configuration causes the container-side support structure 56 (shown in FIG. 14) to be smoothly inserted in the grooves 407, thus enabling the fluid container 50 to be readily set in the mounting assembly unit 30*a*.

A-4-7. Detailed Structure of Lock Mechanism 200

Figure 47:
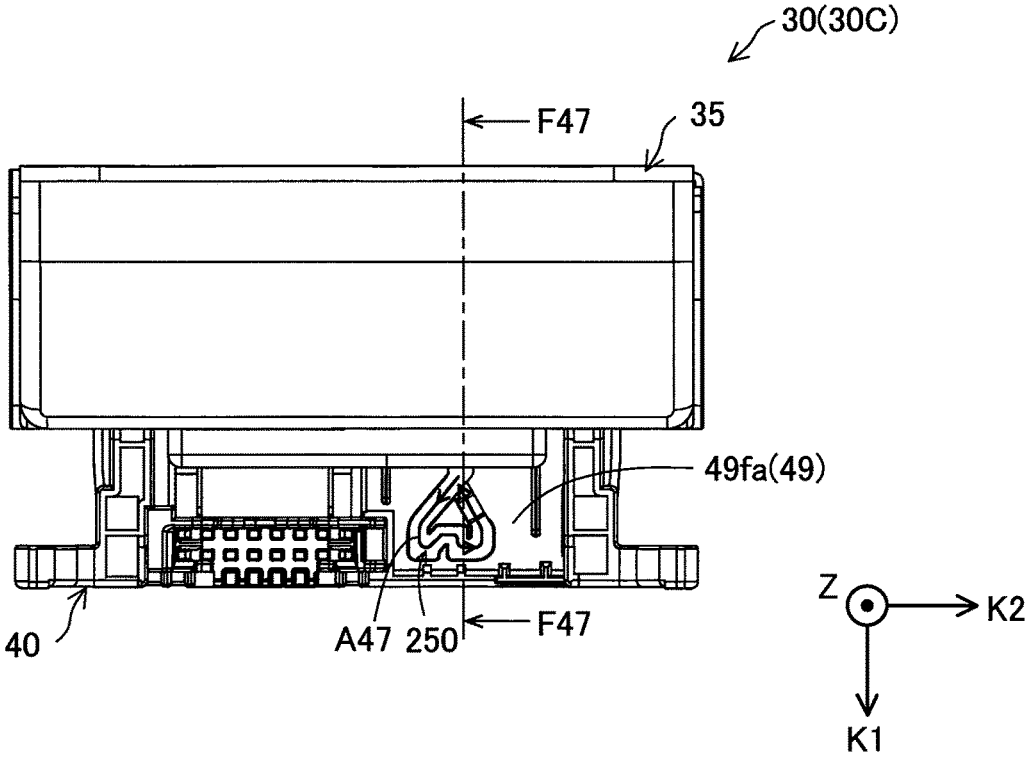
FIG. 47 is a top view illustrating the mounting assembly unit.
Figure 48:
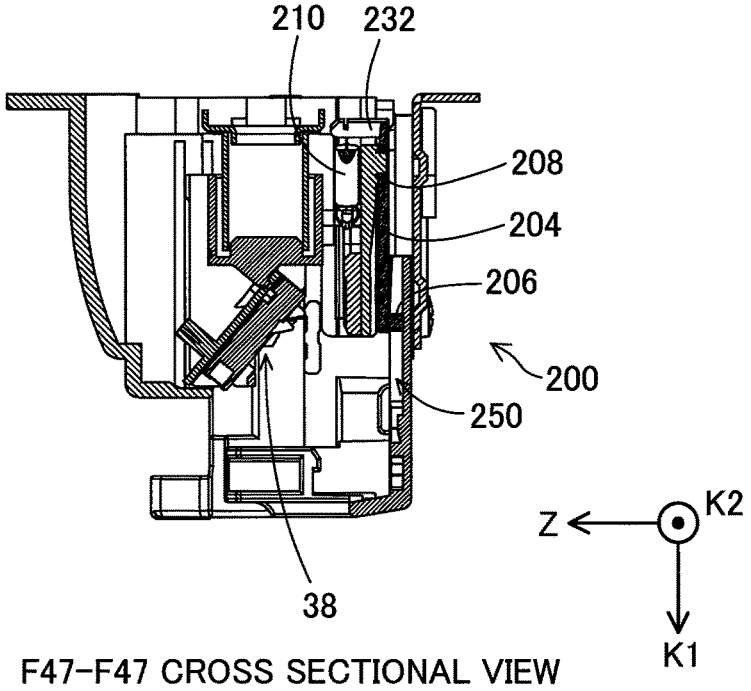
FIG. 48 is an F47-F47 cross sectional view of FIG. 47.

FIG. 47 is a top view illustrating the mounting assembly unit 30. FIG. 48 is an F47-F47 cross sectional view of FIG. 47. FIGS. 49 to 60 are diagrams illustrating a moving pathway of the projection 206. In order to facilitate understanding, even invisible part of the engagement member 201 actually hidden and invisible is shown by the solid line as appropriate.

As shown in FIG. 47, when the movable support structure 40 is changed from the first state (setting state) to the second state (mounting state) to be locked by the lock mechanism 200 and is subsequently changed from the second state to the first state by unlocking, the projection 206 (shown in FIG. 31) moves in the guide structure 250 in the direction of an arrow A47. A pathway along which the projection 206 moves in the direction of the arrow A47 is called "moving pathway".

Figure 49:
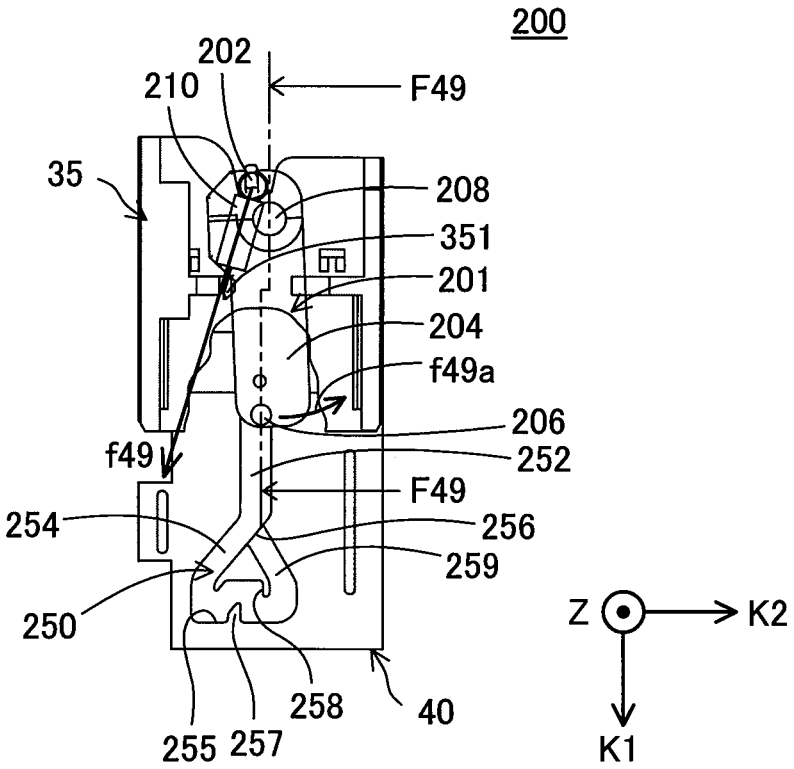
FIG. 49 is a diagram illustrating a moving pathway of a projection.
Figure 50:
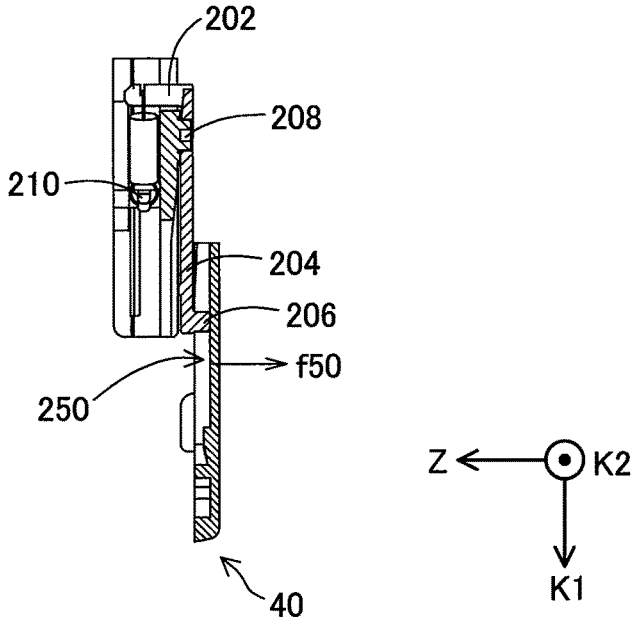
FIG. 50 is a diagram illustrating the moving pathway of the projection.

As shown in FIG. 49, the lock mechanism 200 includes the engagement member 201, the spring 210 and the guide structure 250. The engagement member 201 is mounted to the stationary member 35 by means of the spring 210. The spring 210 has one end portion mounted to the mounting element 202 of the engagement member 201 and the other end portion mounted to a stationary member-side mounting element 351 of the stationary member 35. The stationary member-side mounting element 351 is located on the +K1-axis direction side and on the −K2-axis direction side of the mounting element 202 and the groove 208. The engagement member 201 receives a biasing force f49 by the spring 210. The direction of the biasing force f49 includes a +K1-axis direction component and a −K2-axis direction component. The biasing force f49 including the +K1-axis direction component suppresses the projection 206 from being excessively moved in the −K1-axis direction. This configuration prevents the projection 206 from being slipped off from a −K1-axis direction side end portion (inlet end portion) of the guide structure 250. The biasing force f49 generates a rotating force f49*a* applied to the projection 206. The direction of the rotating force f49*a* includes a +K2-axis direction component about the groove 208 as the support point. As shown in FIG. 50, the biasing force f49 also generates a pressing force f50 applied to the projection 206. The direction of the pressing force f50 includes a component of a direction (−Z-axis direction component) in which the projection 206 is pushed against the bottom of the guide structure 250. The pressing force f50 reduces the likelihood that the projection 206 is detached from the guide structure 250.

As shown in FIG. 49, the guide structure 250 has an inlet part 252, an inlet connecting part 254, a projection wall 257, a support structure-side engagement element 258, an outlet connecting part 259 and a stepped part 256. The inlet part 252 is located on the most −K1-axis direction side of the guide structure 250. The inlet part 252 is extended in the K1-axis direction. The inlet connecting part 254 is connected with the inlet part 252. The inlet connecting part 254 is extended obliquely from the inlet part 252. More specifically, the inlet connecting part 254 is extended from the inlet part 252 in a direction including a +K1-axis direction component and a −K2-axis direction component. The projection wall 257 is located between the inlet connecting part 254 and the support structure-side engagement element 258 in the moving pathway. The projection wall 257 is a member protruded in the −K1-axis direction from a wall surface 255 located on the most +K1-axis direction side among the wall surfaces defining and forming the guide structure 250. The support structure-side engagement element 258 is located on the −K1-axis direction side of the wall surface 255. The support structure-side engagement element 258 is formed by a wall surface defining and forming the guide structure 250. In the mounting state of the fluid container 50, the support structure-side engagement element 258 is engaged with the projection 206 to restrict the motion of the projection 206. The outlet connecting part 259 is located between the support structure-side engagement element 258 and the inlet part 252 in the moving pathway. The stepped part 256 forms a different in level between the outlet connecting part 259 and the inlet connecting part 254. More specifically, the stepped part 256 forms a difference in level on the boundary between the outlet connecting part 259 and the inlet connecting part 254, such that the depth of the outlet connecting part 259 is made shallower than the depth of the inlet connecting part 254.

Figure 51:
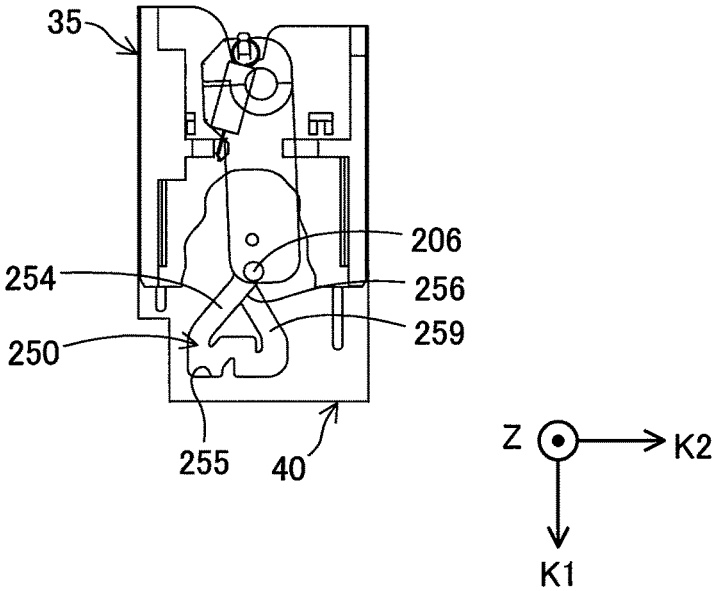
FIG. 51 is a diagram illustrating the moving pathway of the projection.
Figure 52:
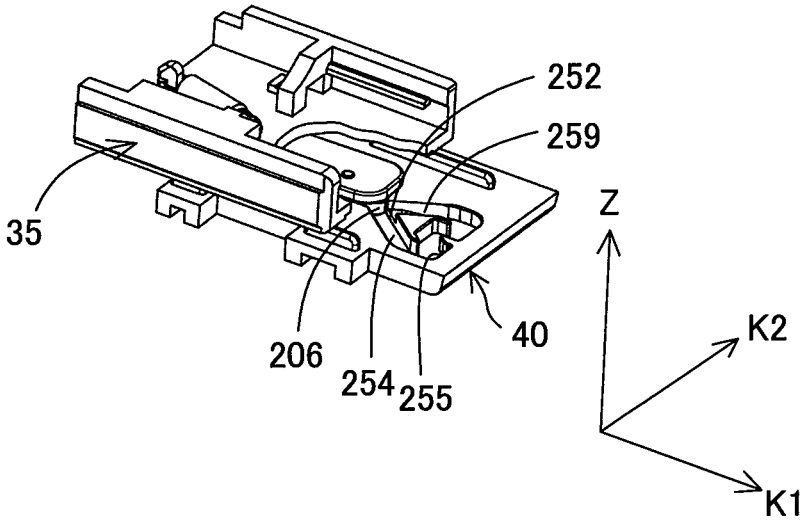
FIG. 52 is a diagram illustrating the moving pathway of the projection.

As shown in FIGS. 51 and 52, when the movable support structure 40 is pushed and moved relative to the stationary member 35 in the connecting direction (−K1-axis direction), the projection 206 reaches a part of the inlet connecting part 254 where the stepped part 256 is located. In this state, the projection 206 is not guided to the outlet connecting part 259 but is further guided to the inlet connecting part 254 by the stepped part 256.

Figure 53:
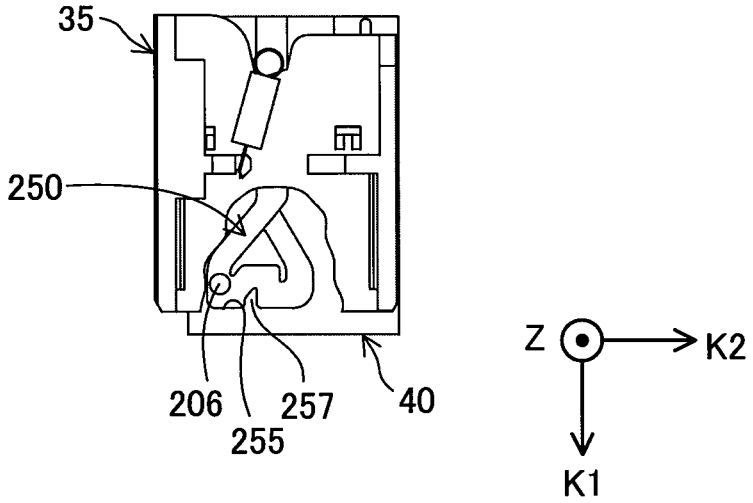
FIG. 53 is a diagram illustrating the moving pathway of the projection.

As shown in FIG. 53, when the movable support structure 40 is further pushed and moved relative to the stationary member 35 in the −K1-axis direction, part of the movable support structure 40 comes into contact with part of the stationary member 35, before the projection 206 abuts the wall surface 255. This configuration restricts any further motion of the movable support structure 40 in the −K1-axis direction relative to the stationary member 35. This accordingly reduces the likelihood that the projection 206 collides with the wall surface 255 to be damaged.

Figure 54:
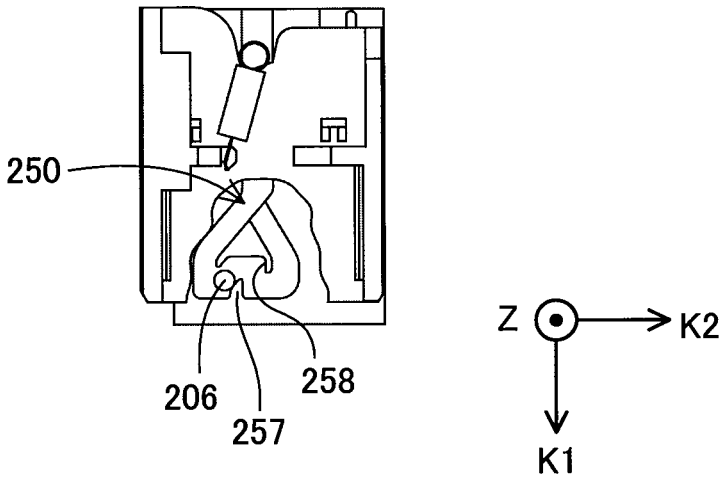
FIG. 54 is a diagram illustrating the moving pathway of the projection.

In the state of FIG. 53, the rotating force f49*a* (shown in FIG. 49) is applied to the projection 206, so that the projection 206 is guided along the pathway of the guide structure 250 toward the projection wall 257. As shown in FIG. 54, the projection 206 then abuts the projection wall 257. This configuration adjusts the moving direction (guide direction) of the projection 206 to the direction toward the support structure-side engagement element 258.

Figure 55:
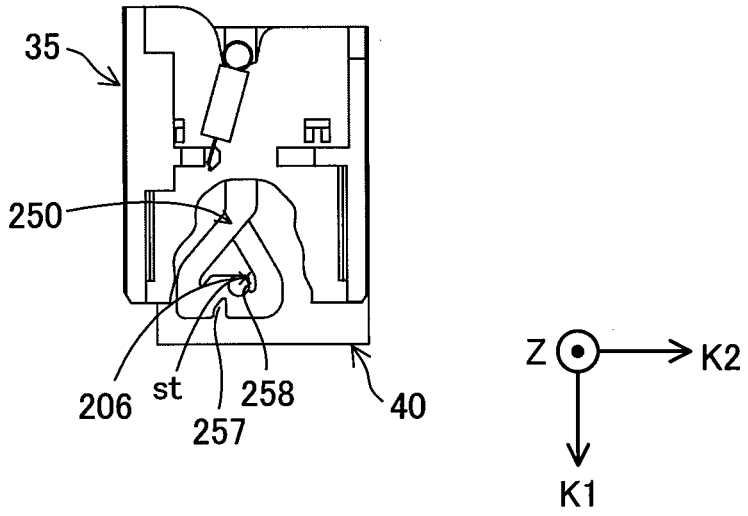
FIG. 55 is a diagram illustrating the moving pathway of the projection.

After the projection 206 abuts the projection wall 257, as shown in FIG. 55, the projection 206 comes into contact with and thereby engages with the support structure-side engagement element 258. The engagement of the support structure-side engagement element 258 with the projection 206 restricts the motion of the projection 206 in the +K2-axis direction caused by the rotating force f49*a*. The engagement of the support structure-side engagement element 258 with the projection 206 also restricts the motion of the movable support structure 40 in the +K1-axis direction by the biasing force of the coil spring 39 (shown in FIG. 30). The state shown in FIG. 55 is the locked state by the lock mechanism 200. The position where the projection 206 is engaged with the support structure-side engagement element 258 is called "engagement position st".

Figure 56:
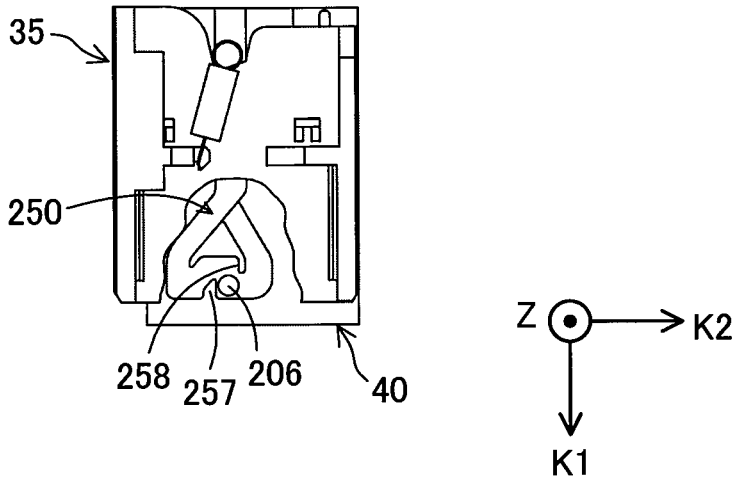
FIG. 56 is a diagram illustrating the moving pathway of the projection.
Figure 57:
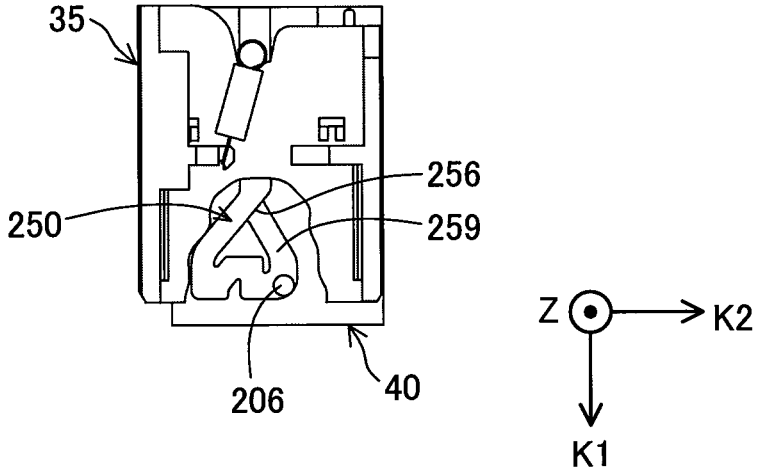
FIG. 57 is a diagram illustrating the moving pathway of the projection.

As shown in FIG. 56, the lock mechanism 200 is unlocked by moving the movable support structure 40 in the −K1-axis direction. For example, when the fluid container 50 is set in the movable support structure 40, the user pushes the pushing part 545 of the fluid container 50 (shown in FIG. 19) in the −K1-axis direction, so as to move the movable support structure 40 in the −K1-axis direction. This causes the projection 206 to be separated away from the support structure-side engagement element 258 and unlocks the lock mechanism 200 as shown in FIG. 56. As shown in FIG. 57, the projection 206 then moves toward the outlet connecting part 259 by the rotating force f49*a* (shown in FIG. 49).

After the projection 206 reaches the vicinity of the entry of the outlet connecting part 259 as shown in FIG. 57, the operation of moving the movable support structure 40 in the −K1-axis direction is stopped. For example, the user stops pushing the pushing part 545 in the −K1-axis direction. This causes the movable support structure 40 to be moved in the +K1-axis direction by the biasing force of the coil spring 39 (shown in FIG. 30). As the movable support structure 40 moves in the +K1-axis direction, the projection 206 moves in the outlet connecting part 259 toward the stepped part 256.

Figure 58:
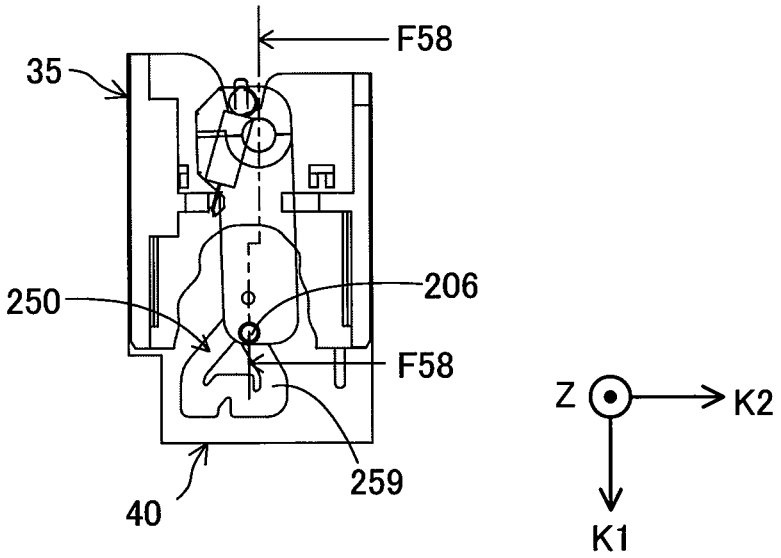
FIG. 58 is a diagram illustrating the moving pathway of the projection.
Figure 59:
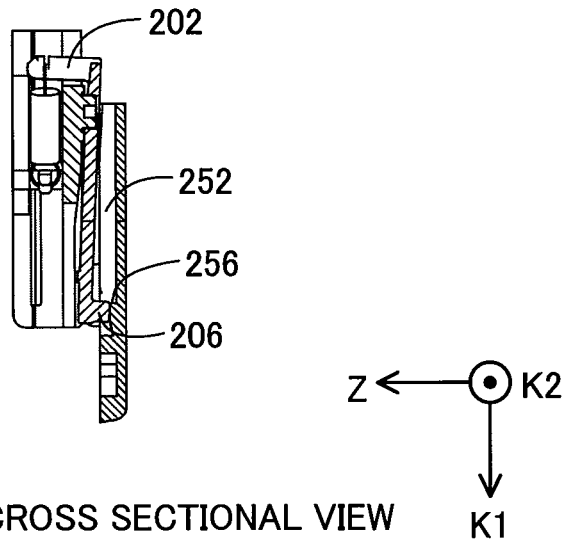
FIG. 59 is a diagram illustrating the moving pathway of the projection.
Figure 60:
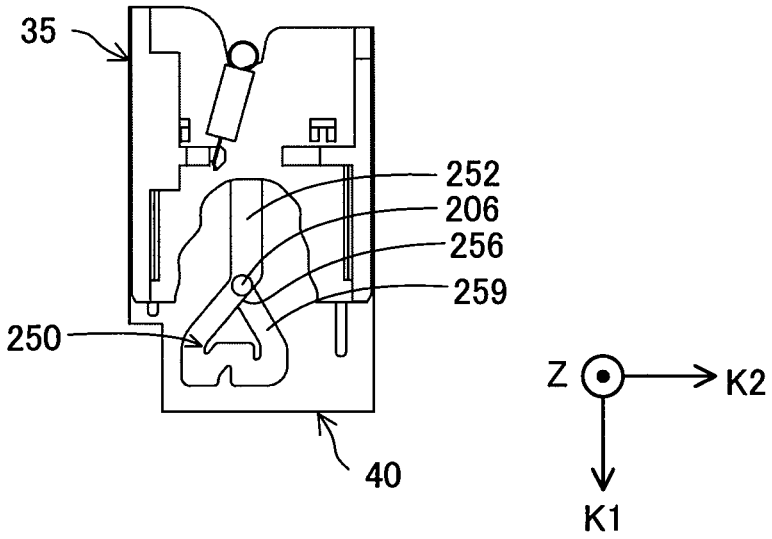
FIG. 60 is a diagram illustrating the moving pathway of the projection.

As shown in FIGS. 58 to 60, after the projection 206 reaches the stepped part 256, further motion of the movable support structure 40 in the +K1-axis direction by the biasing force of the coil spring 39 (shown in FIG. 30) causes the projection 206 to ride over the stepped part 256 and move toward the inlet part 252. After the projection 206 rides over the stepped part 256 and moves to the inlet part 252, the movable support structure 40 moves in the +K1-axis direction and causes the projection 206 to move in the inlet part 252.

As described above, when the fluid introducing structure 362 (shown in FIG. 9) is connected with the fluid supply assembly 57 (shown in FIG. 9) (in the process shown in FIGS. 51 to 55) or when the fluid introducing structure 362 is disconnected from the fluid supply assembly 57 (in the process shown in FIGS. 55 to 60), the projection 206 as the connection structure-side engagement element moves along the guide structure 250. When the fluid introducing structure 362 (shown in FIG. 9) is connected with the fluid supply assembly 57 (shown in FIG. 9) (in the process shown in FIGS. 51 to 55) or when the fluid introducing structure 362 is disconnected from the fluid supply assembly 57 (in the process shown in FIGS. 55 to 60), the fluid supply assembly 57 is supported by the movable support structure 40 (shown in FIG. 9).

A-5. Relationship Between Mounting Assembly Unit 30 and Fluid Container 50

A-5-1. Timings of Connection and Demounting

Figure 61:
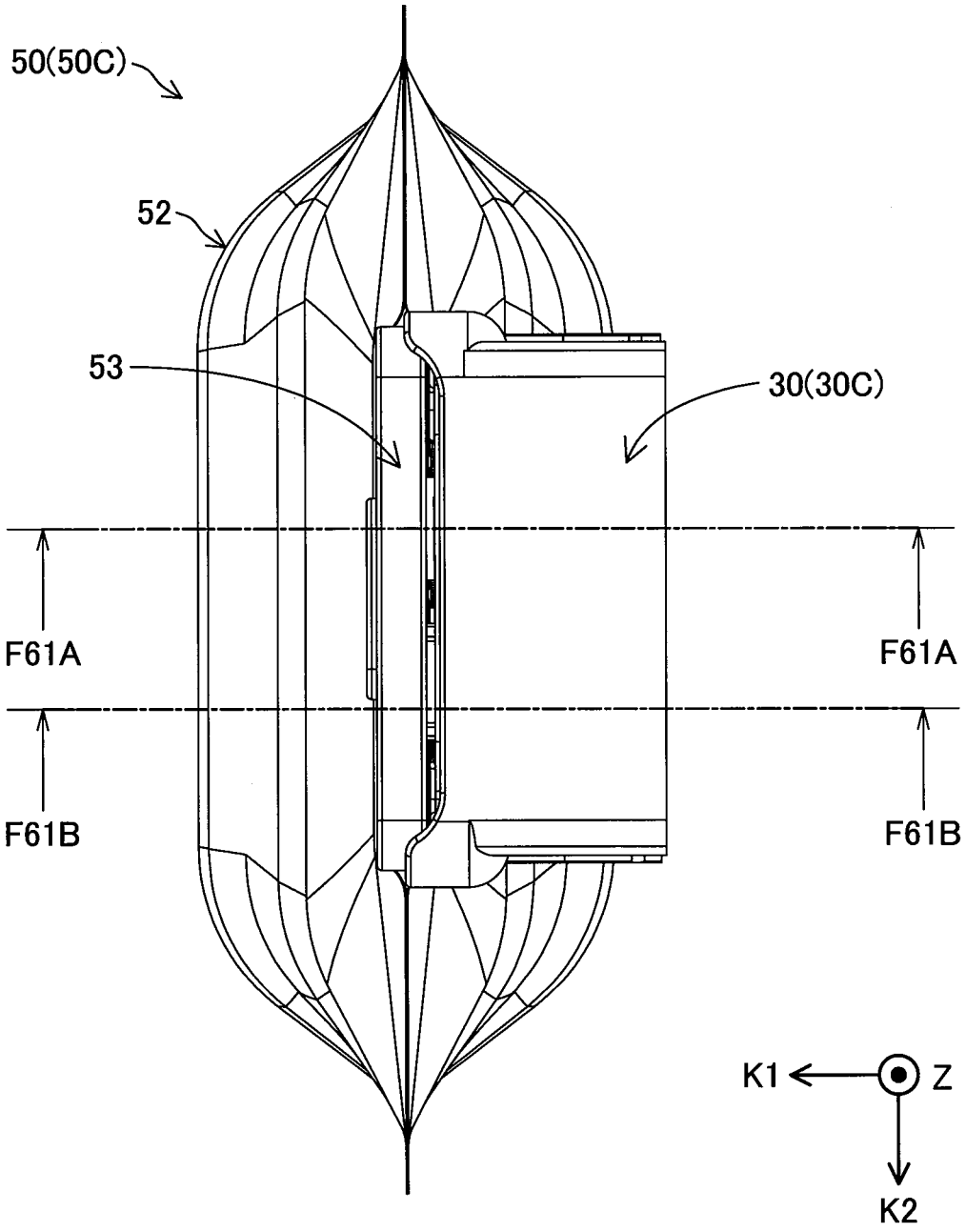
FIG. 61 is a first diagram illustrating a connection timing.
Figure 62:
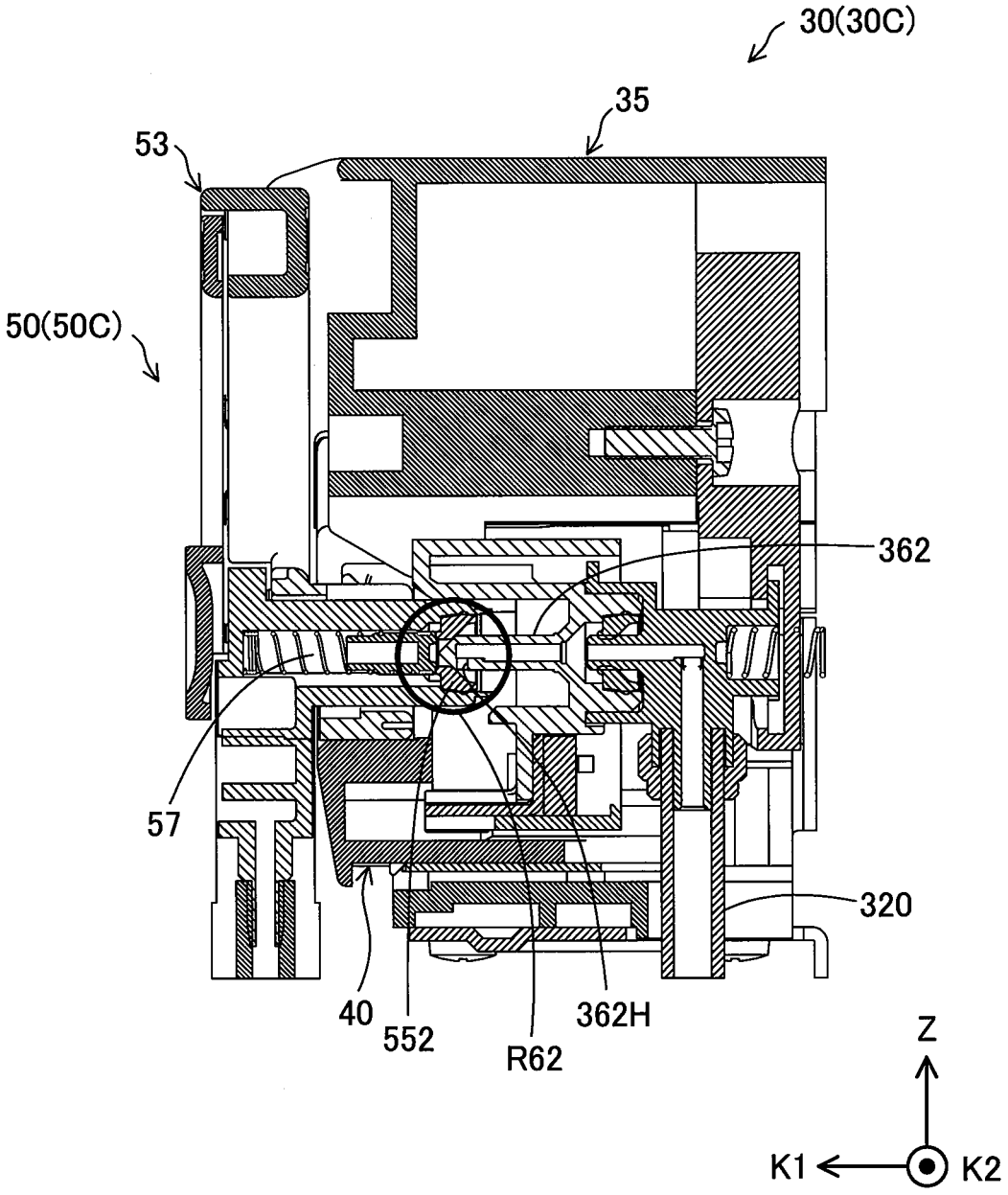
FIG. 62 is an F61A-F61A partial cross sectional view of FIG. 61.
Figure 63:
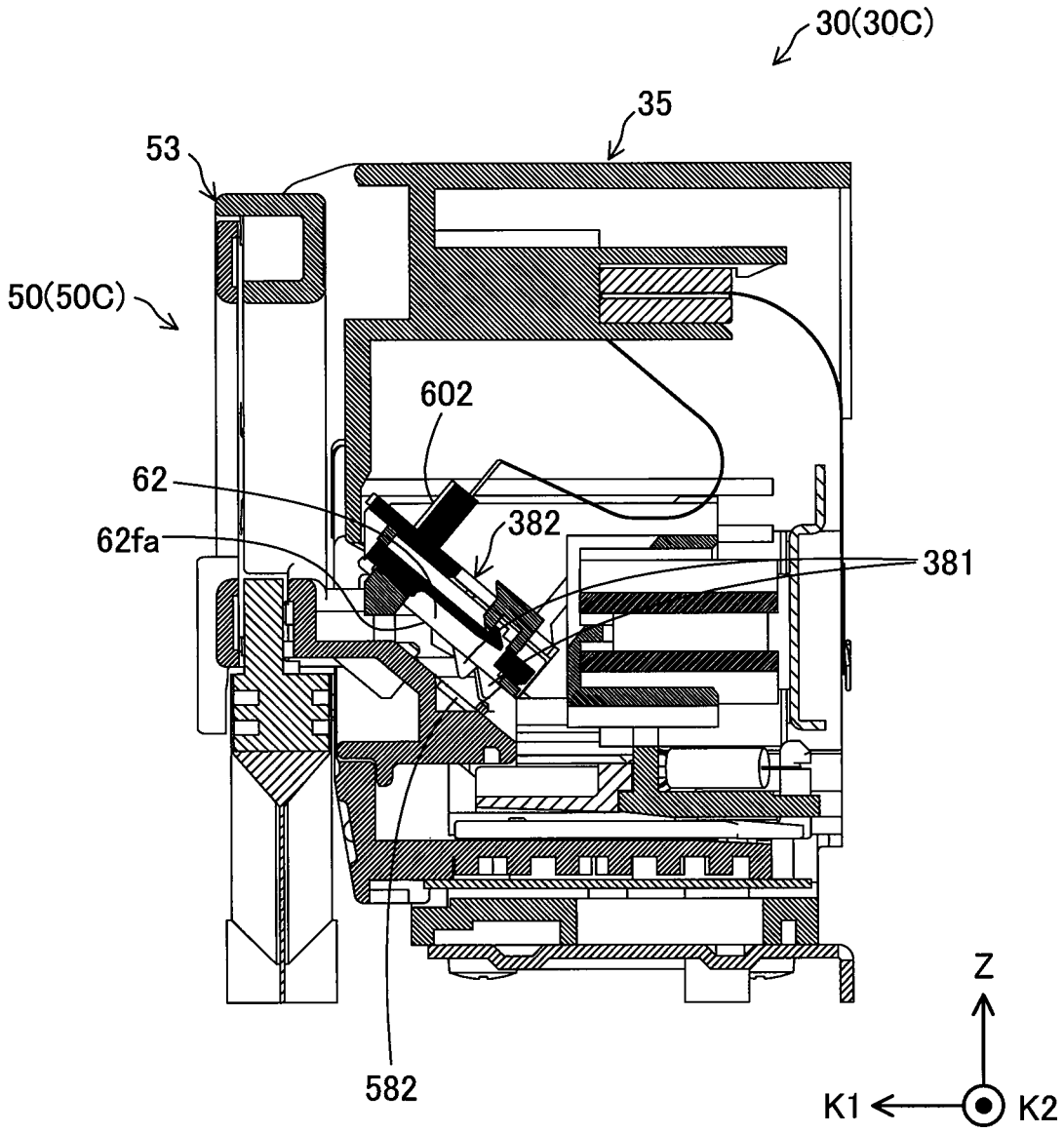
FIG. 63 is an F61B-F61B partial cross sectional view of FIG. 61.
Figure 64:
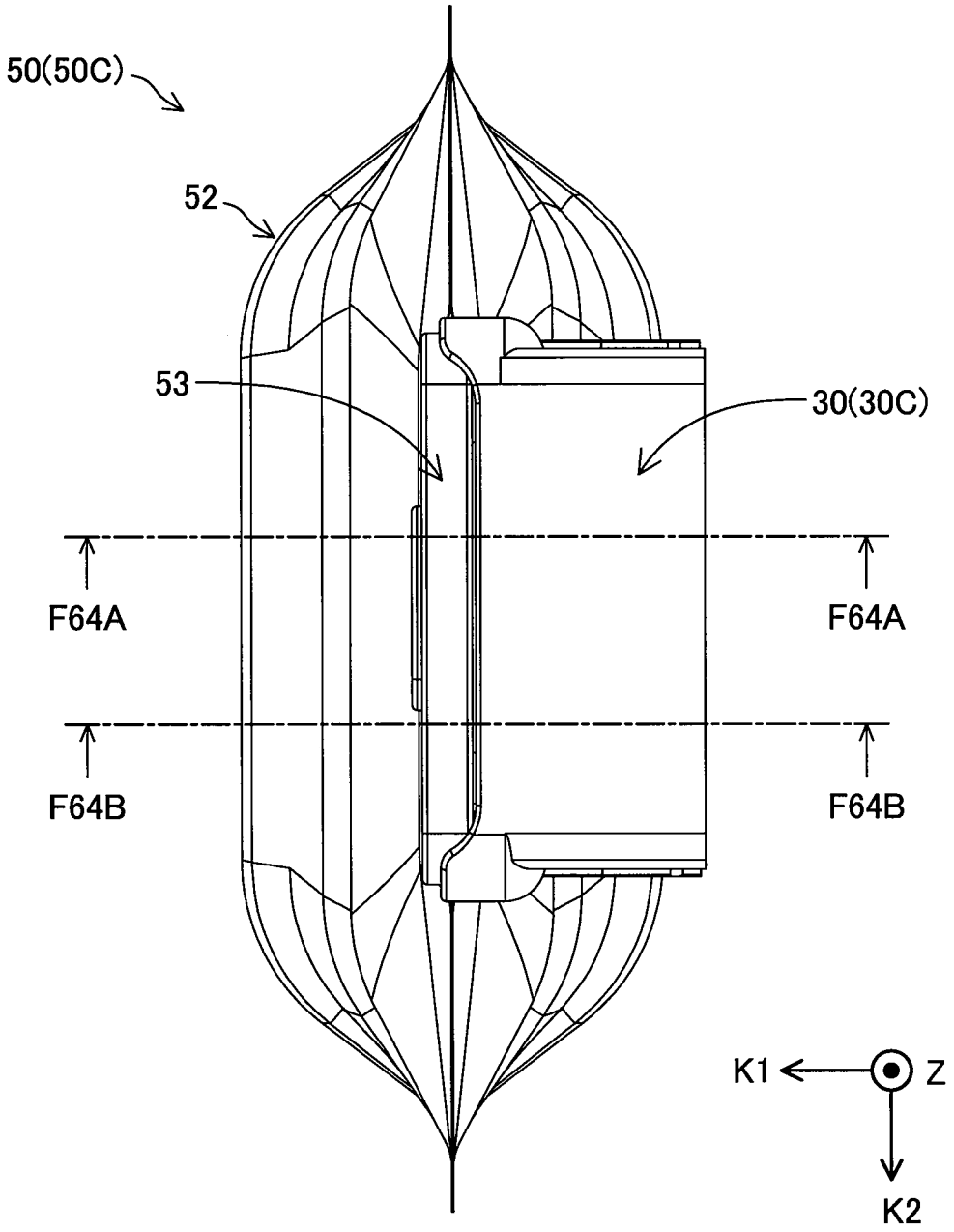
FIG. 64 is a second diagram illustrating the connection timing.
Figure 65:
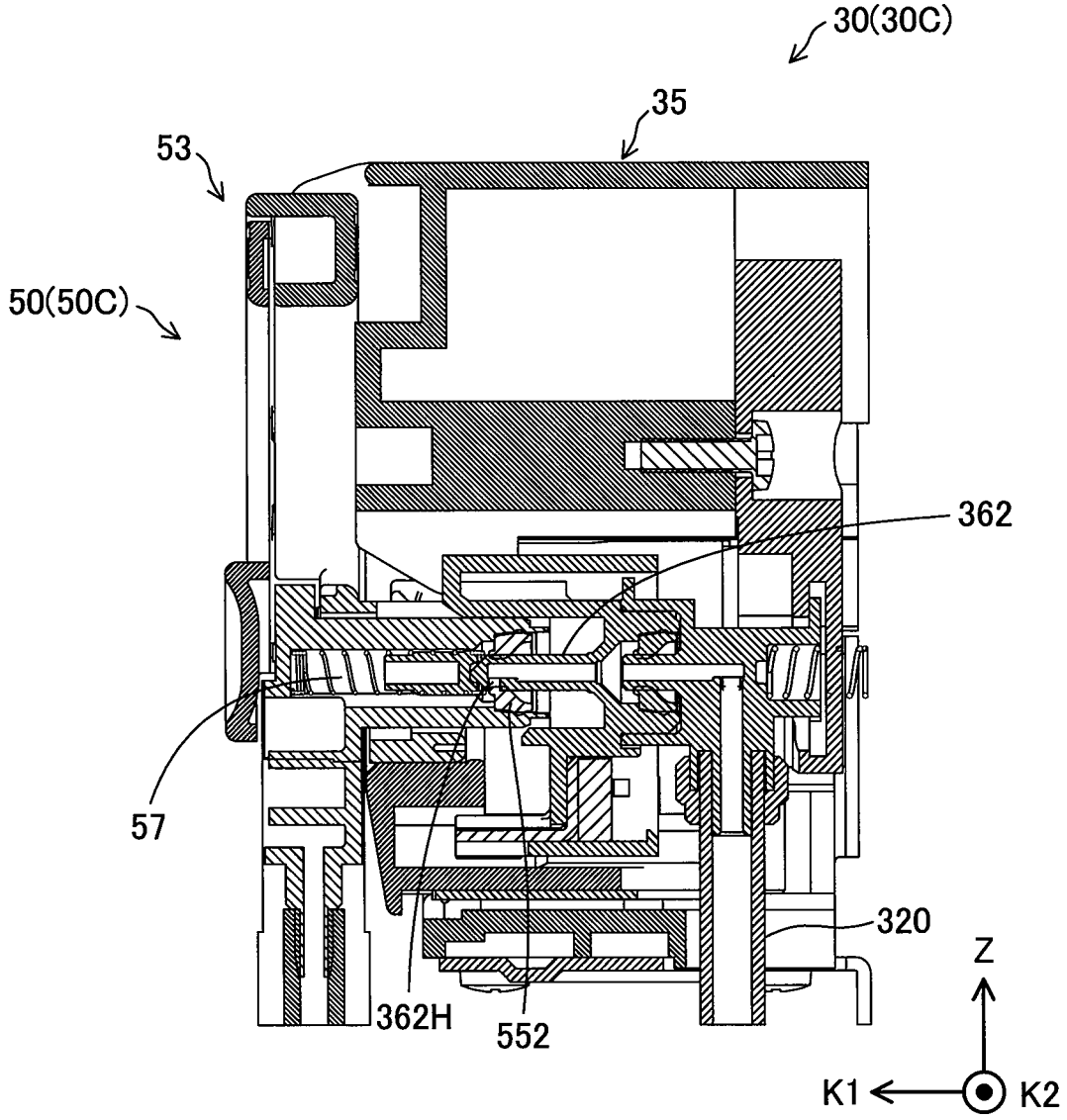
FIG. 65 is an F64A-F64A partial cross sectional view of FIG. 64.
Figure 66:
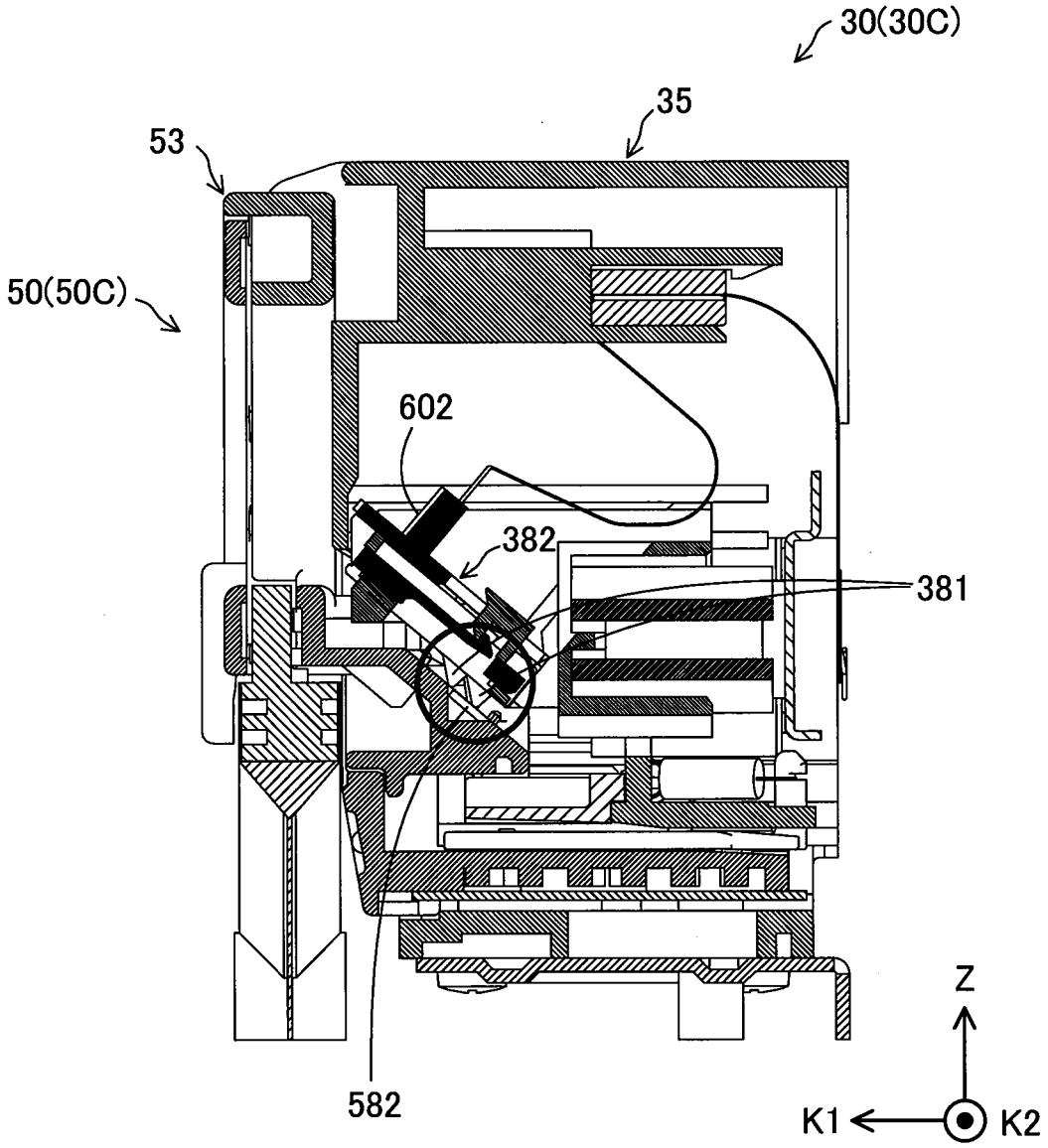
FIG. 66 is an F64B-F64B partial cross sectional view of FIG. 64.

FIG. 61 is a first diagram illustrating a connection timing. FIG. 62 is an F61A-F61A partial cross sectional view of FIG. 61. FIG. 63 is an F61B-F61B partial cross sectional view of FIG. 61. FIG. 64 is a second diagram illustrating the connection timing. FIG. 65 is an F64A-F64A partial cross sectional view of FIG. 64. FIG. 66 is an F64B-F64B partial cross sectional view of FIG. 64. FIG. 61 is a first diagram prior to completion of mounting of the fluid container 50. FIG. 64 is a second diagram prior to completion of mounting of the fluid container 50.

As shown in FIGS. 62 and 63, pushing and moving the fluid container 50 in the connecting direction (−K1-axis direction, first direction) starts connection of the fluid supply assembly 57 with the fluid introducing structure 362, before starting the contact (connection) of the circuit board 582 (more specifically, the fluid container-side terminals 581) with the device-side terminals 381. In order to facilitate understanding, an area in which the connection of the fluid supply assembly 57 with the fluid introducing structure 362 starts is expressed by an symbol "R62" in FIG. 62.

As shown in FIGS. 65 and 66, further pushing and moving the fluid container 50 in the connecting direction starts the contact of the terminals 581 of the circuit board 582 with the device-side terminals 381.

As clearly understood from the foregoing, the fluid supply assembly 57 and the circuit board holding member 59 are arranged such that the fluid container 50 is disconnected from the mounting assembly unit 30 of the printer 10 (i.e., the fluid container 50 is demounted from the printer 10) at the following timing (demounting timing).

<Demounting Timing>

Before the fluid supply assembly 57 is separated away from the fluid introducing structure 362 of the printer 10, the contacts cp of the circuit board 582 are separated from the device-side terminals 381 of the printer 10.

The state that "the fluid supply assembly 57 is separated away from the fluid introducing structure 362 of the printer 10" herein means the state that the fluid supply assembly 57 moves in the demounting direction (+K1-axis direction), so as to make a communication hole 362H come out of contact with the valve seat 552 of the fluid supply assembly 57. More specifically, the state of the communication hole 362H is changed from the closed state by the valve seat 552 of the fluid supply assembly 57 to the opened state by moving the fluid supply assembly 57 in the demounting direction (+K1-axis direction). According to this embodiment, when the fluid supply assembly 57 is moved in the +K1-axis direction from the state shown in FIG. 65, the fluid supply assembly 57 is detached from the fluid introducing structure 362 of the printer 10. The communication hole 362H is an aperture formed to make the internal flow path of the fluid introducing structure 362 communicate with the outside. In this embodiment, the communication hole 362H is formed in a peripheral wall of the fluid introducing structure 362.

A-5-2. Wiping Effect

Figure 67:
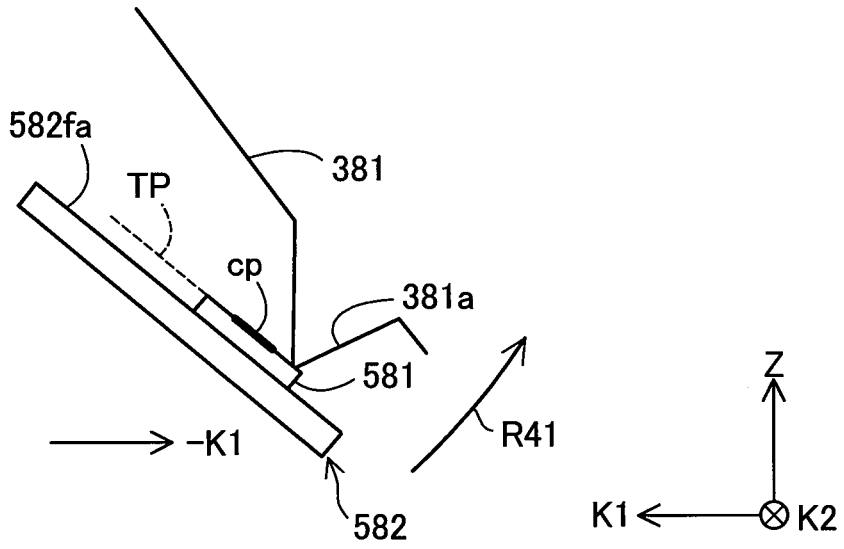
FIG. 67 is a first diagram illustrating the wiping effect.
Figure 68:
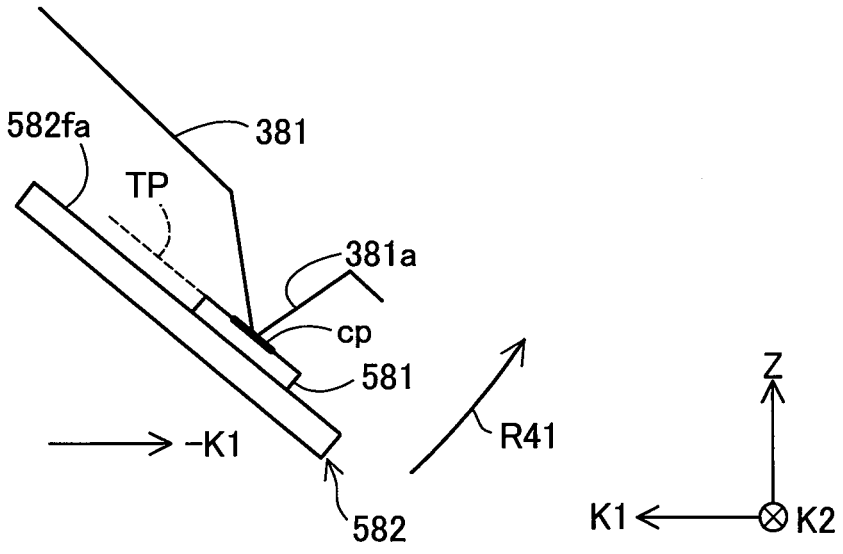
FIG. 68 is a second diagram illustrating the wiping effect.

FIG. 67 is a first diagram illustrating the wiping effect. FIG. 68 is a second diagram illustrating the wiping effect. FIG. 67 is a diagram illustrating the state that one end portion 381*a* of the device-side terminal 381 starts coming into contact with the fluid container-side terminal 581 of the circuit board 582. FIG. 68 is a diagram illustrating the state that mounting of the fluid container 50 is completed and one end portion 381*a* is in contact with the contact cp of the fluid container-side terminal 581.

As shown in FIG. 67, moving the circuit board 582 in the connecting direction (−K1-axis direction) causes one end portion 381*a* of the device-side terminal 381 to start coming into contact with the fluid container-side terminal 581 of the circuit board 582. Moving the circuit board 582 further in the connecting direction causes the device-side terminal 381 to be pushed and elastically deformed by the circuit board 582. The elastic deformation moves one end portion 381*a* in the direction of the arrow R41. This motion causes one end portion 381*a* to reach the contact cp, while making one end portion 381*a* and the fluid container-side terminal 581 slightly rub against each other.

As described above, the device-side terminal 381 and the fluid container-side terminal 581 slightly rub against each other, immediately before completion of mounting of the fluid container 50. This reduces the likelihood that the device-side terminal 381 rubs against another part of the fluid container 50 to produce some shaving in the course of mounting of the fluid container 50. More specifically, compared with a configuration that the virtual plane TP is parallel to the connecting direction (−K1-axis direction), the inclined configuration of this embodiment reduces the likelihood that the circuit board 582 is scraped off by the device-side terminal 381 and accordingly reduces the likelihood that shaving adheres to the contact cp. Even in the case that some dust is present in the vicinity of the device-side terminal 381 and is placed between the device-side terminal 381 and the fluid container-side terminal 581, this configuration causes the device-side terminal 381 to come into contact with the fluid container-side terminal 581 with linearly rubbing against the surface of the fluid container-side terminal 581. This achieves the effect of removing the dust from the contact cp (wiping effect) and reduces the likelihood that the dust is placed between the device-side terminal 381 and the fluid container-side terminal 581. More specifically, compared with a configuration that the virtual plane TP is perpendicular to the connecting direction (−K1-axis direction), the inclined configuration of the virtual plane TP increases the moving distance of the device-side terminal 381 from the position of contact of the device-side terminal 381 with the circuit board 582 to the position of contact of the device-side terminal 381 with the contact cp. The device-side terminal 381 reaches the contact cp with rubbing against the surface 582*fa* of the circuit board 582 and thereby removes the dust adhering to the device-side terminal 381 or the circuit board 582 from the contact cp. This ensures good electrical continuity between the contacts cp and the device-side terminals 381.

A-5-3. Force Applied to Fluid Container 50 in Mounting State

Figure 69:
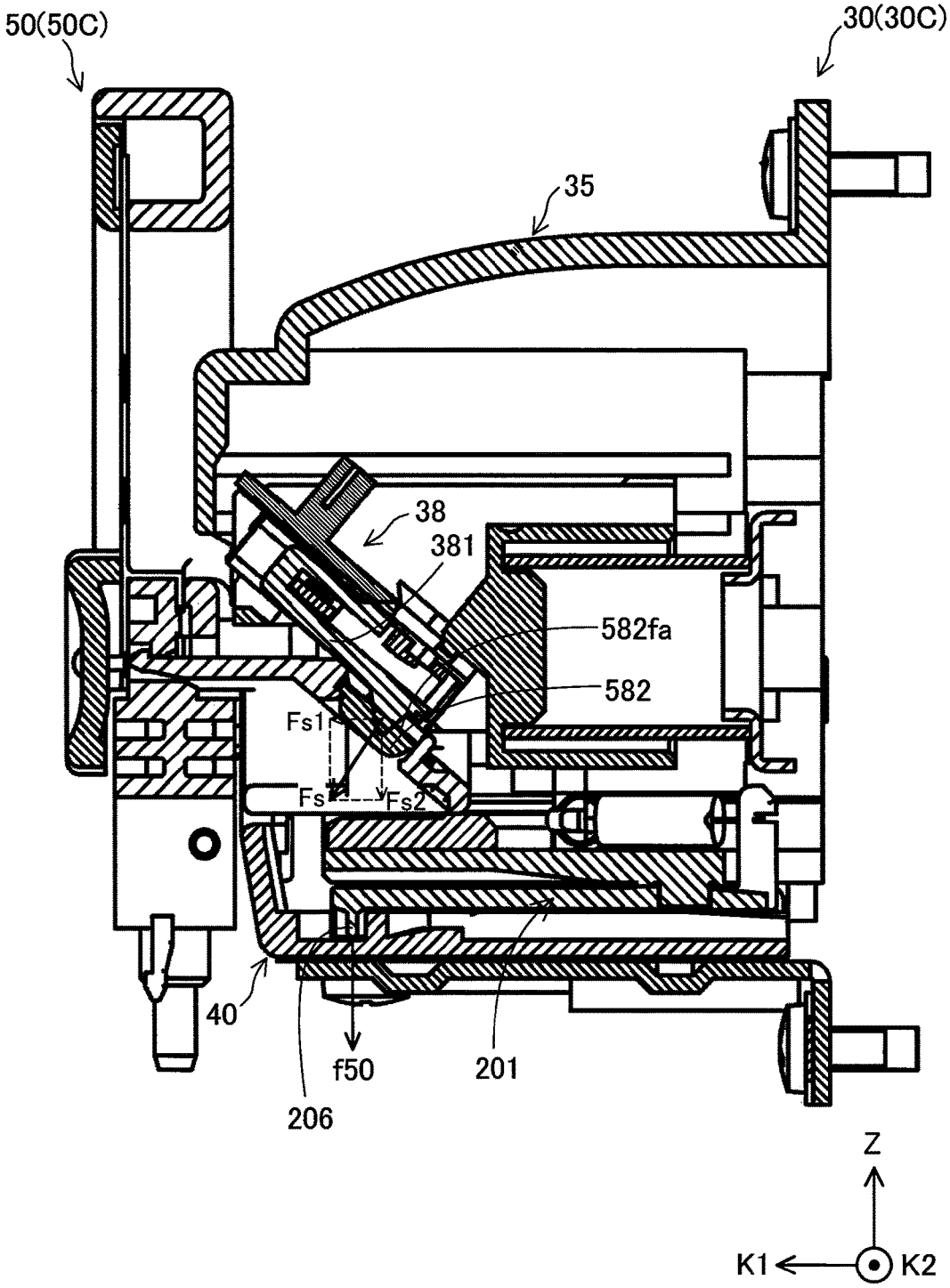
FIG. 69 is a cross sectional diagram illustrating part of the mounting assembly unit and the fluid container in the mounting state.

FIG. 69 is a cross sectional diagram illustrating part of the mounting assembly unit 30 and the fluid container 50 in the mounting state. This cross section includes a contact area where the device-side terminals 381 are in contact with the fluid container-side terminals 581 (more specifically, the contacts cp) in the mounting state of the fluid container 50.

When the contacts cp of the circuit board 581 come into contact with the device-side terminals 381 of the electrical connection structure 382, the projection 206 as the connection structure-side engagement element is engaged with the support structure-side engagement element 258 (shown in FIG. 55). As shown in FIG. 69, in the mounting state, the fluid container 50 receives an external force Fs from the contact mechanism 38. The external force Fs is a force applied to the circuit board 582 by the device-side terminals 381 of the contact mechanism 38. The external force Fs is a force applied substantially perpendicularly to the surface 582*fa* of the circuit board 582. The external force Fs includes a force component Fs1 in the +K1-axis direction and a force component Fs2 in the −Z-axis direction. More specifically, the external force Fs applied from the device-side terminals 381 to the fluid container-side terminals 581 includes a component in the +K1-axis direction which is the demounting direction. This external force Fs including the +K1-axis direction component is generated by the inclined configuration of the surface 582*fa* (virtual plane TP) in a direction including a −K1-axis direction component. According to this embodiment, the surface 582*fa* (virtual plane TP) is inclined in a direction including a −K1-axis direction component and a −Z-axis direction component. The inclination of the virtual plane TP with respect to the first direction (−K1-axis direction) facilitates generation of the force component Fs1 having a vector component in the second direction, compared with a configuration that the contacts cp are arranged to make the virtual plane TP parallel to the first direction and are brought into contact with the electrical connection structure 382 by a force in a direction perpendicular to the first direction (i.e., in the −Z-axis direction). Accordingly, this enables the fluid container 50 to be readily moved in the demounting direction in the course of unlocking the lock mechanism 200 and demounting the fluid container 50 and makes the contacts cp more easily separated from the electrical connection structure 382. This results in readily demounting the fluid container 50 from the mounting assembly unit 30.

A-5-4. Engagement Position st and Positional Relationship Between Circuit Board 582 and Fluid Introducing Structure 362

Figure 70:
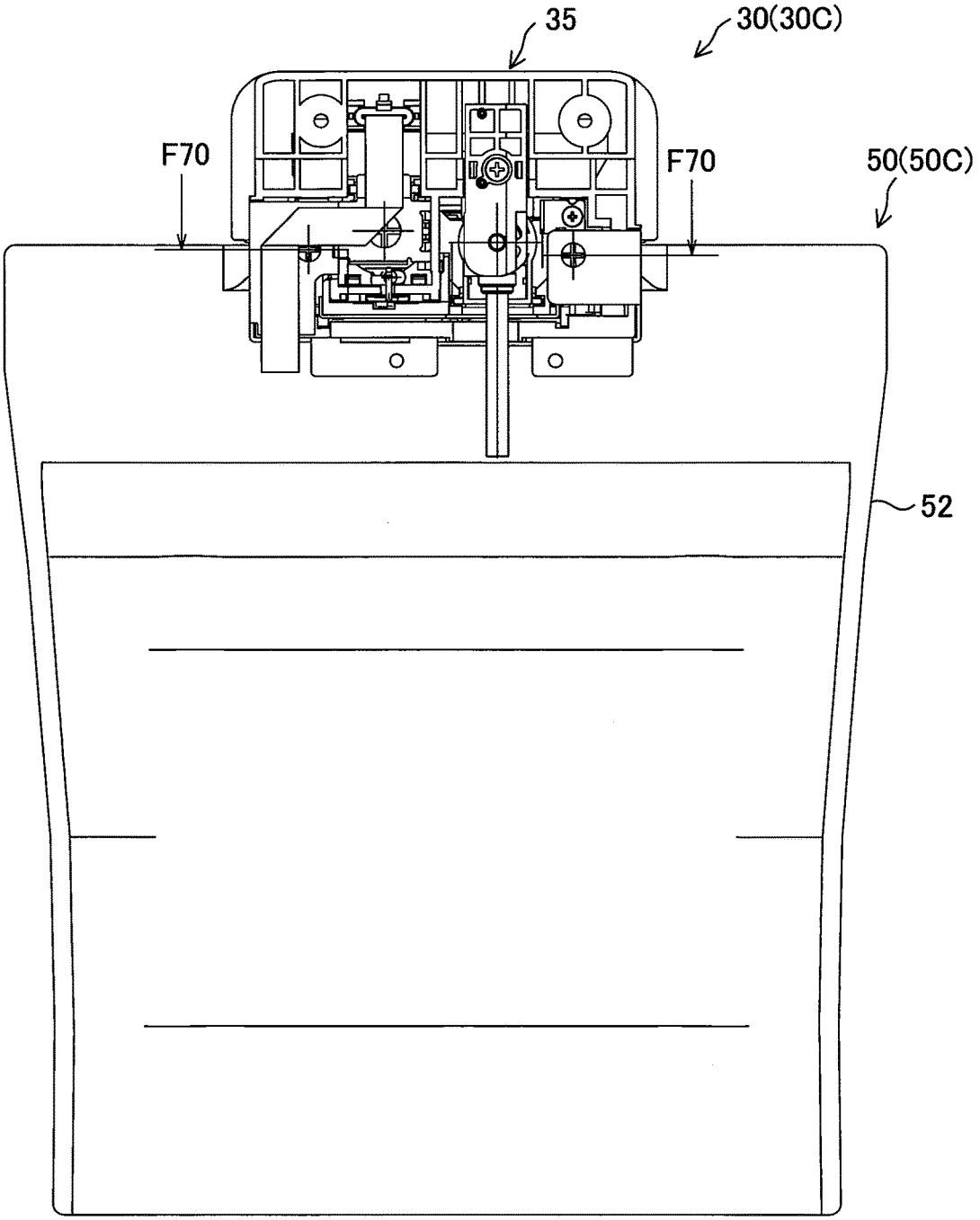
FIG. 70 is a rear view illustrating the mounting assembly unit in the mounting state.
Figure 71:
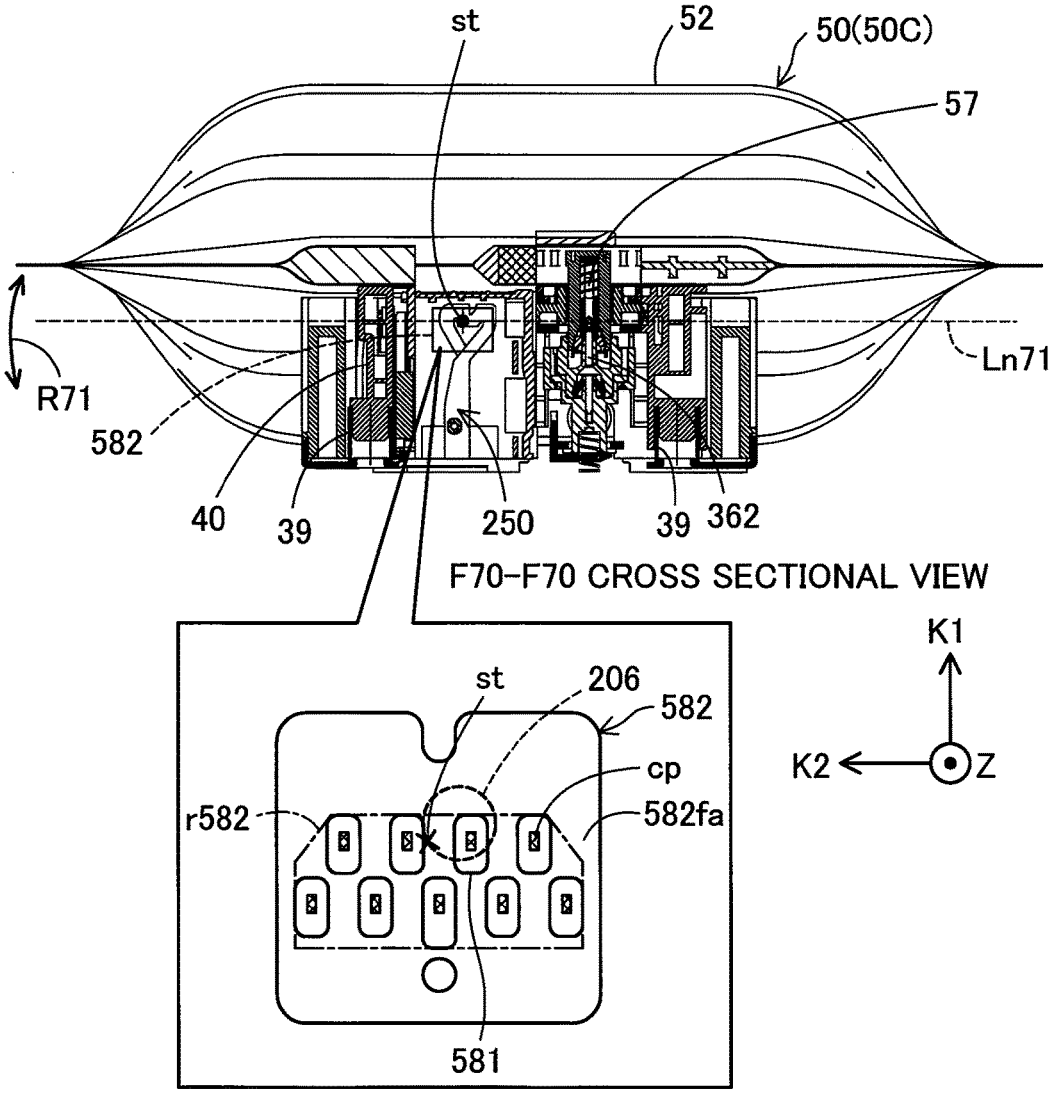
FIG. 71 is an F70-F70 cross sectional view of FIG. 70.

FIG. 70 is a rear view illustrating the mounting assembly unit 30 in the mounting state. FIG. 71 is an F70-F70 cross sectional view of FIG. 70.

As shown in FIG. 71, an area where the contacts cp are formed is located in a third direction (Z-axis direction) which passes through the engagement position st and is orthogonal to the second direction (+K1-axis direction). The area where the contacts cp are formed corresponds to the surface 582*fa* of the circuit board 582 in this embodiment. More specifically, as shown in the lower diagram of FIG. 71, when the fluid container 50 in the mounting state is viewed downward in the direction of gravity, the engagement position st at least partly overlaps with the circuit board 582. In the mounting state, the movable support structure 40 configured to support the fluid container 50 is biased in the +K1-axis direction by the coil spring 39. Locating the projection 206 at the engagement position st restricts the motion of the movable support structure 40 by the biasing force of the coil spring 39. The biasing force of the coil spring 39 accordingly produces a force of rotating the movable support structure 40 in the direction of an arrow R71 about the engagement position st (more specifically, the wall of the guide structure 250 coming into contact with the projection 206). The direction of the arrow R71 is a direction including a K1-axis direction component and a K2-axis direction component. When the fluid container 50 is viewed downward in the direction of gravity (i.e., viewed from the +Z-axis direction), however, the engagement position st overlaps with the area where the contacts cp are formed (i.e., the surface 582*fa* of the circuit board 582). According to this embodiment, the engagement position st overlaps with the contacts cp. This positional relationship suppresses a deviation of the contacts cp from their designed position even when the movable support structure 40 is rotated in the direction of the arrow R71 about the engagement position st. This accordingly ensures the good electrical continuity between the contacts cp and the electrical connection structure 382 in the mounting state. A preferable positional relationship is that the engagement position st at least partly overlaps with an area r582 defined by a minimum convex polygon encompassing a plurality of the fluid container-side terminals 581. This positional relationship further suppresses a deviation of the contacts cp from their designed position.

As shown in FIG. 71, when the fluid container 50 in the mounting state is viewed downward in the direction of gravity, the engagement position st and an end portion of the fluid introducing structure 362 inserted into the fluid supply assembly 57 are located on a straight line Ln71 along the K2-axis direction.

A-5-5. Support During Connection

Figure 72:
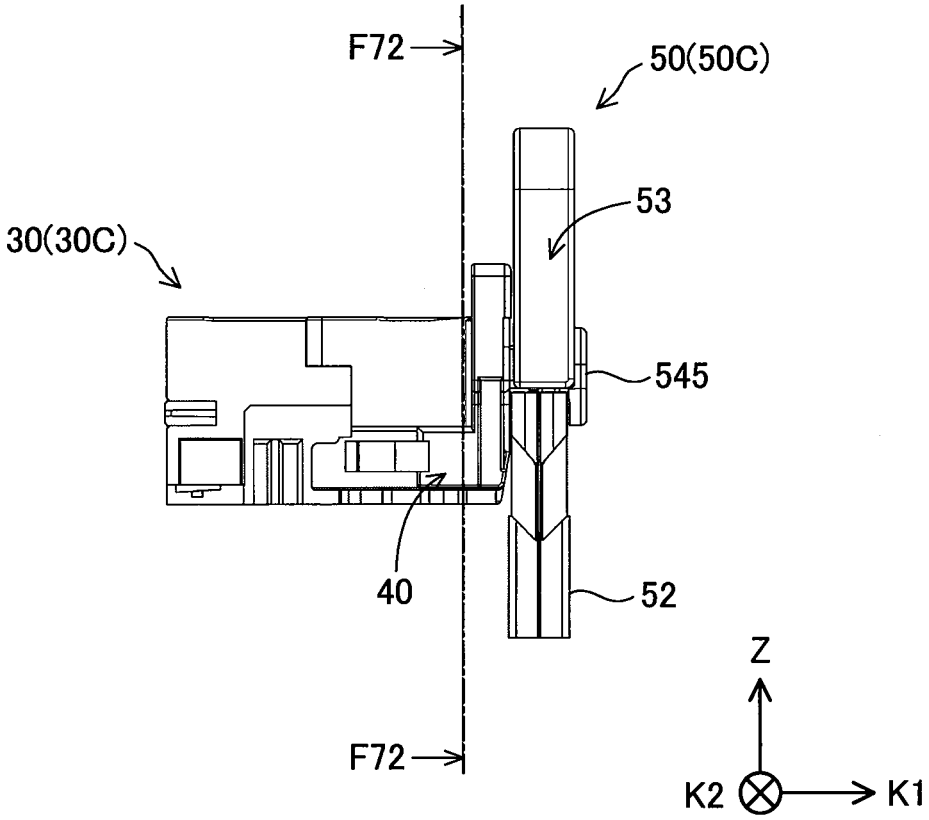
FIG. 72 is a side view illustrating the state that the fluid container is set in the movable support structure.
Figure 73:
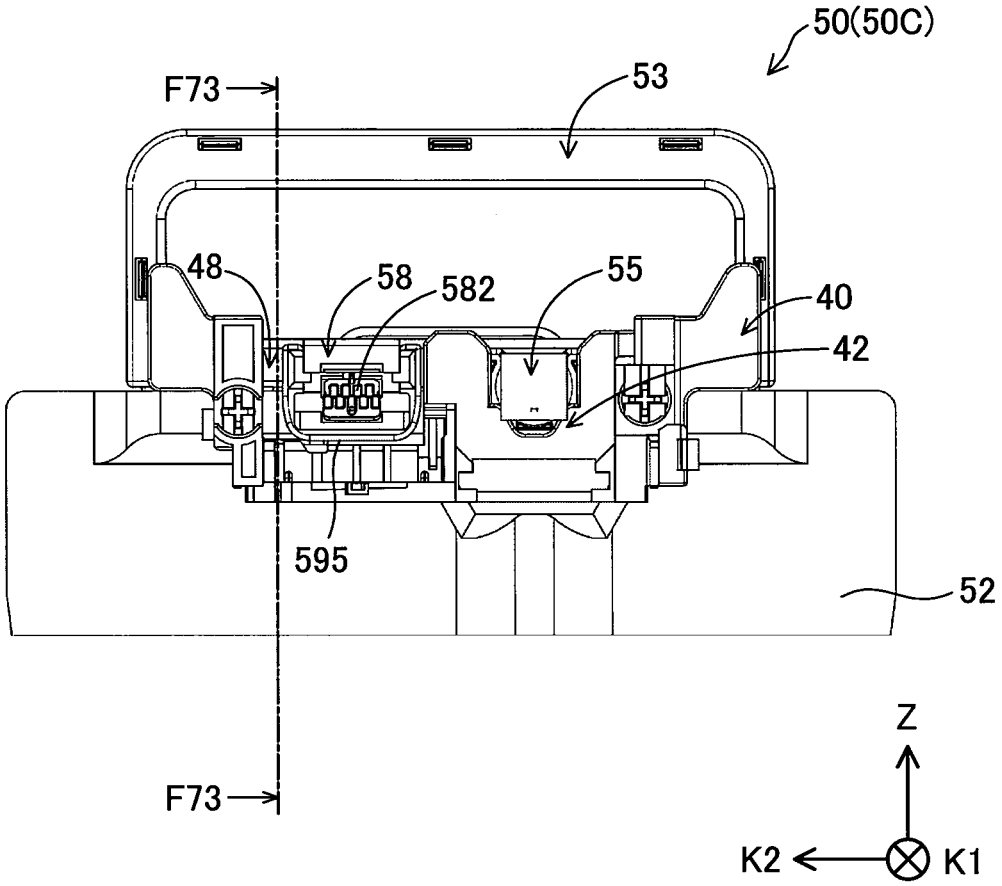
FIG. 73 is a front view illustrating the state that the fluid container is set in the movable support structure.
Figure 74:
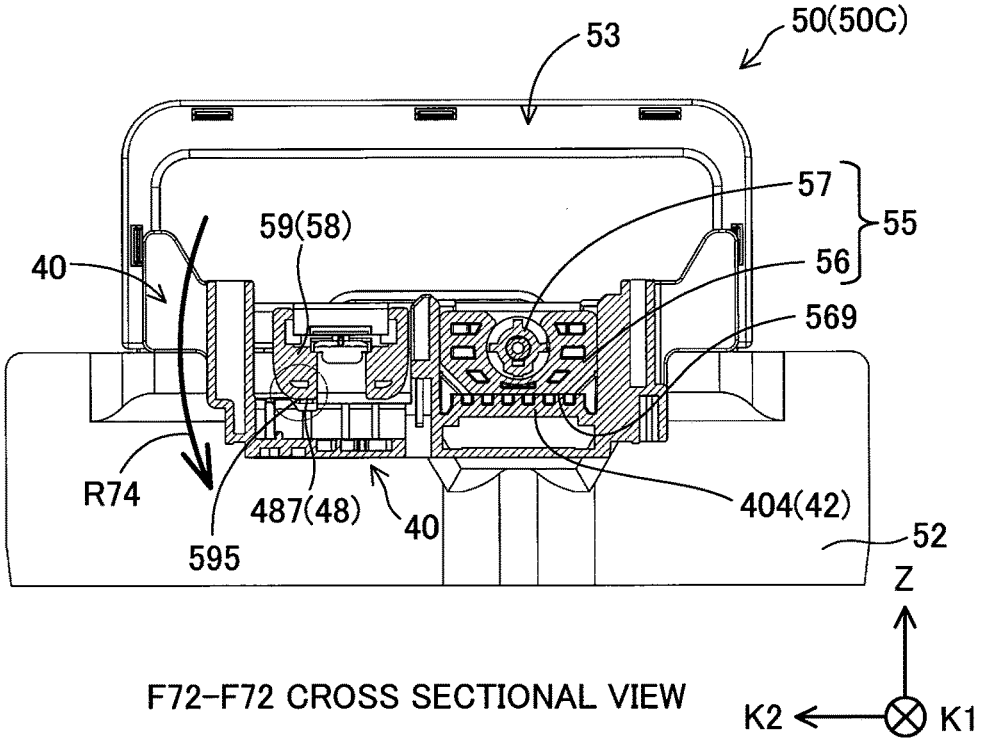
FIG. 74 is an F72-F72 cross sectional view of FIG. 72.
Figure 75:
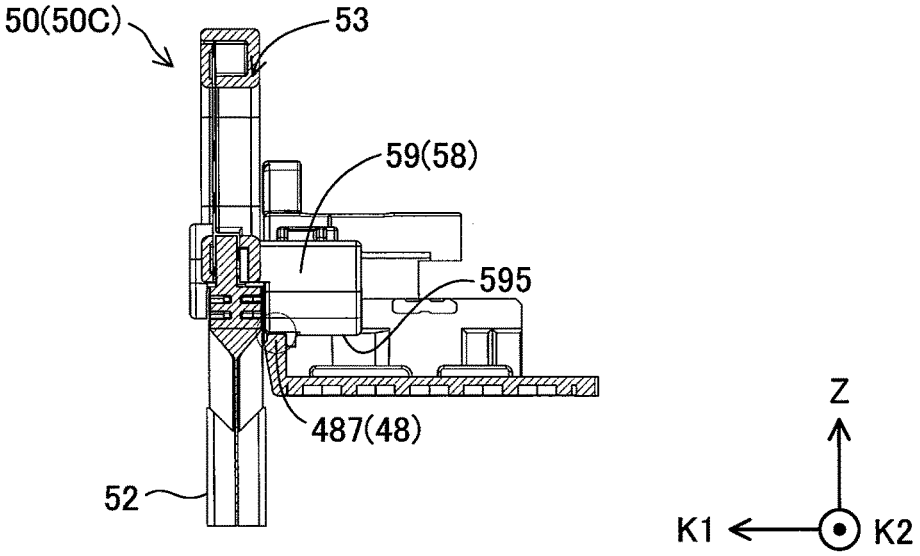
FIG. 75 is an F73-F73 cross sectional view of FIG. 73.
Figure 76:
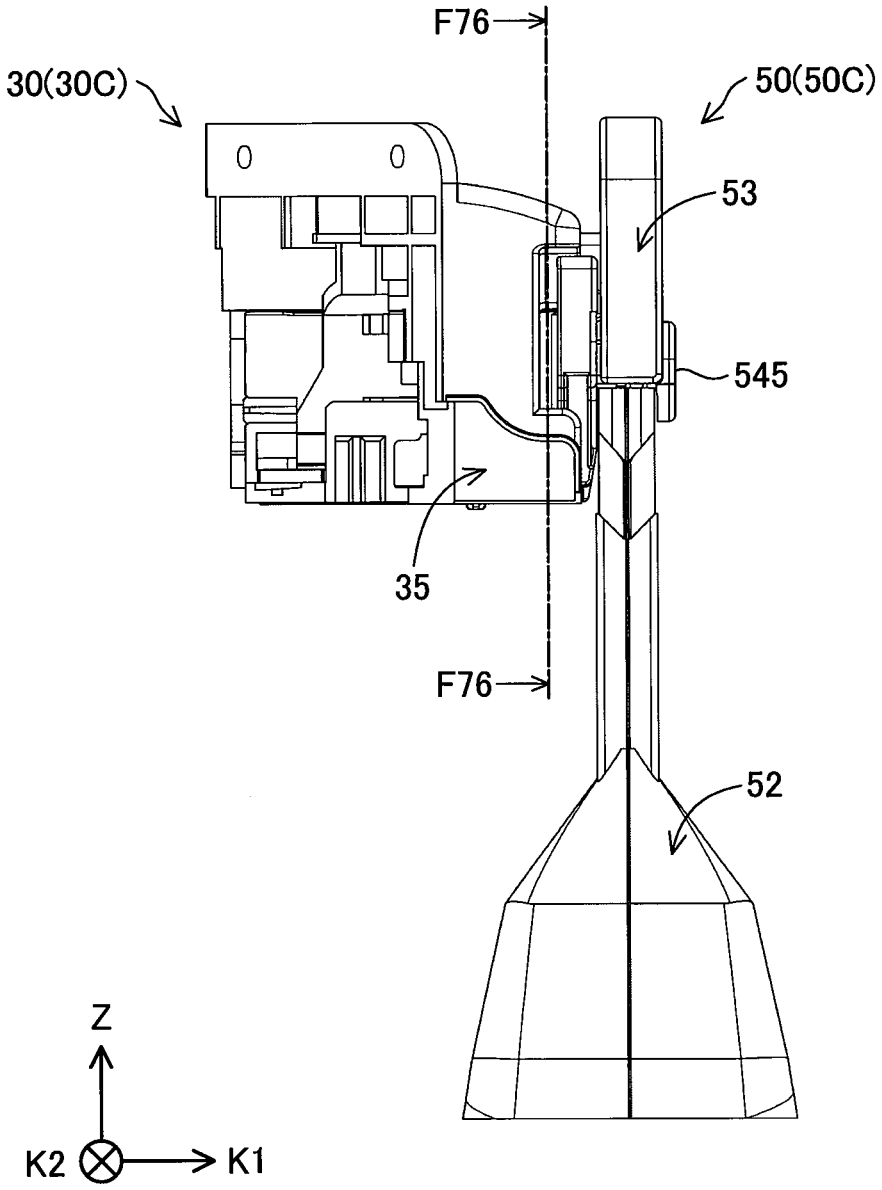
FIG. 76 is side view illustrating the state that mounting of the fluid container to the mounting assembly unit is completed.
Figure 77:
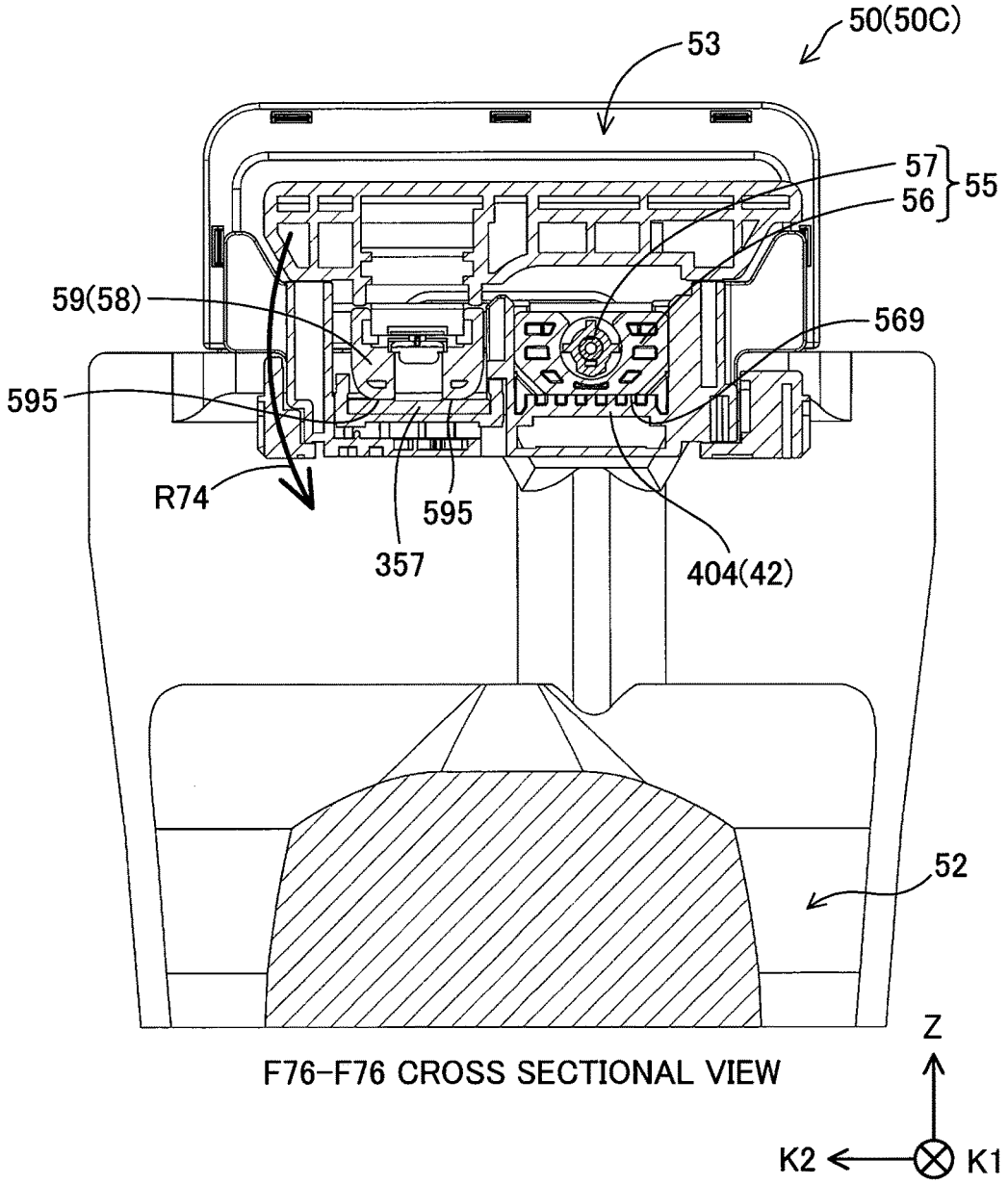
FIG. 77 is an F76-F76 cross sectional view of FIG. 76.

FIG. 72 is a side view illustrating the state that the fluid container 50 is set in the movable support structure 40 of the mounting assembly unit 30. FIG. 73 is a front view illustrating the state that the fluid container 50 is set in the movable support structure 40 of the mounting assembly unit 30. FIG. 74 is an F72-F72 cross sectional view of FIG. 72. FIG. 75 is an F73-F73 cross sectional view of FIG. 73. FIG. 76 is side view illustrating the state that mounting (connection) of the fluid container 50 to the mounting assembly unit 30 is completed. FIG. 77 is an F76-F76 cross sectional view of FIG. 76. The state of the mounting assembly unit 30 shown in FIG. 72 is the second state like FIG. 6. The state of the mounting assembly unit 30 shown in FIG. 76 is the first state like FIG. 7.

As shown in FIG. 74, when the fluid container 50 is set in the movable support structure 40, the fluid container body 52 is supported such that the fluid supply unit 55 and the substrate unit 58 are located above the fluid container body 52 in the direction of gravity (i.e., on the +Z-axis direction side of the fluid container body 52). More specifically, as shown in FIG. 74, a bottom 569 of the container-side support structure 56 comes into contact with the third support plane 404 of the supply assembly support part 42. This restricts the motion of the fluid container 50 downward in the direction of gravity (i.e., in the −Z-axis direction). This configuration supports the −K2-axis direction side of the fluid container body 52.

As shown in FIG. 77, as in the state that the fluid container 50 is set in the movable support structure 40, in the state that the fluid container 50 is connected to the mounting assembly unit 30 (in the mounting state), the fluid supply unit 55 and the substrate unit 58 are located above the fluid container body 52 in the direction of gravity (i.e., on the +Z-axis direction side of the fluid container body 52) to support the fluid container body 52. More specifically, the bottom part 595 of the circuit board holding member 59 coming into contact with a bottom 357 of the stationary member 35 restricts the motion of the fluid container 50 downward in the direction of gravity (i.e., in the −Z-axis direction). The bottom 569 of the container-side support structure 56 coming into contact with the third support plane 404 of the supply assembly support part 42 also restricts the motion of the fluid container 50 downward in the direction of gravity (i.e., in the −Z-axis direction). The fluid container 50 is supported through such restriction of the motion of the fluid container 50 downward in the direction of gravity by the fluid supply unit 55 and the substrate unit 58. The bottom 357 of the stationary member 35 starts coming into contact with the circuit board holding member 59, prior to completion of the connection of the fluid container 50 to the movable member 40 after the fluid container 50 is set in the movable member 40 and is moved in the connecting direction.

As shown in FIGS. 74 and 77, the bottom part 595 of the circuit board holding member 59 rotates in the direction of an arrow R74 and comes into contact with a device-side rotation restricting part 487 of the movable member 40. This configuration restricts the rotation of the circuit board holding member 59 in the direction of the arrow R74 about the fluid supply assembly 57. The bottom part 595 is thus also called rotation restricting part 595.

A-6. Advantageous Effects

In the embodiment described above, as shown in FIGS. 61 to 66, the fluid supply assembly 57 and the container-side electrical connection structure 58 are arranged in the positional relationship such that the contacts cp of the circuit board 582 are separated away from the printer 10, prior to the fluid supply assembly 57 in the course of disconnection of the fluid container 50 from the printer 10. In the course of disconnection from the printer 10, for example, the fluid container body 52 may be unintentionally pushed and make the fluid scattered from the fluid supply assembly 57 to outside. In this case, when the contacts cp of the circuit board 582 are in contact with the electrical connection structure 382 (more specifically, the device-side terminals 381) of the printer 10, the scattered ink may adhere to the contact parts and may cause an electrical problem such as a short circuit. The fluid supply unit 55 including the fluid supply assembly 57 is located at the one end portion 501-side of the fluid container body 52, i.e., above the fluid container body 52 in the direction of gravity as shown in FIGS. 12 and 14. Accordingly, the configuration of the fluid container 50 of the above embodiment causes the contacts cp of the circuit board 582 to be separated away from the printer 10, prior to the fluid supply assembly 57, in the course of disconnection of the fluid container 50 from the printer 10. This reduces the likelihood of the electrical problem described above.

According to the above embodiment, as shown in FIG. 14, the fluid container 50 includes the handle member 53 linked with the fluid supply unit 55 including the fluid supply assembly 57 and with the container-side electrical connection structure 58. This configuration ensures the easy operation of the fluid container 50 by using the handle member 53. For example, the user may grasp the handle member 53 and move the fluid container 50 to readily set the fluid container 50 in the mounting assembly unit 30. The grip part 54 of the handle member 53 is formed in an approximately rectangular frame-like shape but may be formed in an approximate C shape or in an approximate T shape.

According to the above embodiment, as shown in FIGS. 47 and 48, the fluid supply connection unit (mounting assembly unit) 30 of the printer 10 has the connection mechanism for connecting the fluid container 50 to the printer 10, which includes, for example, the movable support structure 40, the guide structure 250 and the connection structure-side engagement element 206. The fluid container 50 accordingly does not need to have any complicated connection mechanism and has the simplified structure. This facilitates disposal of the fluid container 50 after ink consumption. In the embodiment, the connection structure-side engagement element 206 is engaged with the guide structure 250 of the fluid supply connection unit 30. Unlike the configuration of providing a casing for the fluid container body 52 and forming the guide structure 250 on the casing to be engaged with the connection structure-side engagement element 206 of the printer 10, this configuration of the embodiment does not need the connection structure-side engagement element 206 to be engaged with the guide structure 250 of the casing in the course of connection of the fluid container 50. This accordingly ensures the easy and secure connection of the fluid container 50 with the printer 10.

According to the above embodiment, as shown in FIG. 36, the stationary structure 35 includes the motion guide assembly 330 configured to guide the motion of the movable support structure 40 in the first direction (−K1-axis direction9 or in the second direction (+K1-axis direction). The fluid container 50 accordingly does not need to have any complicated mechanism for guiding in the first direction or in the second direction and has the simplified structure.

According to the above embodiment, as shown in FIGS. 36 and 39, the mounting assembly unit (fluid supply connection unit) 30 includes the main body-side electrical connection structure 382 located between the parts of the motion guide assembly 330. As shown in FIGS. 20 and 23, the fluid container 50 has the contacts cp arranged to come into contact with the main body-side electrical connection unit 382 of the printer 10. Since the main body-side electrical connection structure 382 is located between the parts of the motion guide assembly 330, the contacts cp are smoothly connected with the main body-side electrical connection structure 382 by guiding the motion of the fluid container 50 supported on the movable support structure 40 by the motion guide assembly 330.

According to the above embodiment, as shown in FIG. 17, the fluid container 50 includes the pushing part 545 located on the second side 53*fb* opposite to the side on which the fluid supply assembly 57 is placed across the operation member 53 and configured to push the fluid supply assembly 57 in the first direction (−K1-axis direction). The fluid container 50 is thus readily movable in the first direction by pressing the pushing part 545. This makes the fluid supply assembly 57 more easily connected with the mounting assembly unit 30.

B. Second Embodiment

B-1. Structure of Fluid Container 50*b*

Figure 78:
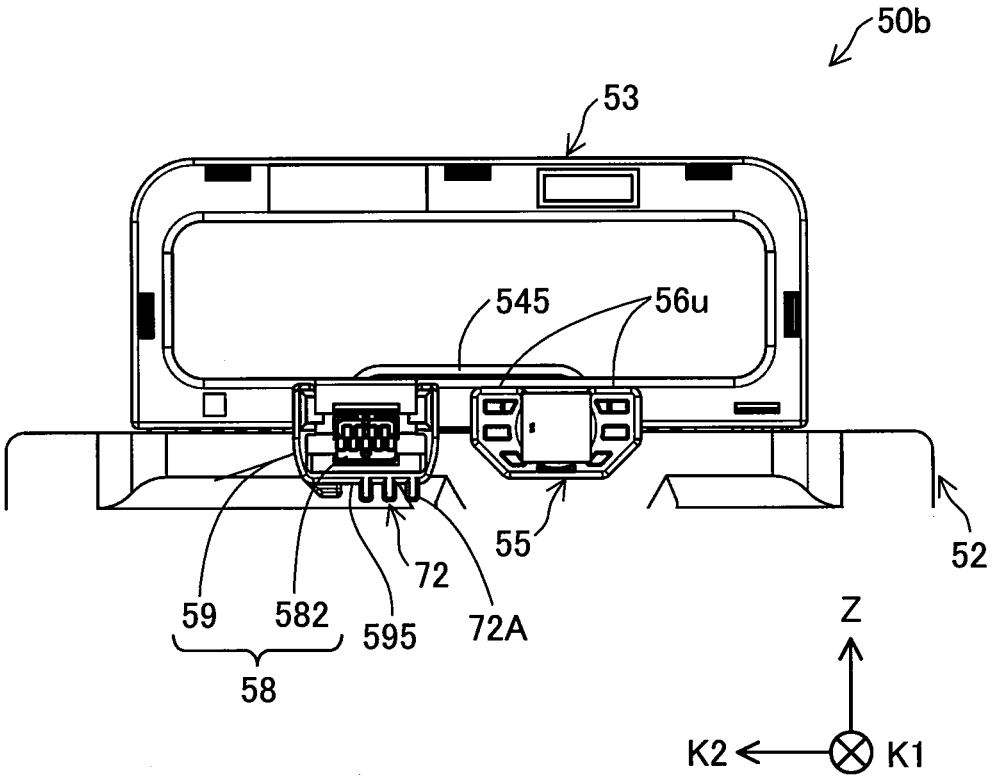
FIG. 78 is a diagram illustrating a fluid container according to a second embodiment.
Figure 79:
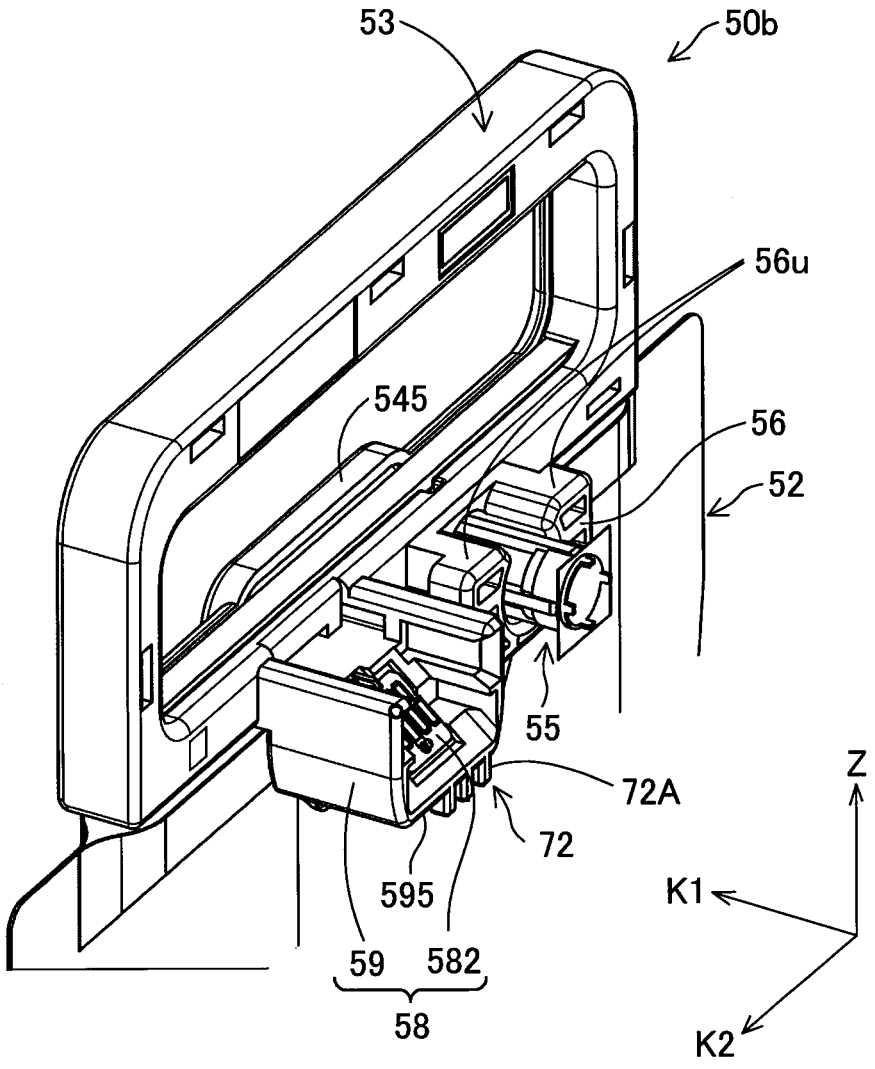
FIG. 79 is a perspective view illustrating the fluid container of the second embodiment.
Figure 80:
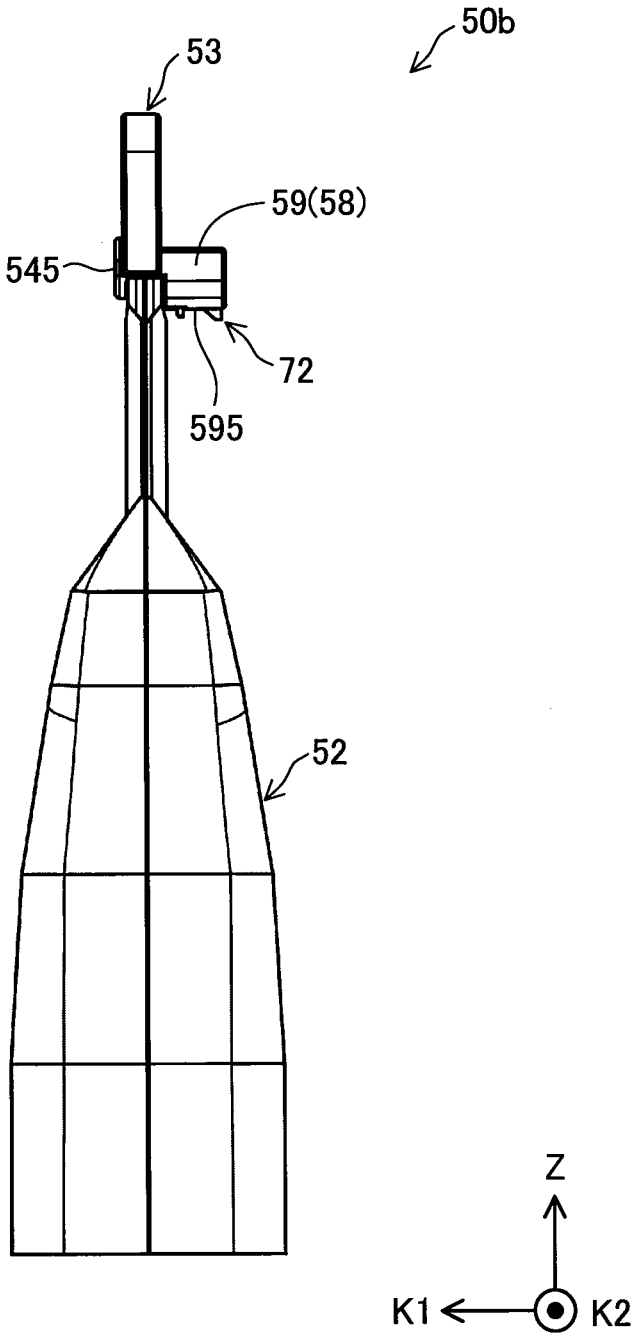
FIG. 80 is a side view illustrating the fluid container of the second embodiment.

FIG. 78 is a diagram illustrating a fluid container 50*b* according to a second embodiment. FIG. 79 is a perspective view illustrating the fluid container 50*b*. FIG. 80 is a side view illustrating the fluid container 50*b*. The fluid container 50*b* of the second embodiment differs from the fluid container 50 of the first embodiment (shown in FIG. 18) by that the fluid container 50*b* additionally has a container-side identification member 72. Otherwise the structure of the fluid container 50*b* of the second embodiment is similar to that of the first embodiment. The like components are expressed by the like symbols to those of the first embodiment and are not specifically described herein. The container-side identification member 72 is used to identify whether a right type of (in this embodiment, a right ink color of) the fluid container 50 is mounted.

As shown in FIGS. 78 to 80, the container-side identification member 72 is made of at least one projection 72A provided on the bottom part 595 of the circuit board holding member 59. The projection 72A is located on a −K1-axis direction side end portion of the bottom part 595. The container-side identification member 72 has a different pattern specified by the number and the positions of the projections 72A for each of different types of fluid containers 50*b* (fluid containers 50C, 50M, 50Y and 50K containing different color inks).

B-2. Structure of Mounting Assembly Unit 30*b*

Figure 81:
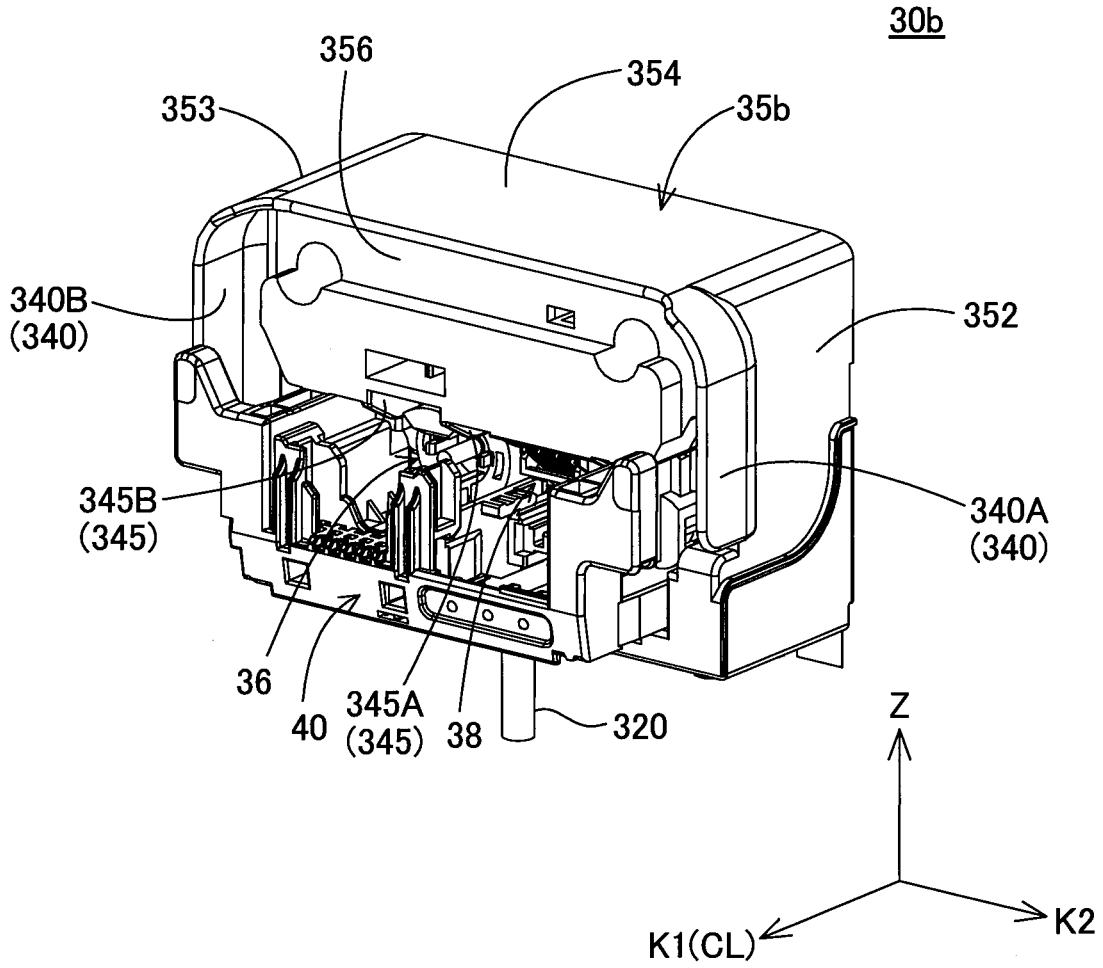
FIG. 81 is a first perspective view illustrating a mounting assembly unit of the second embodiment.
Figure 82:
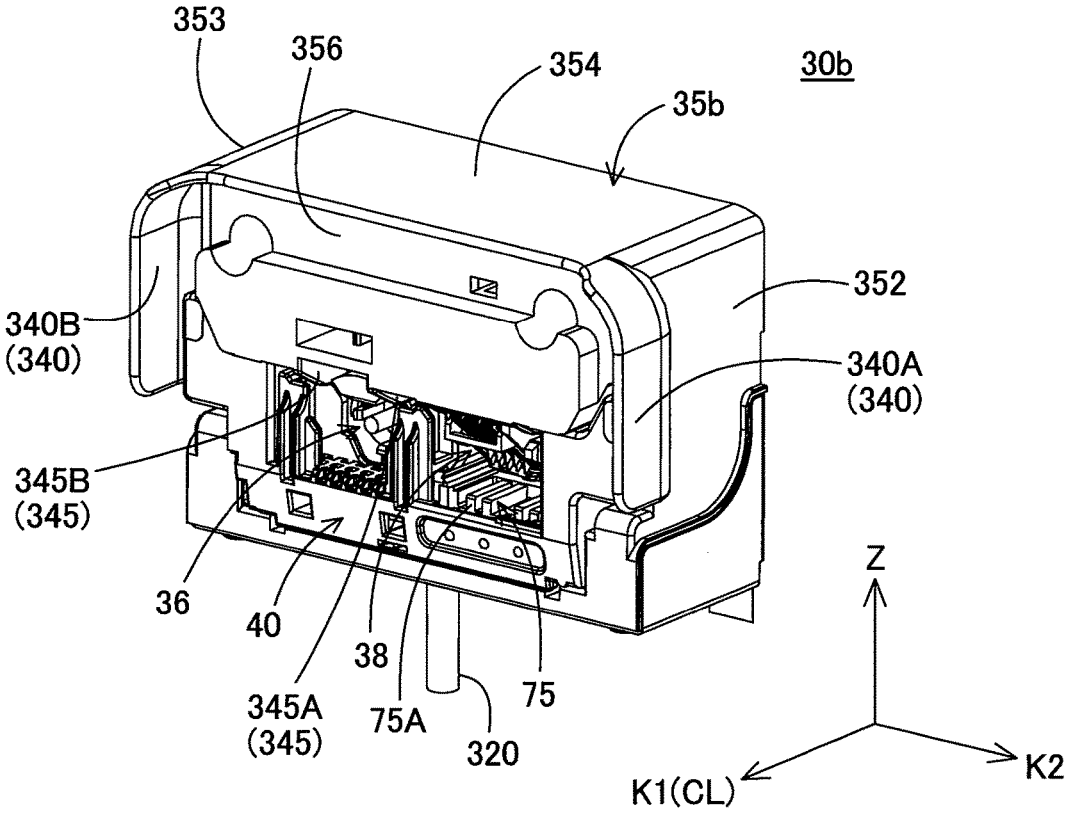
FIG. 82 is a second perspective view illustrating the mounting assembly unit of the second embodiment.
Figure 83:
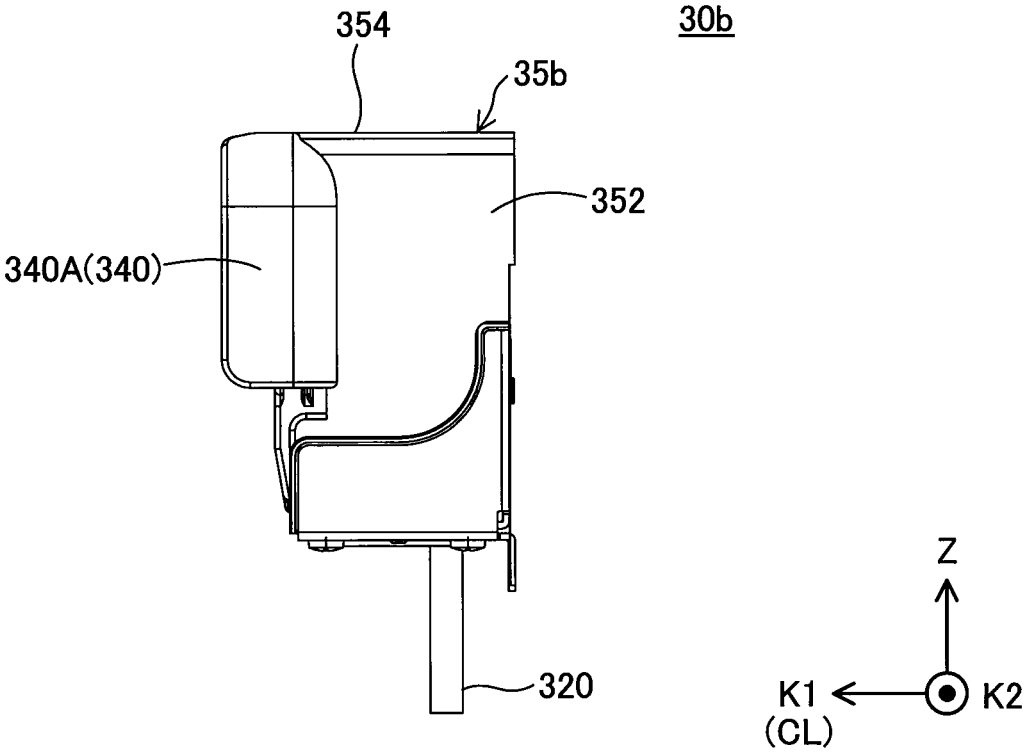
FIG. 83 is a side view illustrating the mounting assembly unit of the second embodiment.
Figure 84:
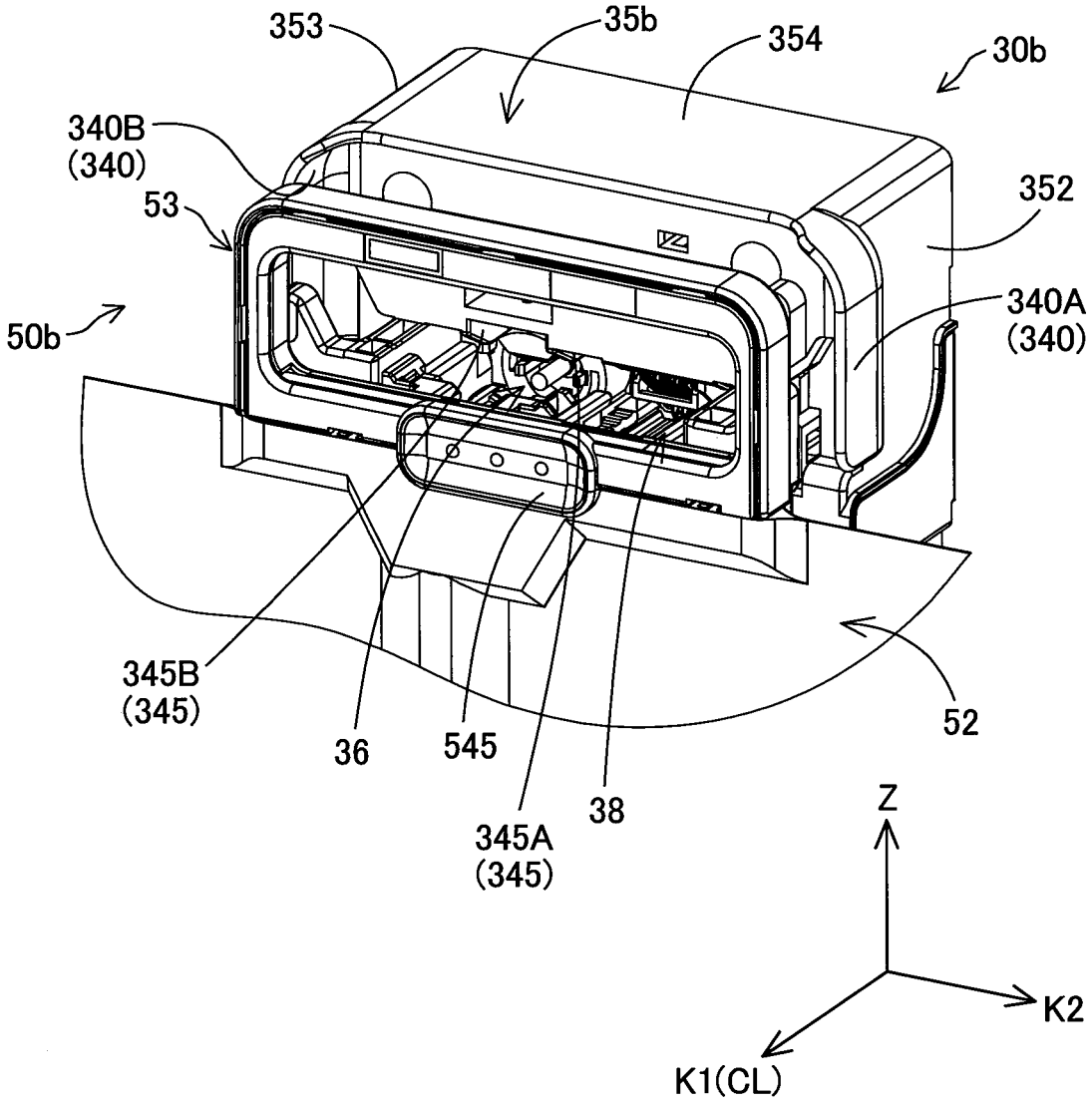
FIG. 84 is a diagram illustrating the state that the fluid container is set in the mounting assembly unit shown in FIG. 81.
Figure 85:
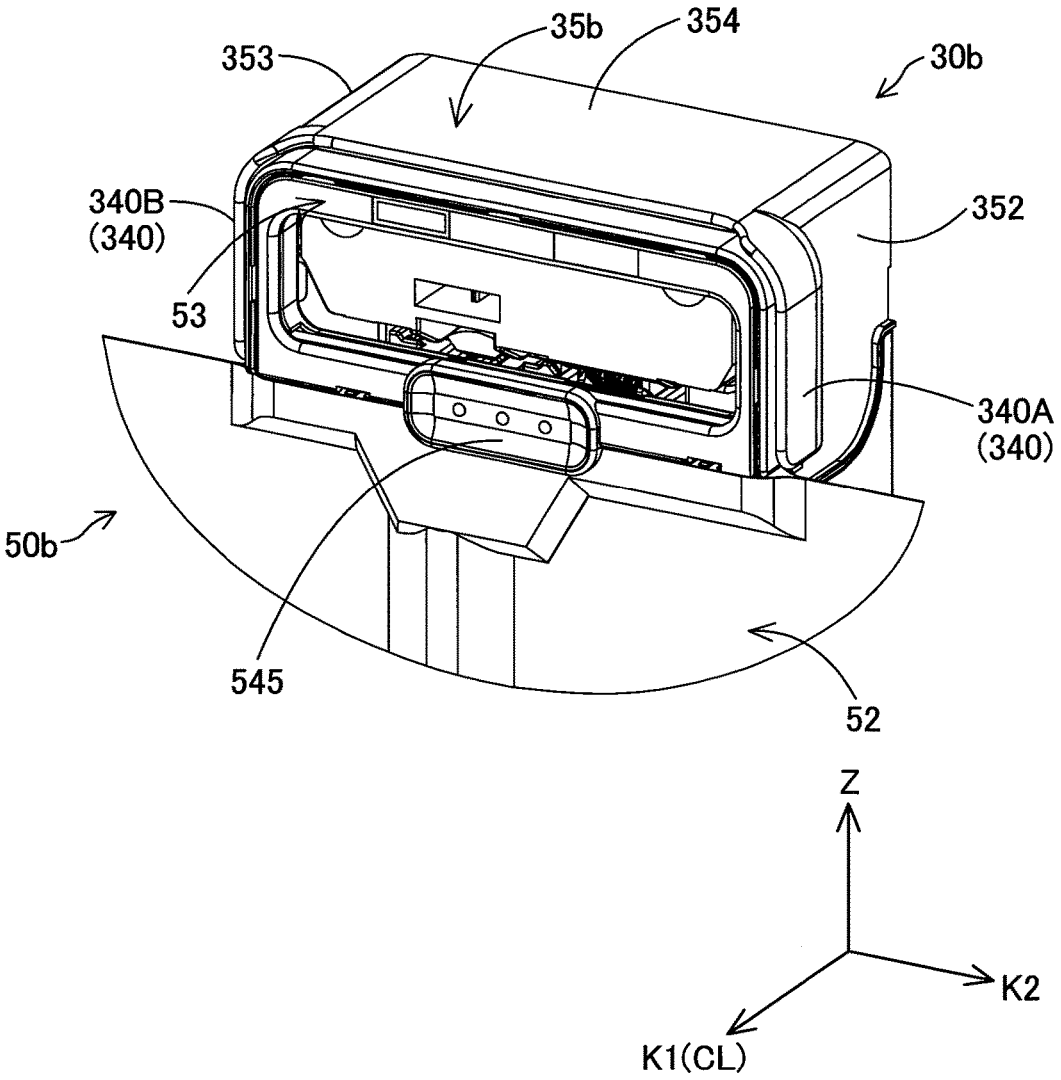
FIG. 85 is a diagram illustrating the state that the fluid container is mounted to the mounting assembly unit shown in FIG. 82.

FIG. 81 is a first perspective view illustrating a mounting assembly unit 30*b* of the second embodiment. FIG. 82 is a second perspective view illustrating the mounting assembly unit 30*b* of the second embodiment. FIG. 83 is a side view illustrating the mounting assembly unit 30*b*. FIG. 84 is a diagram illustrating the state that the fluid container 50*b* is set in the mounting assembly unit 30*b* shown in FIG. 81. FIG. 85 is a diagram illustrating the state that the fluid container 50*b* is mounted to the mounting assembly unit 30*b* shown in FIG. 82. FIG. 81 illustrates the first state that the movable support structure 40 is protruded outward relative to a stationary member 35*b*. FIG. 82 illustrates the second state that the movable support structure 40 is placed in the stationary member 35*b*. The mounting assembly unit 30*b* of the second embodiment differs from the mounting assembly unit 30 of the first embodiment (shown in FIG. 27) by that the mounting assembly unit 30*b* includes a cover member 340, a device-side upper restriction element 345 and a device-side identification member 75 (shown in FIG. 82). Otherwise the structure of the mounting assembly unit 30*b* of the second embodiment is similar to that of the first embodiment. The like components are expressed by the like symbols to those of the first embodiment and are not specifically described herein.

As shown in FIGS. 81 to 83, the cover member 340 is provided on a first wall (first side surface) 352 and a second wall (second side surface) 353 arranged to intersect with an upper wall (upper surface) 354 of the stationary member 35*b*. The first wall 352 is located on the +K2-axis direction side, and the second wall 353 is located on the −K2-axis direction side. The cover member 340 is provided to cover at least part of the handle member 53 when the fluid container 50*b* is connected to the mounting assembly unit 30*b*. The cover member 340 includes a first cover part 340A and a second cover part 340B. The first cover part 340A is provided on the first wall 352 to be protruded from the first wall 352 toward the +K1-axis direction side (front wall 356-side). The second cover part 340B is provided on the second wall 353 to be protruded from the second wall 353 toward the +K1-axis direction side (front wall 356-side).

As shown in FIG. 81, the device-side upper restriction element 345 is provided on the stationary member 35*b*. More specifically, the device-side upper restriction element 345 is provided on a front wall 356 constituting a +K1-axis direction side surface of the stationary member 35*b*. The device-side upper restriction element 345 includes a first upper restriction part 345A and a second upper restriction part 345B. The first upper restriction part 345A and the second upper restriction part 345B are arranged across the fluid introducing mechanism 36 in the K2-axis direction. The first upper restriction part 345A and the second upper restriction part 345B come into contact with a +Z-axis direction-side end surface (upper end surface) 56*u* (shown in FIG. 79) of the container-side support structure 56, so as to restrict the motion of the container-side support structure 56 in the +Z-axis direction, when the fluid container 50*b* is connected to the mounting assembly unit 30*b*.

As shown in FIG. 82, the device-side identification member 75 is provided on the stationary member 35*b*. The device-side identification member 75 is formed immediately below the contact mechanism 38. The device-side identification member 75 is made of at least one projection 75A. The device-side identification member 75 has a different pattern specified by the number and the positions of the projections 75A for each of different types (more specifically, each of different types of the fluid containers 50*b* to be mounted). In the case that a right type of the fluid container 50*b* is mounted to the mounting assembly unit 30*b*, the device-side identification member 75 and the container-side identification member 72 do not collide with each other but are fit in each other. In the case that a wrong type of the fluid container 50*b* is mounted to the mounting assembly unit 30*b*, on the other hand, the device-side identification member 75 and the container-side identification member 72 collide with each other to interfere with further motion of the fluid container 50*b* in the connecting direction (−K1-axis direction). This configuration reduces the likelihood that a wrong type of the fluid container 50*b* is mounted to the mounting assembly unit 30*b*.

B-3. Connection of Fluid Container 50*b* to Mounting Assembly Unit 30*b*

Figure 86:
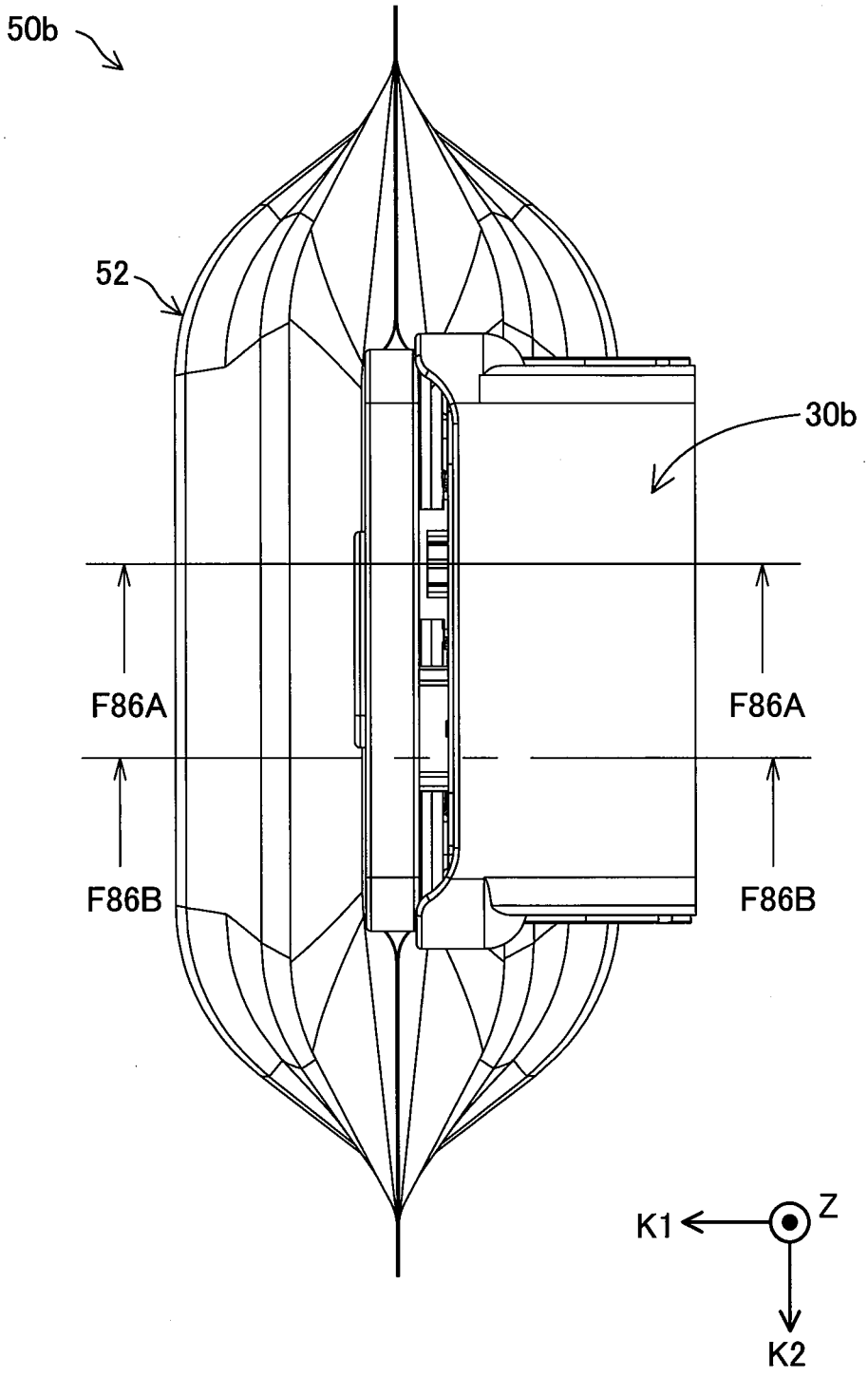
FIG. 86 is a diagram illustrating a connection timing.
Figure 87:
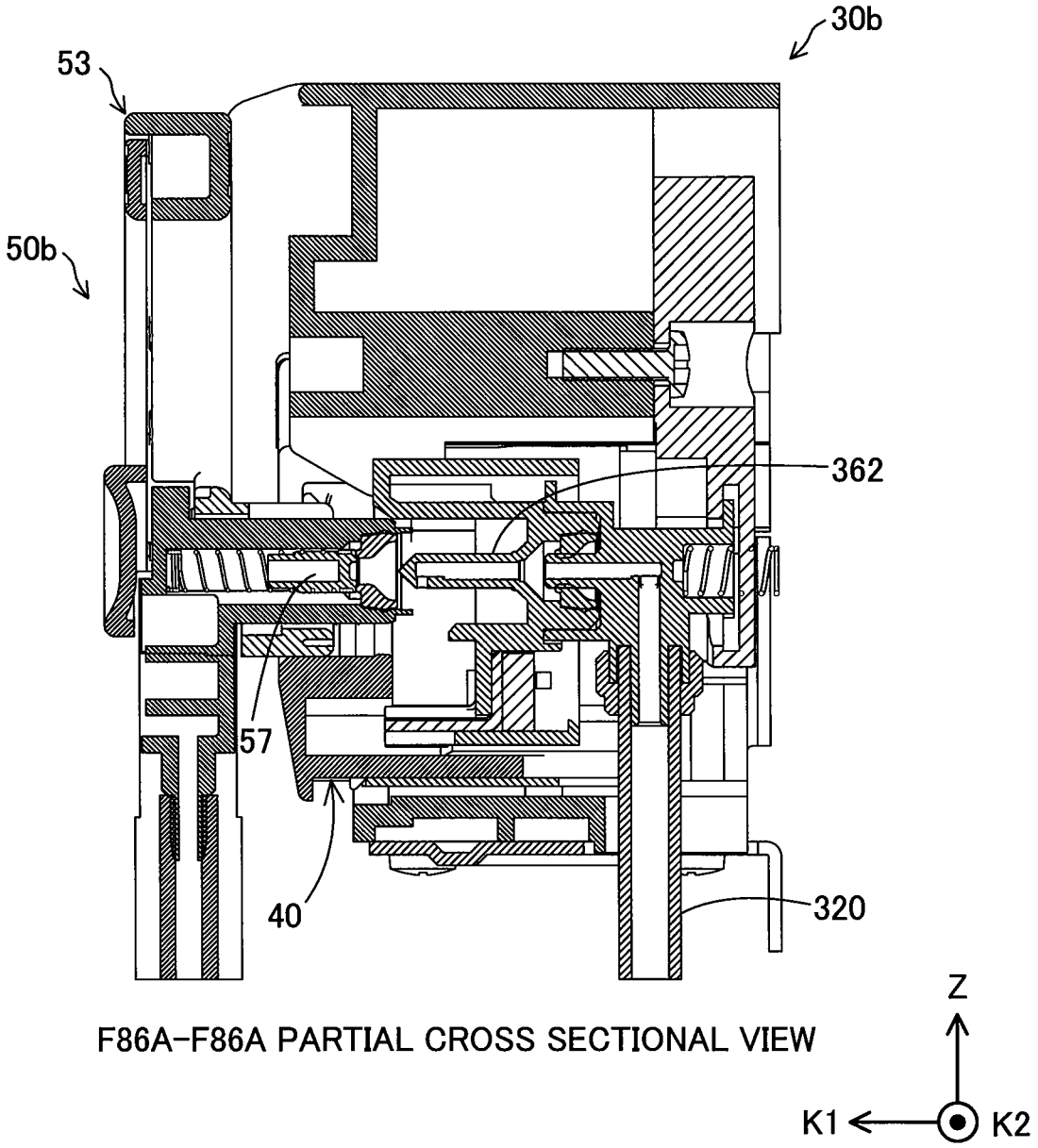
FIG. 87 is an F86A-F86A partial cross sectional view of FIG. 86.
Figure 88:
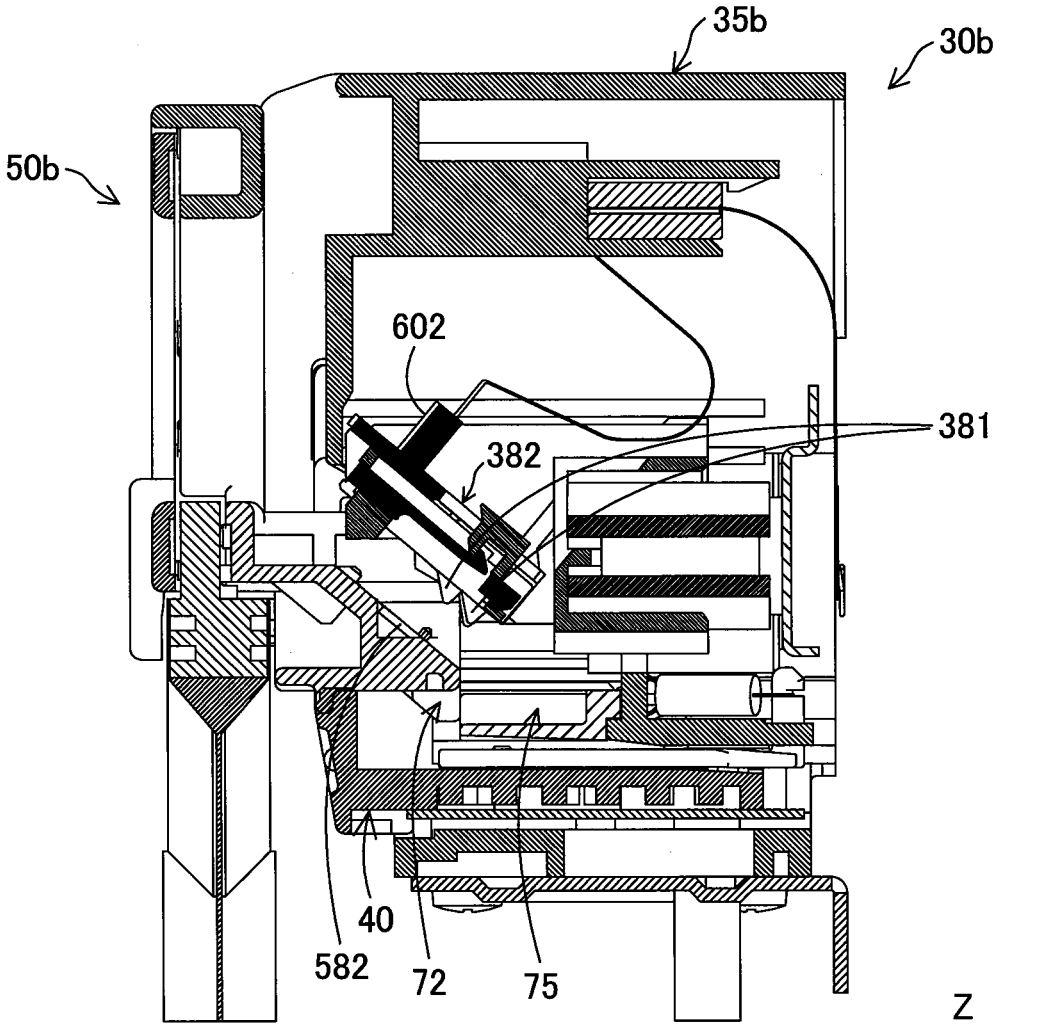
FIG. 88 is an F86B-F86B partial cross sectional view of FIG. 86.
Figure 88:
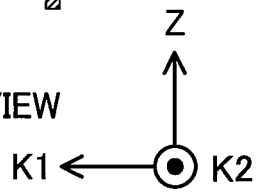

FIG. 86 is a diagram illustrating a connection timing. FIG. 87 is an F86A-F86A partial cross sectional view of FIG. 86. FIG. 88 is an F86B-F86B partial cross sectional view of FIG. 86. FIG. 86 illustrates the state that the fluid container 50*b* is set in the movable support structure 40 and is pushed and moved in the connecting direction (−K1-axis direction) to start fitting between the container-side identification member 72 and the device-side identification member 75.

As shown in FIGS. 87 and 88, fitting between the container-side identification member 72 and the device-side identification member 75 starts, prior to a start of connection of the fluid introducing structure 362 with the fluid supply assembly 57. This configuration reduces the likelihood that a wrong type of the fluid container 50*b* is mounted to the mounting assembly unit 30*b* and thereby reduces the likelihood that the wrong color ink is introduced through the fluid introducing part 362. As shown in FIG. 88, fitting between the container-side identification member 72 and the device-side identification member 75 starts, prior to a start of the contact of the device-side terminals 381 with the circuit board 582.

Fitting between the container-side identification member 72 and the device-side identification member 75 is not made in the course of setting the fluid container 50*b* in the movable support structure 40 of the mounting assembly unit 30*b* but is made in the course of moving the fluid container 50*b* in the connecting direction after setting. This configuration prevents the container-side identification member 72 and the device-side identification member 75 from colliding with each other in the course of setting, thus reducing the likelihood that the fluid container 50*b* is not set in a proper attitude in the movable support structure 40. Accordingly this reduces the occurrence of various problems that may arise by the failure in setting the fluid container 50*b* in a proper attitude in the movable support structure 40. For example, this reduces the problem that the container-side identification member 72 and the device-side identification member 75 collide with each other in the course of setting and the fluid container 50*b* falls off from the movable support structure 40. This also reduces the likelihood that the fluid container 50*b* or the mounting assembly unit 30*b* is damaged by collision of the fluid container 50*b* with part of the stationary member 35*b* in the course of moving the fluid container 50*b* in the connecting direction after setting.

Figure 89:
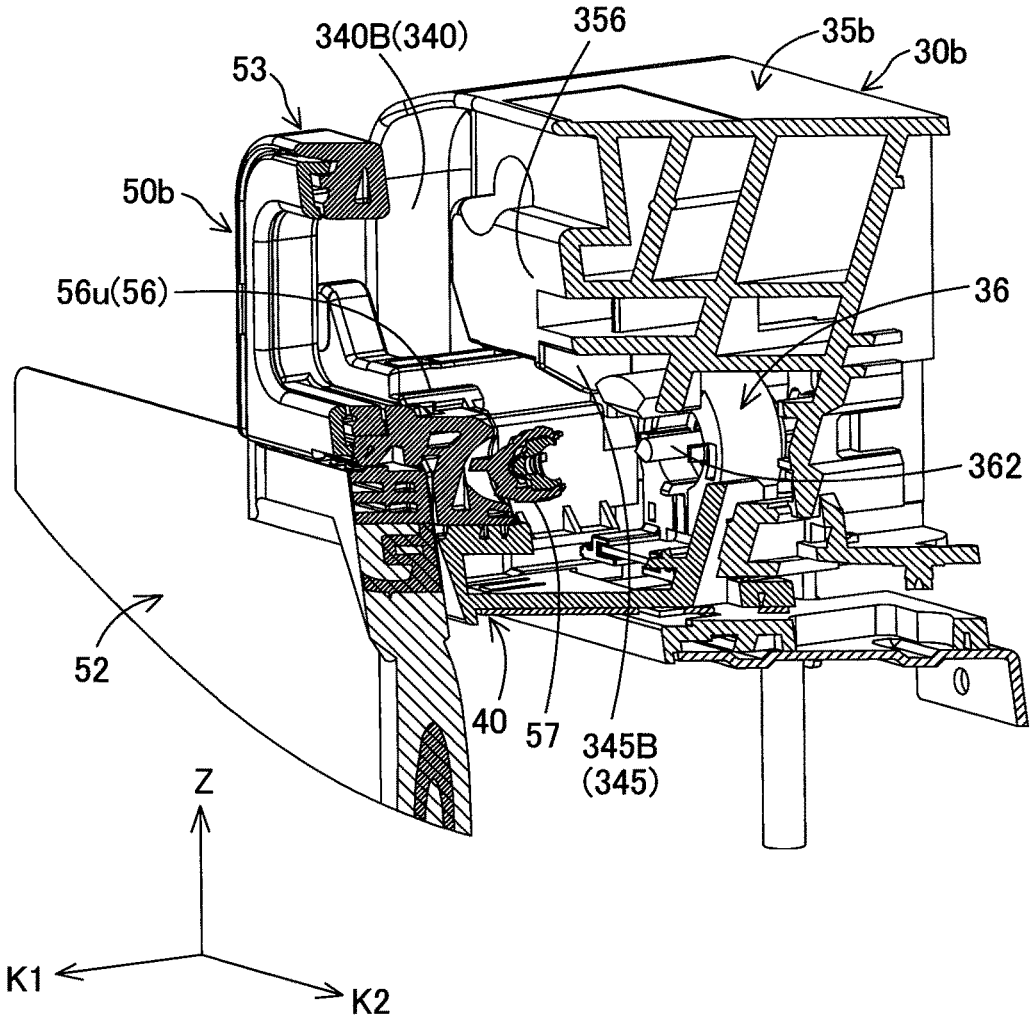
FIG. 89 is a cutaway drawing of FIG. 84.
Figure 90:
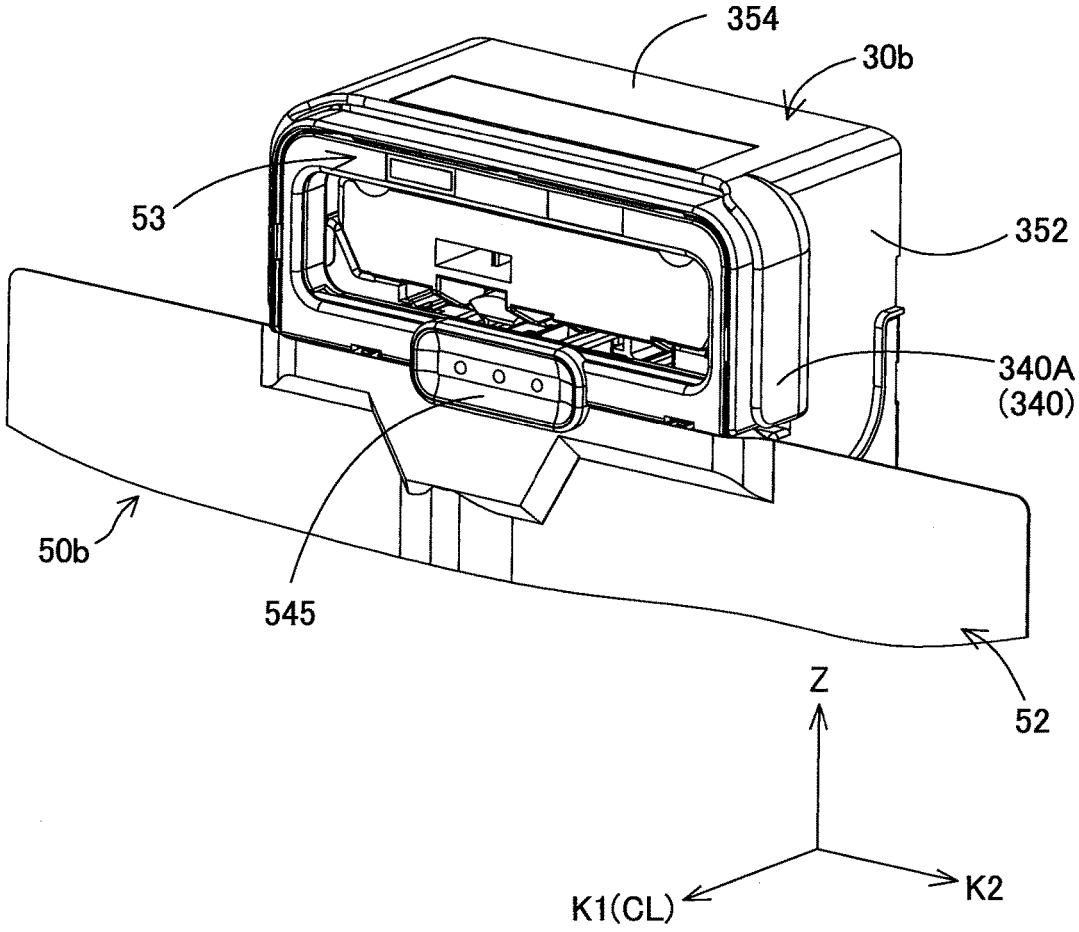
FIG. 90 is a perspective view illustrating the mounting assembly unit and the fluid container of the second embodiment.
Figure 91:
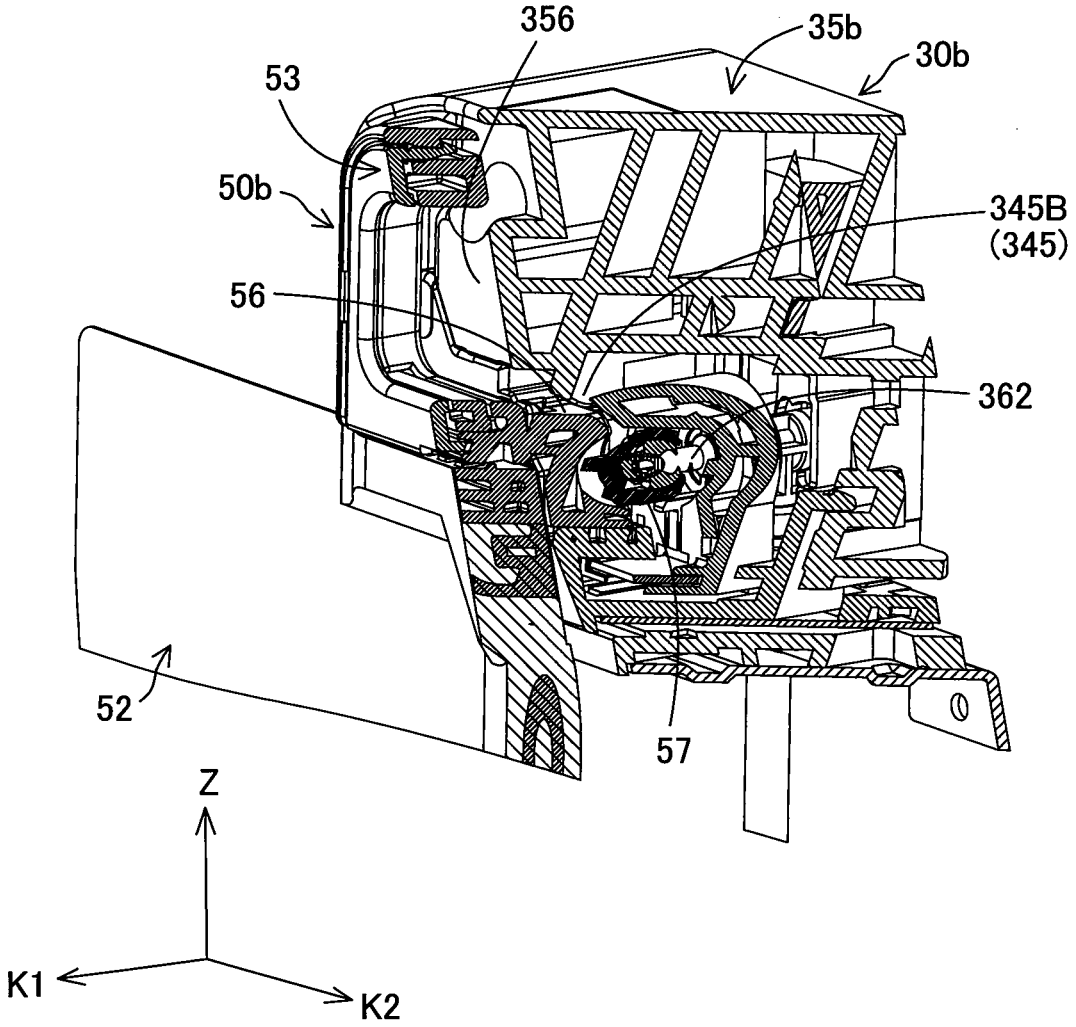
FIG. 91 is a cutaway drawing of FIG. 90.
Figure 92:
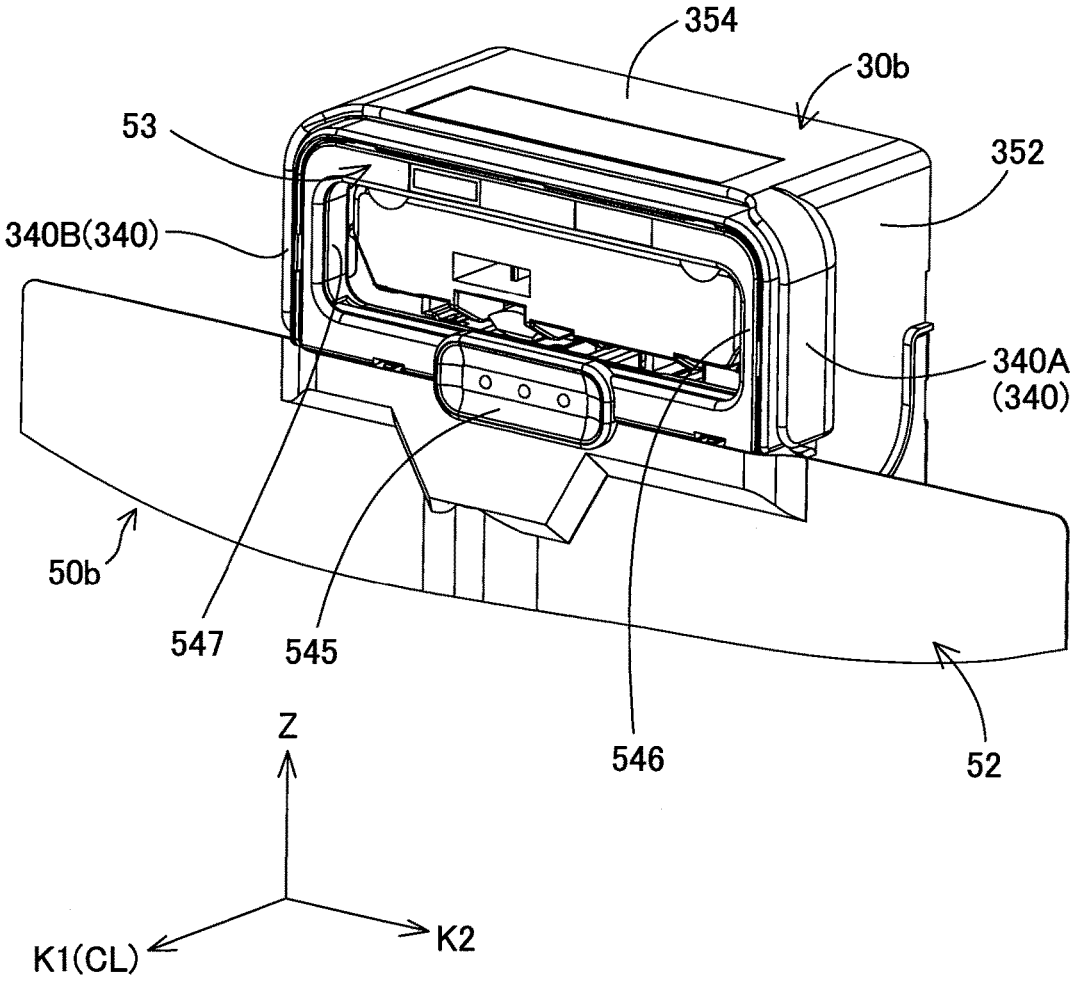
FIG. 92 is a perspective view illustrating the mounting unit and the fluid container of the second embodiment.
Figure 93:
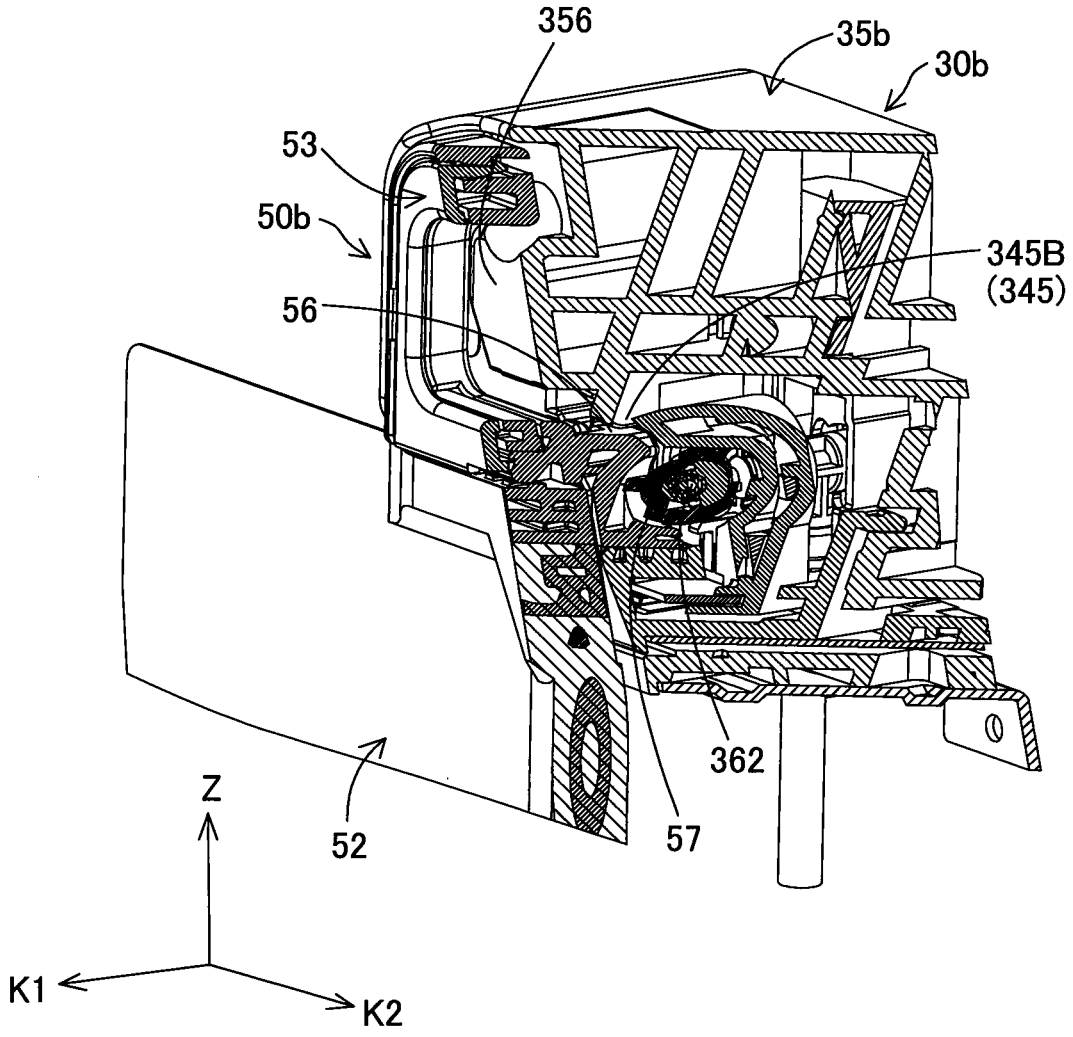
FIG. 93 is a cutaway drawing of FIG. 92.

FIG. 89 is a cutaway drawing of FIG. 84. FIG. 90 is a perspective view illustrating the mounting assembly unit 30*b* and the fluid container 50*b*. FIG. 91 is a cutaway drawing of FIG. 90. FIG. 92 is a perspective view illustrating the mounting unit 30*b* and the fluid container 50*b*. FIG. 93 is a cutaway drawing of FIG. 92. FIG. 90 illustrates the state that the fluid container 50*b* is pushed and moved in the connecting direction and the device-side upper restriction element 345 (shown in FIG. 82) approaches the upper end surface 56*u* (shown in FIG. 78) of the container-side support structure 56. FIG. 92 illustrates the state that connection of the fluid container 50*b* is completed.

As shown in FIG. 89, as the fluid container 50*b* is pushed and moved in the connecting direction (−K1-axis direction), the upper end surface 56*u* moves toward the device-side upper restriction element 345. As shown in FIG. 91, the container-side support structure 56 reaches the position where the device-side upper restriction element 345 is located with respect to the connecting direction, substantially simultaneously with starting the connection of the fluid supply assembly 57 to the fluid introducing structure 362. As shown in FIG. 93, the upper end surface 56*u* of the container-side support structure 56 comes into contact with the device-side upper restriction element 345, so that the operation of connecting the fluid supply assembly 57 with the fluid introducing structure 362 proceeds under restriction of the motion of the container-side support structure 56 upward in the direction of gravity (+Z-axis direction). This ensures the good connection of the fluid supply assembly 57 with the fluid introducing structure 362.

As shown in FIG. 92, at least part of the handle member 53 is covered by the cover member 340 in the state that the fluid container 50*b* is connected to the mounting assembly unit 30*b*. According to this embodiment, the first connecting part 546 and the second connecting part 547 of the handle member 53 are placed inside of the cover member 340 so as to be covered by the cover member 340. This configuration suppresses the handle member 53 from being operated by the user in the connecting state of the fluid container 50*b*. Covering the handle member 53 by the cover member 340 also reduces the likelihood that the handle member 53 is damaged.

B-4. Positional Relationship Between Pushing Part 545 and Motion Guide Assembly 330

Figure 94:
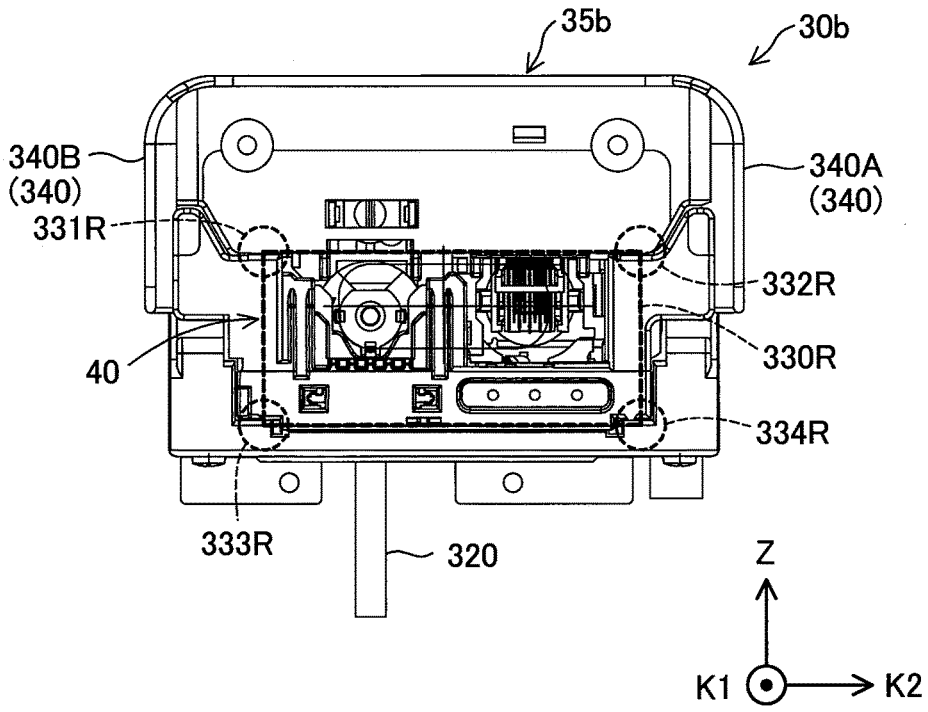
FIG. 94 is a front view illustrating the mounting assembly unit of the second embodiment.
Figure 95:
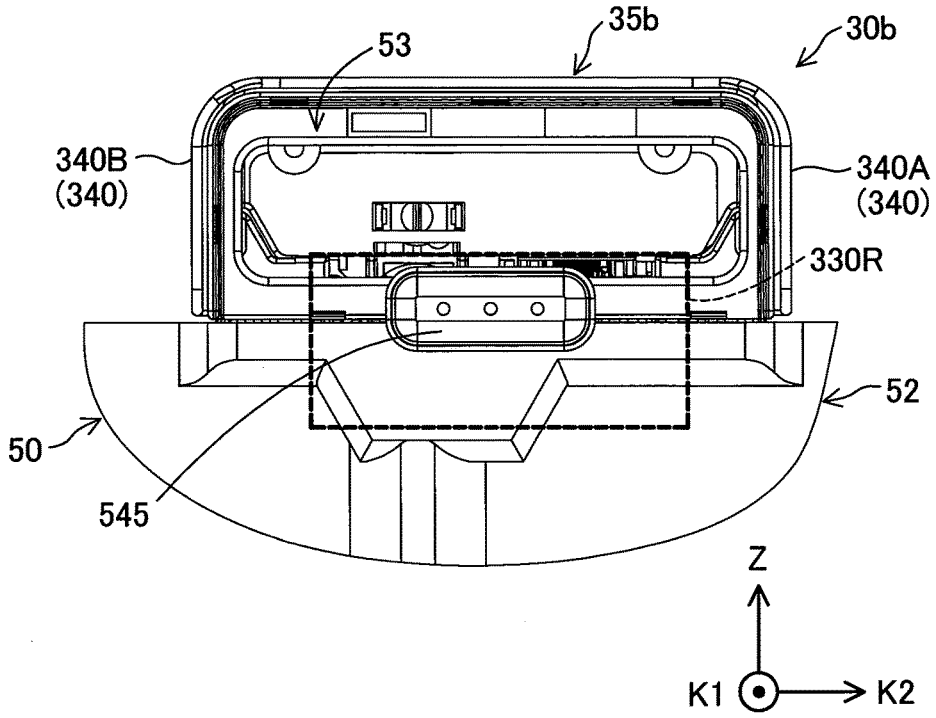
FIG. 95 is a front view illustrating a stationary member of the second embodiment in the mounting state.

FIG. 94 is a front view illustrating the mounting assembly unit 30*b*. FIG. 95 is a front view illustrating the stationary member 35*b* in the mounting state. A symbol "331R" shown in FIG. 94 indicates an area where the first guide part 331 (shown in FIG. 36) is located when the mounting assembly unit 30*b* is viewed from the +K1-axis direction side. A symbol "332R" shown in FIG. 94 indicates an area where the second guide part 332 (shown in FIG. 36) is located when the mounting assembly unit 30*b* is viewed from the +K1-axis direction side. A symbol "333R" shown in FIG. 94 indicates an area where the second guide part 333 (shown in FIG. 36) is located when the mounting assembly unit 30*b* is viewed from the +K1-axis direction side. A symbol "334R" shown in FIG. 94 indicates an area where the fourth guide part 334 (shown in FIG. 36) is located when the mounting assembly unit 30*b* is viewed from the +K1-axis direction side. An area inside of a convex polygon (rectangle in this embodiment) formed by connecting the first guide part 331 to the fourth guide part 334 when the mounting assembly unit 30*b* is viewed from the +K1-axis direction side (from the second direction side) is called area 330R defined by the plurality of guide restriction parts 331 to 334. In other words, the area 330R is an area inscribed in the first to the fourth guide parts 331 to 334. As shown in FIG. 95, when the fluid supply assembly 57 is supported on the movable support structure 40 and the fluid supply structure 55 is connected with or disconnected from the mounting assembly unit 30*b*, at least part of the pushing part 545 is located inside of the area 330R. This configuration enables the operation of connecting the fluid supply structure 55 with the mounting assembly unit 30*b* or the operation of disconnecting the fluid supply structure 55 from the mounting assembly unit 30*b* to be performed smoothly via the motion guide assembly 330 (shown in FIG. 36) by pushing the pushing part 545.

C. Modifications

The invention is not limited to the embodiments or the aspects described above but may be implemented by a diversity of other aspects without departing from the scope of the invention. Some examples of possible modification are given below.

C-1. Modifications of Fluid Container-Side Terminals 581

Figure 96:
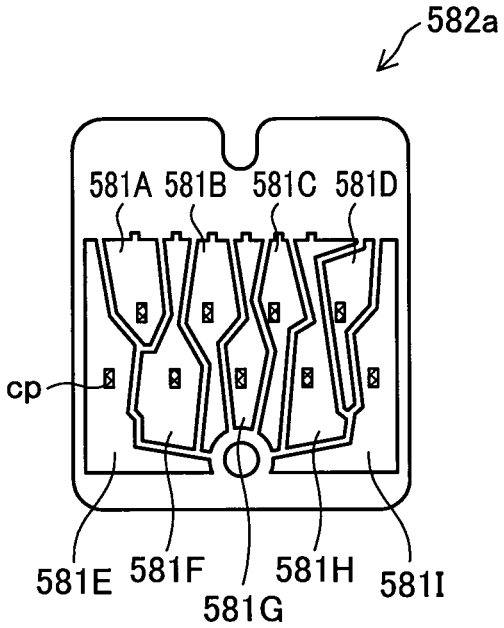
FIG. 96 is a diagram illustrating a modification of terminal geometry of the circuit board.
Figure 97:
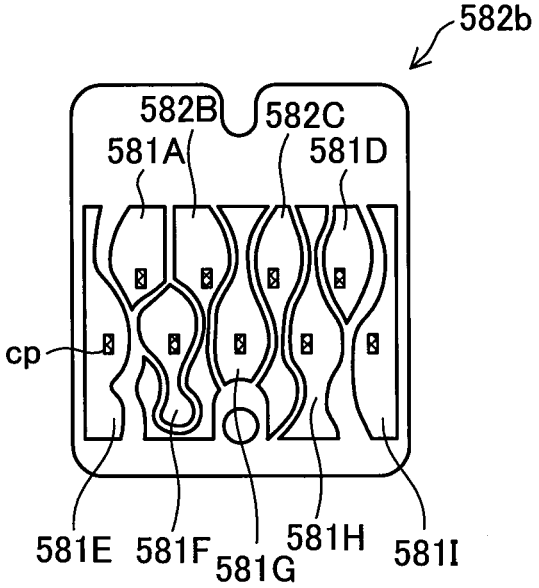
FIG. 97 is a diagram illustrating another modification of terminal geometry of the circuit board.
Figure 98:
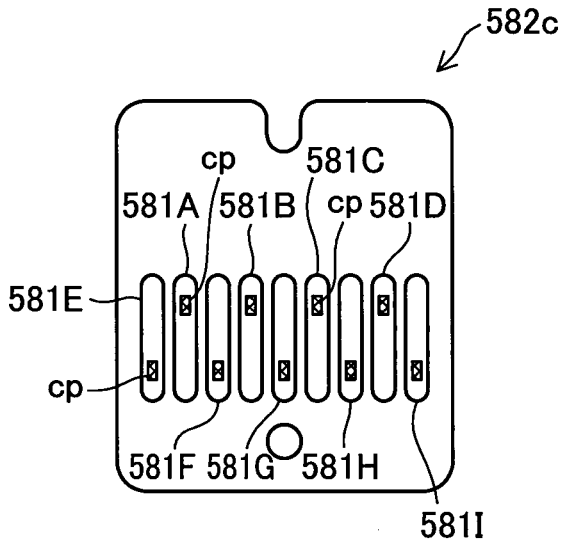
FIG. 98 is a diagram illustrating another modification of terminal geometry of the circuit board.

FIGS. 96 to 98 are diagrams illustrating modifications of terminal geometry of the circuit board. Circuit boards 582*a* to 582*c* of these modifications differ from the circuit board 582 shown in FIG. 23 by only the surface geometry of the fluid container-side terminals 581A to 581H. In the circuit boards 582*a* and 582*b* of FIGS. 96 and 97, the individual terminals do not have the approximately rectangular shape but irregular shapes. In the circuit board 582*c* of FIG. 98, the nine fluid container-side terminals 581A to 581H are aligned. These circuit boards 582*a* to 582*c* have the same arrangement of the contacts cp, which come into contact with the device-side terminals 381 (shown in FIG. 41A) corresponding to the respective fluid container-side terminals 581A to 581H, as that of the circuit board 582 shown in FIG. 23. As long as the arrangement of the contacts cp is fixed, the individual terminals may have any surface geometry.

C-2. Modifications of Contact Plane (Virtual Plane) TP

In the description hereof, the term "plane" is used in a broad sense including both a virtual plane (also called non-real plane) and a real plane. The contact plane TP defined by three or more contacts comprised of the contacts cp included in the line Ln1 and the contacts cp included in the line Ln2 shown in FIG. 23 accordingly means both a virtual plane and a real plane inclined in a predetermined direction.

Figure 99:
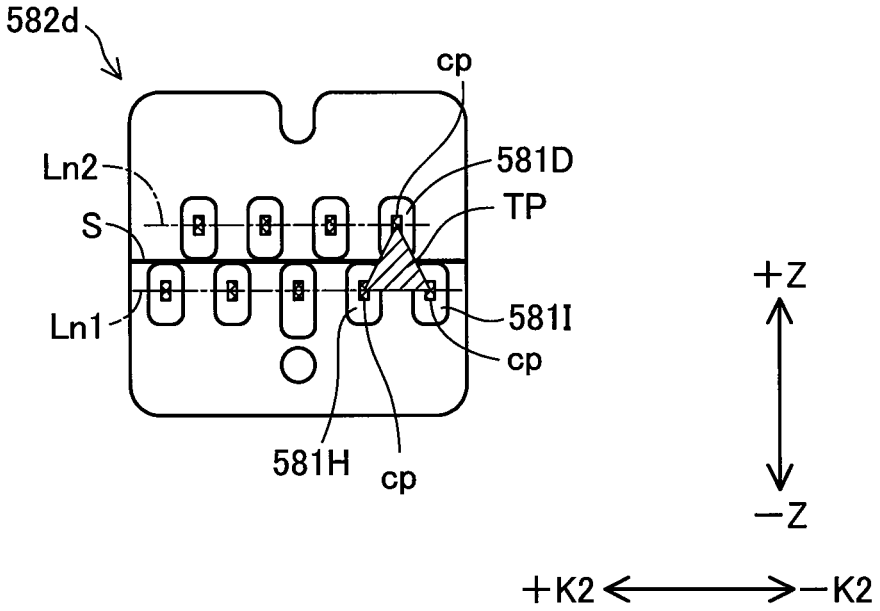
FIG. 99 is a diagram illustrating one example of a virtual contact plane inclined in a predetermined direction.
Figure 100:
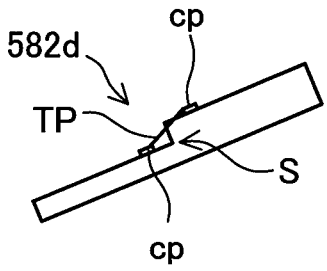
FIG. 100 is a diagram of FIG. 99 viewed from a −K2-axis direction.

FIG. 99 is a diagram illustrating one example of the virtual contact plane TP inclined in a predetermined direction. FIG. 100 is a diagram of FIG. 99 viewed from the −K2-axis direction. FIG. 99 illustrates a circuit board 582*d* with a step S between the line Ln1 and the line Ln2 as one example. In this example, the virtual contact plane TP is defined by connecting the contact cp of the terminal 581D included in the line Ln2 and the contacts cp of the terminals 581H and 581I included in the line Ln1. As shown in FIG. 100, the virtual contact plane TP defined by the respective contacts cp is inclined in a predetermined direction. In this example, like the example of the above embodiment shown in FIG. 25, the virtual contact plane TP is inclined in a direction including a +Z-axis direction (upward in the direction of gravity) component and a −K1-axis direction (first direction) component.

Figure 101:
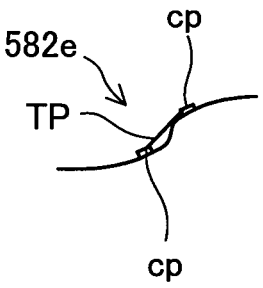
FIG. 101 is a diagram illustrating another example of the virtual contact plane.

FIG. 101 is a diagram illustrating another example of the virtual contact plane TP inclined along a predetermined direction. A circuit board 582*e* shown in FIG. 101 is made of a bendable (flexible) film. Since the circuit board 582*e* is bendable, the virtual contact plane TP is inclined along the predetermined direction even without formation of the step S shown in FIGS. 99 and 100.

As described above, an inclined surface defined by the contacts cp (including both a virtual contact surface TP and a real contact surface TP) needs to be inclined in the direction including the +Z-axis direction (upward in the direction of gravity) component and the −K1-axis direction (first direction) component at least in the mounting state. Any of the configurations other than those described above may have the similar advantageous effects to those of the above embodiment, as long as the virtual or the real contact plane TP is inclined.

Figure 102:
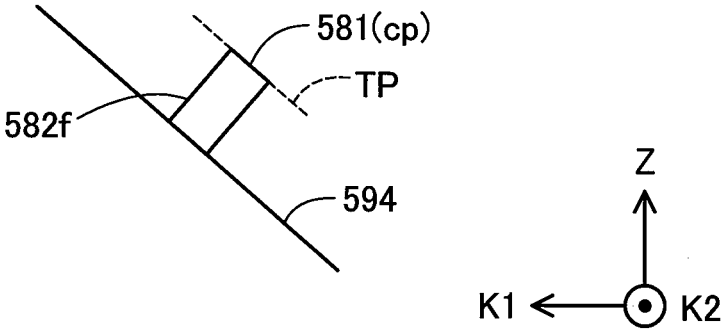
FIG. 102 is a diagram illustrating a fluid container-side terminal member.
Figure 103:
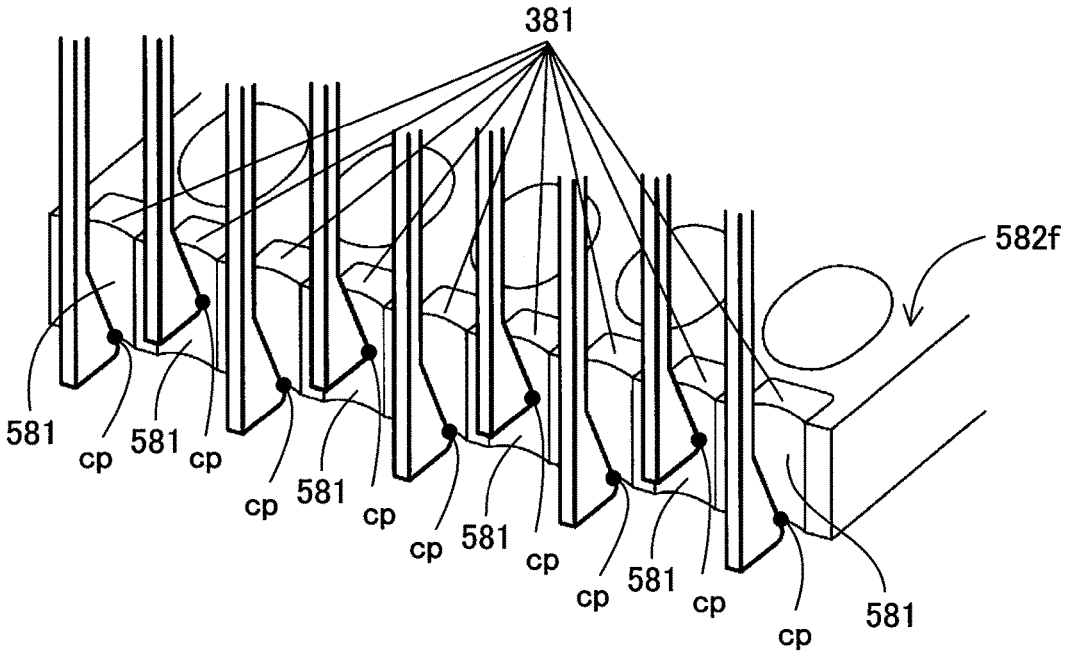
FIG. 103 is a diagram illustrating the state of contact between the fluid container-side terminal member and the device-side terminals.

FIG. 102 is a diagram illustrating a fluid container-side terminal member 582*f* having the fluid container-side terminals 581. FIG. 103 is a diagram illustrating the state of contact between the fluid container-side terminal member 582*f* and the device-side terminals 381 (shown in FIG. 41A). The fluid container 50 may have the fluid container-side terminal member 582*f* configured to come into contact with the device-side terminals 381 and thereby to be electrically connectable with the electrical connection structure 382, instead of the circuit board 582 of the above embodiment. The fluid container-side terminal member 582*f* is a member protruded from the placement element 594. As shown in FIG. 103, an end face of the fluid container-side terminal member 582*f* forms a plurality of (nine in the illustrated example) fluid container-side terminals 581. The fluid container-side terminals 581 have contacts cp arranged to come into contact with the device-side terminals 381 in the mounting state of the fluid container 50. As shown in FIG. 102, the virtual plane TP defined by the plurality of contacts cp is inclined in the direction including the +Z-axis direction (upward in the direction of gravity) component and the −K1-axis direction (first direction) component, like the above embodiment. This configuration also has the similar advantageous effects to those of the above embodiment.

C-3. Modification of Container-Side Electrical Connection Structure 58

In the above embodiments, the container-side electrical connection structure 58 includes the circuit board 582. This is, however, not restrictive, but the container-side electrical connection structure 58 may have any configuration including the contacts cp arranged to come into contact with the device-side electrical connection structure 382. For example, the circuit board 582 may not have the storage unit 583. In another example, the container-side electrical connection structure 58 may have a contact of a terminal used for detection of mounting and demounting of the fluid container 50. The container-side electrical connection structure 58 may have a circuit board assembly including a flexible cable, such as a flexible printed circuit board (FPC). This circuit board assembly may have contacts arranged on its one end portion to come into contact with the device-side electrical connection structure 382. The other end portion of the circuit board assembly may be connected, for example, with a reset device. This modified configuration may be employed, instead of the circuit board 582 or in addition to the circuit board 582.

C-4. Other Modifications

C-4-1. First Modification

In the above embodiments, the guide structure 250 is a groove as shown in FIG. 33, and the connection structure-side engagement element 206 (shown in FIG. 31) guided by the guide structure 250 is a projection. These geometries are, however, not restrictive, but the guide structure 250 and the connection structure-side engagement element 206 may have any geometries that enable the connection structure-side engagement element 206 to be guided by the guide structure 250 and to be engaged with the guide structure 250 at the engagement position st. For example, the guide structure 250 may be formed in a convex shape, and the connection structure-side engagement element 206 may be formed in a groove-like shape to receive the convex guide structure 250 therein.

C-4-2. Second Modification

In the above embodiments, the fluid container body 52 is made of a material having flexibility. This is, however, not restrictive, and the fluid container body 52 may be made of any material that enables the fluid container body 52 to contain a fluid. For example, the fluid container body 52 may be partly made of a material having flexibility or may be made of a hard material that substantially does not change its volume irrespective of the consumption of the fluid. Forming at least part of the fluid container body 52 of the material having flexibility causes the volume of the fluid container body 52 to be varied according to the amount of ink contained in the fluid container body 52.

C-4-3. Third Modification

In the above embodiments, as shown in FIG. 9, the connecting direction of the fluid container 50 with the mounting assembly unit 30 is the horizontal direction (K1-axis direction). This is, however, not restrictive, but the connecting direction may be any direction including a first direction (K1-axis direction) component. For example, the connecting direction may be a direction including a −Z-axis direction component and a −K1-axis direction component. In this case, the movable support structure 40 is also moved in a direction corresponding to the connecting direction of the fluid container 50.

C-4-4. Fourth Modification

The present invention is not limited to the inkjet printer or its fluid container 50 but is also applicable to any printing device (fluid consuming device) configured to eject another fluid but ink and a fluid container configured to contain another fluid. For example, the invention may be applied to any of various fluid consuming devices and their fluid containers:

(1) image recording device, such as a facsimile machine;

(2) color material ejection device used to manufacture color filters for an image display device, e.g., a liquid crystal display;

(3) electrode material ejection device used to form electrodes of, for example, an organic EL (electroluminescence) display and a field emission display (FED);

(4) fluid consuming device configured to eject a bioorganic material-containing fluid used for manufacturing biochips;

(5) sample ejection device used as a precision pipette;

(6) ejection device of lubricating oil;

(7) ejection device of a resin solution;

(8) fluid consuming device for pinpoint ejection of lubricating oil on precision machines such as watches or cameras;

(9) fluid consuming device configured to eject a transparent resin solution, such as an ultraviolet curable resin solution, onto a substrate in order to manufacture a hemispherical microlens (optical lens) used for, for example, optical communication elements;

(10) fluid consuming device configured to eject an acidic or alkaline etching solution in order to etch a substrate or the like; and

(11) fluid consuming device equipped with a fluid ejection head for ejecting a very small volume of droplets of any other fluid.

The "droplet" herein means the state of fluid ejected from the fluid consuming device and may be in a granular shape, a teardrop shape or a tapered threadlike shape. The "fluid" herein may be any material ejectable by the fluid consuming device. The "fluid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "fluid". The "fluid" is not limited to the liquid state as one of the three states of matter but includes solutions, dispersions and mixtures of the functional solid material particles, such as pigment particles or metal particles, solved in, dispersed in or mixed with a solvent. Typical examples of the fluid include ink described in the above embodiment and liquid crystal. The ink herein includes general water-based inks and oil-based inks, as well as various fluid compositions, such as gel inks and hot-melt inks. In an application using a fluid container configured to contain UV ink curable by UV radiation and connected with the printer, the arrangement of the fluid container coming off the placement surface reduces the likelihood that the UV ink is cured by transmission of heat from the placement surface to the fluid container.

The invention is not limited to any of the embodiments, the examples and the modifications described herein but may be implemented by a diversity of other configurations without departing from the scope of the invention. For example, the technical features of the embodiments, examples and modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A fluid container, detachably connectable with a fluid consuming device, the fluid container comprising:

a fluid supply structure configured to be connectable with a fluid supply connection unit of the fluid consuming device, wherein the fluid supply connection unit comprises:

a stationary structure supported by a casing of the fluid consuming device and configured to have a fluid introducing structure to which the fluid supply structure is connected; and a movable support structure supported by the stationary structure and configured to be movable in a first direction and in a second direction with supporting the fluid supply structure of the fluid container, the first direction being a straight direction in which the fluid container is connected to the fluid consuming device, the second direction being a straight direction, in which the fluid container is disconnected from the fluid consuming device, wherein the movable support structure includes a guide structure having a support structure-side engagement element, the stationary structure includes a connection structure-side engagement element configured to be engaged with the support structure-side engagement element, wherein the fluid supply structure is configured to be supported by the movable support structure and the connection structure-side engagement element is configured to move along the guide structure, when the fluid supply structure is connected with the fluid introducing structure or when the fluid supply structure is disconnected from the fluid introducing structure.

2. The fluid container according to claim 1, wherein the stationary structure includes a motion guide assembly, wherein the motion guide assembly includes guide parts to guide motion of the movable support structure either in the first direction or in the second direction and the guide parts are placed on respective sides across the guide structure.

3. The fluid container according to claim 2, wherein the fluid supply connection unit includes a main body-side electrical connection structure located between the parts of the motion guide assembly, the fluid container further comprising: a contact configured to come into contact with a device-side electrical connection structure of the fluid consuming device.

4. The fluid container according to claim 3, wherein the movable support structure is biased in the second direction, the connection structure-side engagement element is engaged with the support structure-side engagement element when the contact comes into contact with the main body-side electrical connection structure, and an area in which the contact is formed is located in a third direction that passes through an engagement position where the connection structure-side engagement element is engaged with the support structure-side engagement element and is perpendicular to the second direction.

5. The fluid container according to claim 3, wherein the fluid container includes a plurality of the contacts, wherein surface of the plurality of contacts defines a virtual plane, wherein the virtual plane is inclined with respect to the first direction.

6. The fluid container according to claim 1, further comprising: a pushing part located on a second direction side of the fluid supply structure and configured to push the fluid supply structure in the first direction.

7. The fluid container according to claim 2, further comprising:

a pushing part located on a second direction side of the fluid supply structure and configured to push the fluid supply structure in the first direction, wherein the motion guide assembly includes a plurality of guide restriction parts configured to restrict motion of the movable support structure in a direction perpendicular to the first direction, and the pushing part is located in an area defined by the plurality of guide restriction parts in a view from a second direction side, when the fluid supply structure is supported by the movable support structure and is connected with the fluid introducing structure or when the fluid supply structure is disconnected from the fluid introducing structure.

8. The fluid container according to claim 1, wherein the movable support structure includes a restriction element configured to restrict motion of the movable support structure in a direction intersecting with the second direction, and the restriction element is provided to come into contact with an abutment part provided on the stationary structure.

9. The fluid container according to claim 1, wherein the movable support structure can take such a first state by motion in the second direction and a second state by motion in the first direction, the movable support structure is protruded outward relative to the stationary structure in the first state, the movable support structure is placed in the stationary structure in the second state.

10. The fluid container according to claim 1, wherein the fluid container comprises a fluid container body configured to contain the fluid, and wherein the fluid supply structure is located at one end portion of the fluid container body and is configured to be supported by the movable support structure such that the fluid container body is located below the fluid supply structure in a direction of gravity.

11. The fluid container according to claim 1, wherein the first direction is a horizontal direction and the second direction is a horizontal direction opposite to the first direction.

* * * * *